US011453021B2

(12) United States Patent
McDonagh et al.

(10) Patent No.: US 11,453,021 B2
(45) Date of Patent: Sep. 27, 2022

(54) BOTTLE TOP PUMP

(71) Applicant: OP-Hygiene IP GmbH, Niederbipp (CH)

(72) Inventors: Padraig McDonagh, County Sligo (IE); Heiner Ophardt, Arisdorf (CH)

(73) Assignee: OP-Hygien IP GmbH, Niederbipp (CH)

( * ) Notice: Subject to any disclaimer, the term of this patent is extended or adjusted under 35 U.S.C. 154(b) by 0 days.

(21) Appl. No.: 17/320,923

(22) Filed: May 14, 2021

(65) Prior Publication Data

US 2021/0354155 A1 Nov. 18, 2021

Related U.S. Application Data

(60) Provisional application No. 63/025,034, filed on May 14, 2020.

(51) Int. Cl.
*B05B 11/00* (2006.01)
*A47K 5/12* (2006.01)

(52) U.S. Cl.
CPC ..... *B05B 11/3015* (2013.01); *A47K 5/1211* (2013.01)

(58) Field of Classification Search
CPC ..... B05B 11/3015; B05B 11/0044; B05B 11/3047; A47K 5/1211; B65D 51/1677; B65D 2205/00
See application file for complete search history.

(56) References Cited

U.S. PATENT DOCUMENTS 4,016,999 A * 4/1977 Denzer ..... B65B 31/047 53/88
5,906,288 A * 5/1999 Dwinell ..... B65D 51/1677 222/541.9
7,748,573 B2 7/2010 Anhuf et al.
9,181,007 B2 * 11/2015 Forrest ..... B65D 51/1677
2003/0168462 A1 * 9/2003 Kiyota ..... B65D 47/32 215/388
2021/0354155 A1 * 11/2021 McDonagh ..... B05B 11/0044

FOREIGN PATENT DOCUMENTS

WO WO-8907575 A1 * 8/1989 ..... B67D 7/0255
WO 2019213693 11/2019

* cited by examiner

*Primary Examiner* — Jeremy Carroll
*Assistant Examiner* — Bob Zadeh
(74) *Attorney, Agent, or Firm* — Thorpe North & Western, LLP; Peter M. de Jonge; Kurt Hendricks

(57) ABSTRACT

A pump assembly which provides a frangible air vent mechanism for providing communication between the atmosphere and the interior of a bottle to which the pump assembly is to be coupled. A vent port is provided through a bottle cap member having an inner end open into the bottle and an outer end open to the atmosphere. A frangible plug member is received in the vent port with the frangible plug member when unbroken preventing flow through the vent port and the plug member when broken permitting flow through the vent port. A vent tab member is coupled to the frangible member with the vent tab member extending from the frangible member accessible on the exterior of the bottle cap member for engagement to apply forces to the vent tab that are translated to the frangible vent member to break the frangible member.

17 Claims, 38 Drawing Sheets

BOTTLE TOP PUMP

BACKGROUND OF THE INVENTION

Fluid dispensers are known for dispensing hand cleaning fluid onto a person's hand.

Previously known pump assemblies that are to be coupled to a bottle against removal as for but one time use suffer the disadvantage that no adequate mechanisms are provided to visually indicate whether the pump assembly has been previously used.

Previously known bottle assemblies in which a pump assembly is coupled to a bottle against removal suffer the further disadvantage that they often leak during transport and storage when inverted or tipped over from an upright transport position.

SUMMARY OF THE INVENTION

To at least partially overcome some of these disadvantages of previously known pump assemblies, the present invention provides each of:

a bottle top pump assembly;

a bottle assembly including a bottle top pump assembly and a non-collapsible bottle;

a dispenser and a removable reservoir assembly;

a method of use of a bottle assembly;

a method of use of a dispenser; and a removable reservoir assembly.

To at least partially overcome some of the disadvantages of previously known devices, the present invention provides a tamper evident mechanism that indicates whether a pump assembly has previously been used.

To at least partially overcome other of the disadvantages of previously known devices, the present invention provides a pump assembly which provides a frangible air vent mechanism for providing communication between the atmosphere and the interior of a bottle to which the pump assembly is to be coupled.

In one aspect the present invention provides a piston pump arrangement comprising:

a bottle cap member providing a liquid chamber coaxial about a center axis, a piston member having a piston portion coaxially received in the chamber for coaxially reciprocal movement of the piston member between retracted positions and extended positions relative the bottle cap member to draw fluid through the liquid chamber and discharge the fluid out a discharge outlet carried on the piston member, the piston member rotatable about the center axis relative the bottle cap member between a first rotational position and a second rotational position, in the first rotational position on relative movement of the piston member from an extended position to a retracted position a latch mechanism couples the piston member to the bottle cap member in a latched condition against axial movement toward the extended positions, in the latched condition the piston member is rotatable about the axis relative the bottle cap member from the first rotational position to the second rotational position in which second rotational position the piston member is reciprocally movable relative the bottle cap member between the retracted position and the extended positions, a resistance member preventing, when the piston member is in the latched condition, the rotation of the piston member about the axis relative the bottle cap member from the first rotational position to the second rotational position, unless a rotational force is applied the piston member relative the bottle cap member greater than a threshold rotational force.

Preferably, the resistance member comprises a frangible member preventing the rotation of the piston member about the axis relative the bottle cap member from the first rotational position to the second rotational position unless the frangible member is broken.

Preferably, the frangible member when unbroken and the frangible member when broken is visible from the exterior of the pump assembly and can be used as a visual indication as to whether the piston member has been moved from the latched condition relative the bottle cap member.

Preferably, the piston pump arrangement in combination with a dispenser assembly having a housing to which the pump assembly is removably coupled to dispense fluid from a bottle, the piston pump assembly movable relative the housing to couple the pump assembly to the housing, with the piston member in the latched condition during movement of the piston pump assembly relative the housing to couple the pump assembly to the housing, engagement between a cam surface provided on the piston member and a cam surface on the housing rotate the piston member about the axis relative the bottle cap member from the first rotational position to the second rotational position.

In another aspect the present invention provided a bottle assembly including:

a bottle enclosed but for an outlet opening.

a bottle cap member secured to the bottle about the opening, the bottle cap member sealing the outlet against fluid flow into or out of the bottle, a vent port through the bottle cap member having an inner end open into the bottle and an outer end open to the atmosphere, a frangible plug member received in the vent port, the frangible plug member when unbroken preventing flow through the vent port, the plug member when broken permitting flow through the vent port, a vent tab member coupled to the frangible member, the vent tab member extending from the frangible member accessible on the exterior of the bottle cap member for engagement to apply forces to the vent tab that are translated to the frangible vent member to break the frangible member.

Preferably, the bottle assembly is in combination with a dispenser assembly having a housing to which the bottle assembly is removably coupled to dispense fluid from a bottle, the bottle assembly movable relative the housing to couple the bottle assembly to the housing, with the frangible plug member received in the vent port unbroken during movement of the bottle assembly relative the housing to couple the bottle assembly to the housing engagement between a cam surface provided on the vent tab member and a cam surface on the housing applies forces to the vent tab that break the frangible member.

In a 1$^{st}$ aspect, the present invention provides a bottle assembly including:

a bottle having an outlet opening, a bottle cap member secured to the bottle about the outlet opening, a vent port through the bottle cap member having an inner end open into the bottle and an outer end open to the atmosphere, a frangible plug member received in the vent port, the frangible plug member preventing flow through the vent port when frangible plug member is intact and not broken, a vent tab on the exterior of the bottle cap member, the vent tab coupled to the frangible plug member, the vent tab extending from the frangible plug member accessible on the exterior of the bottle cap member for engagement to apply forces to the vent tab that become translated to the frangible plug member breaking the frangible plug member, the frangible plug member when broken permitting flow through the vent port, the vent tab coupled to the frangible plug member at a load juncture, the vent tab coupled to the bottle cap member at a fulcrum juncture spaced from the load juncture, the vent tab comprising a lever member extending from the fulcrum juncture away from the fulcrum juncture to a distal end carrying an engagement surface, wherein the load juncture, fulcrum juncture and engagement surface are juxtaposed such that with the application of forces to the engagement surface of the lever member pivots about the fulcrum juncture displacing the load juncture and applying forces across the frangible plug member to break the frangible plug member.

In a $2^{nd}$ aspect, the present invention provides in accordance with the $1^{st}$ aspect, a bottle assembly wherein the forces applied across the frangible plug member to break the frangible plug member are tension forces.

In a $3^{rd}$ aspect, the present invention provides in accordance with the $1^{st}$ or $2^{nd}$ aspects, a bottle assembly wherein either: the load juncture is in between the fulcrum juncture and the engagement surface, or, the fulcrum juncture is in between the load juncture and the engagement surface.

In a $4^{th}$ aspect, the present invention provides in accordance with any one of the $1^{st}$ to $3^{rd}$ aspects, a bottle assembly wherein the lever member is accessible on the exterior of the bottle cap member for engagement to apply forces to the engagement surface to break the frangible plug member.

In a $5^{th}$ aspect, the present invention provides in accordance with any one of the $1^{st}$ to $4^{th}$ aspects, a bottle assembly wherein the bottle cap member is injected molded from plastic material integrally forming the vent port, the frangible plug member and the vent tab including the lever member, fulcrum juncture and load juncture with the frangible plug member intact closing the vent port.

In a $6^{th}$ aspect, the present invention provides in accordance with any one of the $4^{th}$ to $5^{th}$ aspects, a bottle assembly wherein the fulcrum juncture is flexible.

In a $7^{th}$ aspect, the present invention provides in accordance with any one of the $1^{st}$ to $6^{th}$ aspects, a bottle assembly in combination with a dispenser having a housing to which the bottle assembly is removably coupled to dispense fluid from the bottle, the bottle assembly movable relative the housing to couple the bottle assembly to the housing in a dispensing position for dispensing of fluid from the bottle assembly, during movement of the bottle assembly relative the housing toward the dispensing position engagement between the engagement surface provided on the lever member and a cam surface on the housing applies forces to the lever member that pivots the lever member about the fulcrum juncture to break the frangible plug member.

In an $8^{th}$ aspect, the present invention provides in accordance with the $7^{th}$ aspect, a bottle assembly wherein the cam surface on the housing is directed in a forward direction, and the dispenser is mounted vertically, the bottle assembly is movable in a rearward direction relative the housing to couple the bottle assembly to the housing in the dispensing position, the engagement surface is directed in the rearward direction, the cam surface on the housing is directed in a forward direction opposite to the rearward direction.

In a $9^{th}$ aspect, the present invention provides in accordance with the $7^{th}$ aspect, a bottle assembly wherein the lever member extends from the fulcrum juncture to the distal end in the rearward direction and one or more of the group of:

a. upwardly or rearwardly, and b. laterally.

In a $10^{th}$ aspect, the present invention provides in accordance with any one of the $1^{st}$ to $9^{th}$ aspects, a bottle assembly wherein the bottle is enclosed but for the outlet opening.

In an $11^{th}$ aspect, the present invention provides a bottle assembly in combination with a dispenser having a housing to which the bottle assembly is removably coupled to dispense fluid from a bottle, the bottle assembly comprising:

a bottle having an outlet opening, a bottle cap member secured to the bottle about the outlet opening, a vent port through the bottle cap member having an inner end open into the bottle and an outer end open to the atmosphere, a frangible plug member received in the vent port, the frangible plug member preventing flow through the vent port when frangible plug member is intact and not broken, a vent tab on the exterior of the bottle cap member, the vent tab coupled to the frangible plug member, the vent tab extending from the frangible plug member accessible on the exterior of the bottle cap member for engagement to apply forces to the vent tab that become translated to the frangible plug member breaking the frangible plug member, the frangible plug member when broken permitting flow through the vent port, the bottle assembly movable relative the housing to couple the bottle assembly to the housing in a dispensing position for dispensing of fluid from the bottle assembly, during movement of the bottle assembly relative the housing toward the dispensing position engagement between the engagement surface provided on the vent tab and a cam surface on the housing applies forces to the vent tab that moves the vent tab to break the frangible plug member.

In a $12^{th}$ aspect, the present invention provides a piston pump assembly comprising:

a bottle cap member providing a fluid chamber coaxial about a center axis, a piston member having a piston portion coaxially received in the chamber for coaxially reciprocal movement of the piston member between a retracted position and an extended position relative the bottle cap member to draw fluid through the chamber and discharge the fluid out a discharge outlet carried on the piston member, the piston member rotatable about the axis relative the bottle cap member between a first rotational position and a second rotational position, in the first rotational position on relative movement of the piston member from the extended position to the retracted position, a latching system couples the piston member to the bottle cap member in a latched configuration against axial movement toward the extended position, in the latched configuration, the piston member is rotatable about the axis relative the bottle cap member from the first rotational position to the second rotational position in which second rotational position the piston member is reciprocally movable relative the bottle cap member between the retracted position and the extended position, the latching system includes a latching mechanism and a catch mechanism, a first of the piston member and the bottle cap member carrying latching mechanism including a latch member spaced radially from the axis and a second of the piston member and the bottle cap member, that is, not the first of the of the piston member and the bottle cap member carrying the catch mechanism, the latch member comprising a latch surface directed axially in a first axial direction, the catch mechanism having a catch surface directed axially in a second axial direction opposite the first axial direction, in the first rotational position the latch surface of the latch member is at a same relative circumferential location about the axis as a circumferential location of the catch surface, and the latch surface and the catch surface are axially opposed to each other, in the first rotational position with the piston member in the extended position, the latch surface of the latch member is axially spaced from the catch surface of the catch mechanism, in the first rotational position on relative movement of the piston member from the extended position to the retracted position, the latch member becomes engaged with the catch mechanism with the latch surface engaged with the catch surface in the latched configuration against relative axial movement of the piston member toward the extended position, when the piston member is in the first rotational position in the latched configuration, on rotation of the piston member about the axis relative the bottle cap member from the first rotational position to the second rotational position circumferential movement of the latch member relative the catch mechanism moves the latch surface to a different relative circumferential location about the axis than a circumferential location of the catch surface thereby disengaging the latch surface from engagement with the catch surface, one of the piston member and the bottle cap member includes a frangible member spaced radially from the axis with a circumferentially directed first engagement surface directed circumferentially in a first direction, another of the piston member and the bottle cap member, that is, not the one of the piston member and the bottle cap member, includes an engagement member with a circumferentially directed second engagement surface directed circumferentially in a second direction opposite the first direction, the frangible member positioned on the one of the piston member and the bottle cap member with the first engagement surface in circumferential opposition to the second engagement surface such that when the piston member is in the first rotational position in the latched configuration with the frangible member intact and unbroken, rotation of the piston member about the axis towards the second rotational position circumferentially moves the second engagement surface into circumferential engagement with the first engagement surface with such circumferential engagement preventing the rotation of the piston member to the second rotational position unless the frangible member is broken by applying a rotational force to the piston member relative the bottle cap member greater than a first threshold rotational force required to break the frangible member by the circumferential engagement between the second engagement surface and the first engagement surface, in the second rotational position the bottle cap member is axially movable relative the bottle cap member between the retracted position and the extended positions without the latch surface and the catch surface engaging.

In a 13$^{th}$ aspect, the present invention provides a piston pump assembly in accordance with the 12$^{th}$ aspect wherein when the piston member is in the first rotational position in the latched configuration, on rotation of the piston member about the axis relative the bottle cap member from the first rotational position toward the second rotational position in the circumferential movement of the latch member relative the catch mechanism latch surface is slidable circumferentially relative to and in engagement with the catch surface.

In a 14$^{th}$ aspect, the present invention provides a piston pump assembly in accordance with the 12$^{th}$ or 13$^{th}$ aspect wherein:

the latch member comprises a hook member extending axially parallel to the axis from a proximate end to a distal end, the hook member having a side tab that extends laterally of the axis and carries the latch surface, the catch mechanism having an axially extending latch opening with the catch surface adjacent the latching opening, in the first rotational position on relative movement of the piston member from the extended position to the retracted position the hook member becomes located within the latch opening with the latch surface engaged with the catch surface in the latched configuration preventing relative axial movement of the piston member toward the extended position.

In a 15$^{th}$ aspect, the present invention provides a piston pump assembly in accordance with the 14$^{th}$ aspect wherein:

the catch mechanism including a free passage opening located circumferentially adjacent the latch opening positioned such that when the piston member is in the first rotational position in the latched configuration, on rotation of the piston member about the axis relative the bottle cap member to the second rotational position the hook member is moved from the latch opening circumferentially into the free passage opening, locating the hook member to extend axially through the free passage opening in the retracted position and the second rotational position, in second rotational position, the hook member is freely axially movable in the free passage opening permitting reciprocal axial movement of the bottle cap member between the retracted position and the extended position.

In a 16$^{th}$ aspect, the present invention provides a piston pump assembly in accordance with the 15$^{th}$ aspect wherein:

the second of the piston member and the bottle cap member carrying the catch mechanism is the one of the piston member and the bottle cap member that includes the frangible member, the frangible member positioned on the second of the piston member and the bottle cap member with the first engagement surface in the free passage opening or between the latch opening and the free passage opening such that when the piston member is in the first rotational position in the latched configuration with the frangible member intact and unbroken, rotation of the piston member towards the second rotational position circumferentially moves the second engagement surface on the hook member into circumferential engagement with the first engagement surface on the frangible member with such circumferential engagement preventing the rotation of the piston member 46 to the second rotational position until the frangible member is broken by applying the rotational force to the piston member relative the bottle cap member greater than the first rotational threshold force required to break the frangible member.

In a $17^{th}$ aspect, the present invention provides a piston pump assembly in accordance with the $15^{th}$ or $16^{th}$ aspect wherein the frangible member comprises a thin wall closing the latch opening from the free passage opening.

In an $18^{th}$ aspect, the present invention provides a piston pump assembly in accordance with the $15^{th}$ or $16^{th}$ aspect wherein the frangible member is provided within the free passage opening and prevents the hook member from entering the free passage opening sufficiently to exit the latch opening unless the frangible member is broken.

In a $19^{th}$ aspect, the present invention provides a piston pump assembly in accordance with the $18^{th}$ aspect wherein the frangible member is provides as a door-like member extending transversely across the free passage opening and on the frangible member being broken the door-like member is displaced away from the latch opening by movement of the hook member.

In a $20^{th}$ aspect, the present invention provides a piston pump assembly in accordance with the $19^{th}$ aspect wherein the door-like member is coupled in the free passage opening by a hinge connection along an edge of the door-like member remote from the latch opening and also coupled in the free passage opening by a frangible tab the proximate the latch opening, wherein with breaking of the frangible member by breaking the frangible tab the door-like member is pivoted about the hinge connection by movement of the hook member 306 with the door-like member retained within the free passage opening by the hinge mechanism.

In a $21^{st}$ aspect, the present invention provides a piston pump assembly in accordance with any one of the $12^{th}$ to $20^{th}$ aspects wherein:

the second of the piston member and the bottle cap member carrying the latch member is the bottle cap member.

In a $22^{nd}$ a aspect, the present invention provides a piston pump assembly in accordance with the $21^{st}$ aspect wherein the bottle cap member includes a cap support plate extending normal the axis with a first surface directed axially in one direction and a second surface directed in an opposite direction, the latch opening extending through the cap support plate from the first surface to the second surface, the latch surface provided by the second surface adjacent the latch opening, in the first rotational position in the latched configuration on relative movement of the piston member from the extended position to the retracted position the hook member becomes located within the latch opening with the latch surface engaged with the catch surface in the latched configuration preventing relative axial movement of the piston member toward the extended position.

In a $23^{rd}$ aspect, the present invention provides a piston pump assembly in accordance with any one of the $12^{th}$ to $22^{nd}$ aspects wherein the one of the piston member and the bottle cap member that includes the frangible member is the bottle cap member.

In a $24^{th}$ aspect, the present invention provides a piston pump assembly in accordance with any one of the $12^{th}$ to $23^{rd}$ aspects wherein the frangible member when broken is visible from an exterior of the pump assembly as being broken and provides a visual indication that the piston member has been moved from the latched configuration to an unlatched configuration.

In a $25^{th}$ aspect, the present invention provides a piston pump assembly in accordance with any one of the $12^{th}$ to $24^{th}$ aspects including a resistance mechanism preventing, when the piston member is in the latched configuration, the rotation of the piston member about the axis relative the bottle cap member from the first rotational position, unless a rotational force is applied the piston member relative the bottle cap member in a direction from the first rotational position towards the second rotational position greater than a second threshold rotational force.

In a $26^{th}$ aspect, the present invention provides a piston pump assembly in accordance with the $25^{th}$ aspect wherein the resistance mechanism including:

a circumferentially directed first resistance surface on the piston member spaced radially from the axis directed circumferentially in a first direction, a circumferentially directed second resistance surface on the bottle cap member spaced radially from the axis directed circumferentially in a second direction opposite the first direction, the second resistance surface circumferentially opposed to the first resistance surface, the first resistance surface positioned on the piston member with the first resistance surface in circumferential opposition to the second resistance surface such that when the piston member is in the first rotational position in the latched configuration the first resistance surface is in engagement with the second resistance surface resisting rotation of the piston member about the axis towards the second rotational position unless the rotational force applied the piston member relative the bottle cap member is greater than the second threshold rotational force, a circumferentially directed first stop surface on the piston member spaced radially from the axis directed circumferentially in the second direction, a circumferentially directed second stop surface on the bottle cap member spaced radially from the axis directed circumferentially in the first direction circumferentially opposed to the opposite the first stop surface, the first stop surface positioned on the piston member with the first stop surface in circumferential opposition to the second stop surface such that when the piston member is in the first rotational position in the latched configuration the first stop surface is in engagement with the second stop surface preventing rotation of the piston member about the axis from the first rotational away from the second rotational position.

In a $27^{th}$ aspect, the present invention provides a piston pump assembly in accordance with any one of the $15^{th}$ to $20^{th}$ aspects wherein the bottle cap member is injected molded from plastic material integrally forming the frangible member, the catch opening the free passage opening and the catch surface with the frangible member.

In a $28^{th}$ aspect, the present invention provides a piston pump assembly in accordance with any one of the $12^{th}$ to $27^{th}$ aspects in combination with a dispenser having a housing to which the piston pump assembly is removably coupled to dispense fluid from a bottle, the piston pump assembly movable relative the housing to couple the piston pump assembly to the housing, with the piston member in the latched configuration during movement of the piston pump assembly relative the housing to couple the pump assembly to the housing, engagement between a cam surface provided on the piston member and a camming surface on the housing rotates the piston member about the axis relative the bottle cap member from the first rotational position to the second rotational position.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
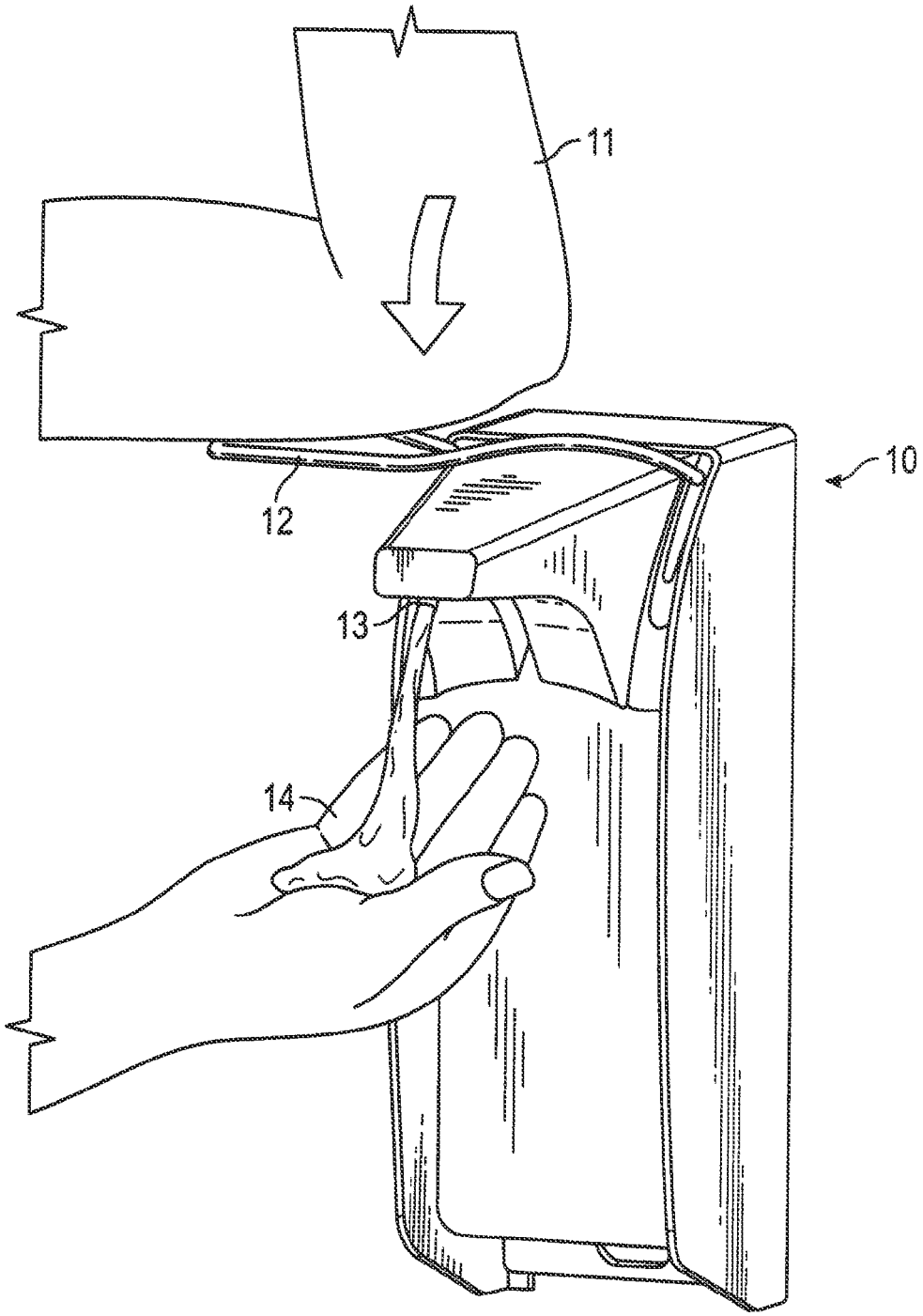
FIG. 1 is a front pictorial view of a fluid dispenser assembly in accordance with a first embodiment of the present invention in an operative position for dispensing fluid and schematically shown as being manually used by a person to dispense fluid onto a person's hand.

Reference is made first to FIG. 1 which illustrates a first embodiment of a fluid dispenser 10 adapted to be secured to a wall, not shown, and schematically illustrated in FIG. 1 as adapted for manual activation as by a person using one arm 11 to urge a lever 12 downwardly so as to dispense fluid from a nozzle 13 onto the hand 14 of the other person's arm.

Figure 2:
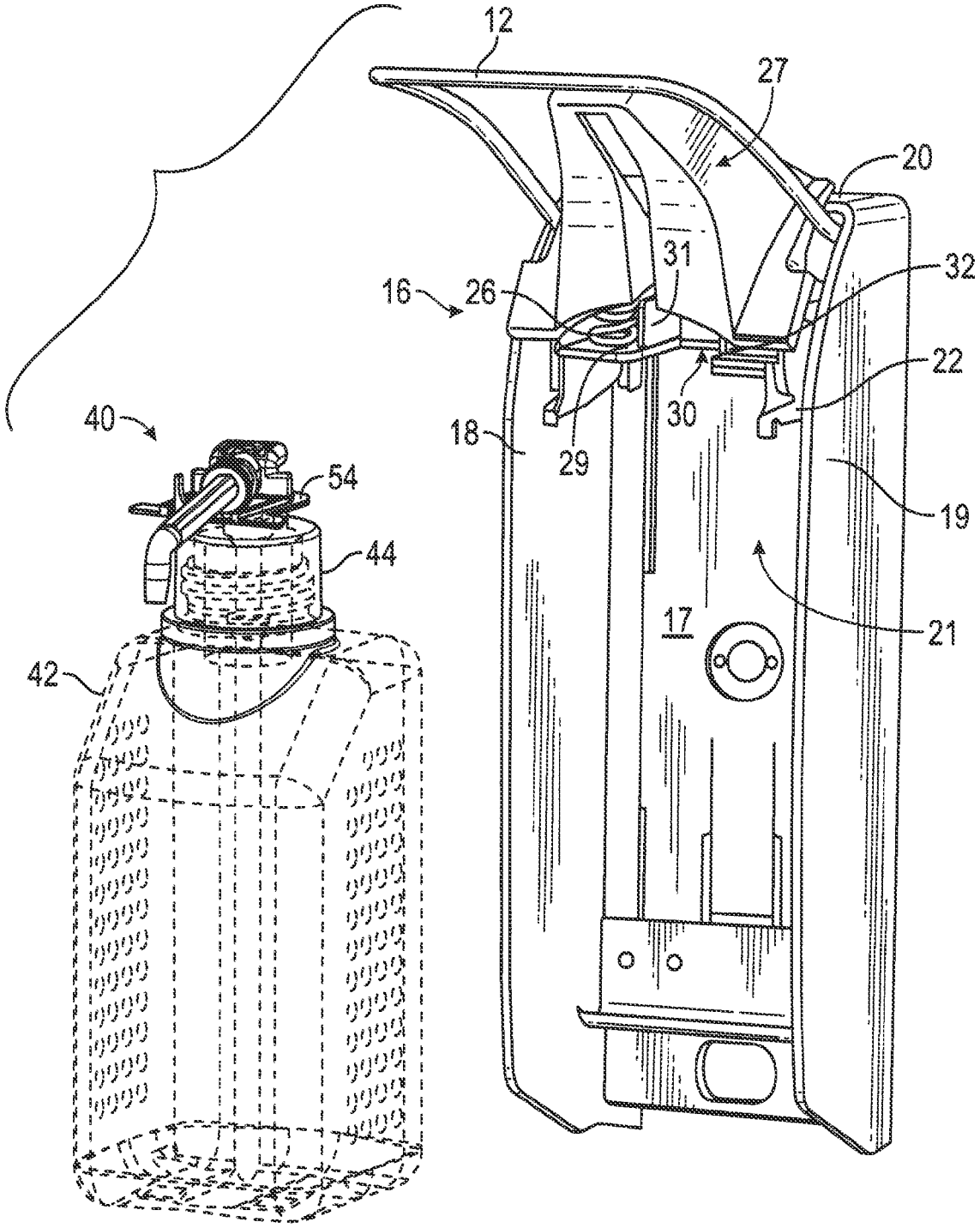
FIG. 2 is an exploded front pictorial view of the dispenser assembly of FIG. 1 with a cover/nozzle shield of the dispenser assembly in a raised open position relative a housing assembly and a bottle assembly in a latched transport configuration positioned in front of the housing assembly ready to be coupled with the housing assembly.
Figure 3:
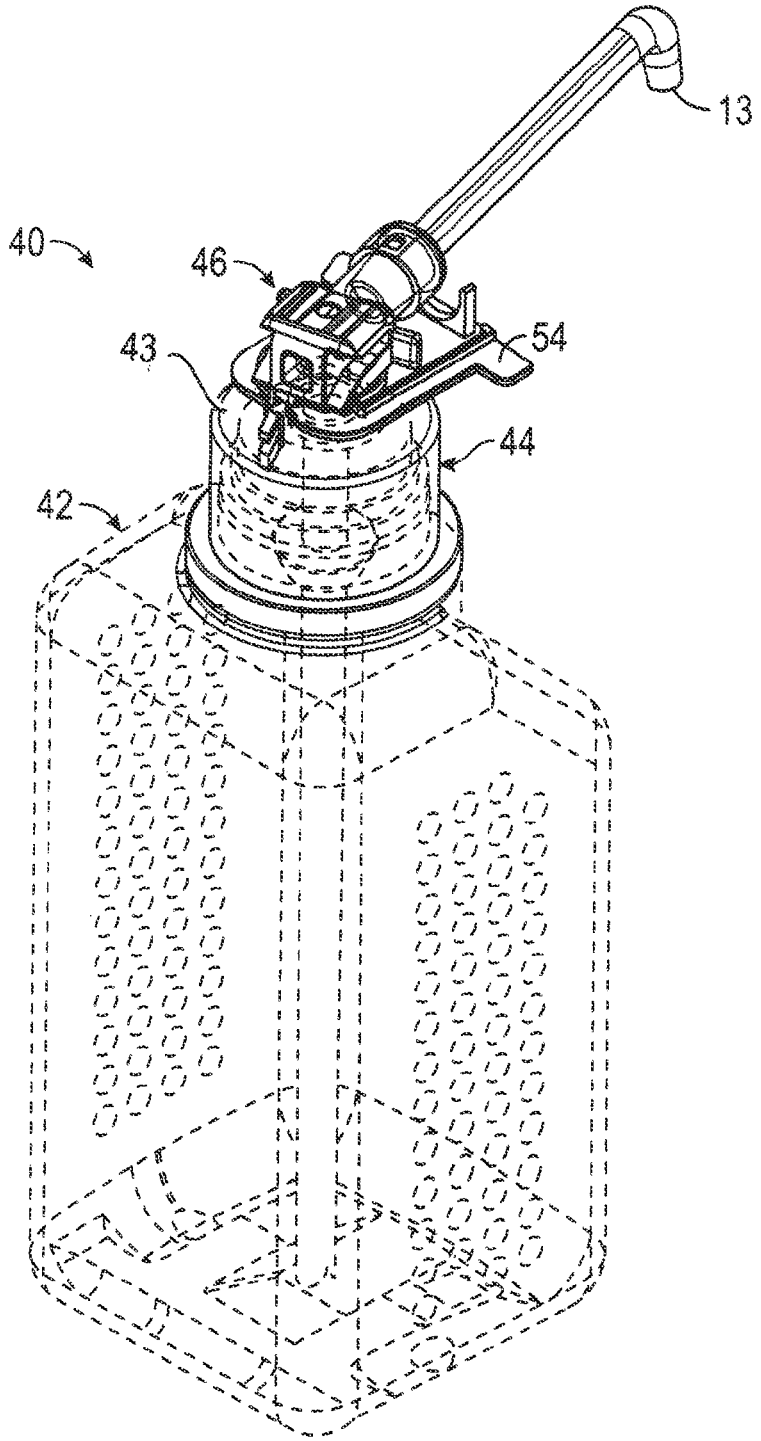
FIG. 3 is a rear pictorial view of the bottle assembly as seen in FIG. 2 in the latched transport configuration.

Referring to FIG. 2, the dispenser 10 includes a housing 16 having a back plate 17, spaced side walls 18 and 19 and a top wall 20 defining an interior 21 therebetween. A housing chassis/support member 22 is fixedly secured in the interior of the housing 16 between the side walls 18 and 19 proximate the top wall 20. The lever 12 is pivotally mounted to the support member 22. Lever springs 26 bias the lever 12 to an upper raised position. A cover or nozzle shield 27 is coupled to the support member 22 and movable between a lower closed position as seen in FIG. 1 and a raised open position as seen in FIG. 2.

FIG. 2 illustrates the dispenser 10 with the nozzle shield 27 in the raised open position in which position the nozzle shield 27 permits a bottle assembly 40 to be coupled or uncoupled to the support member 22 by sliding forwardly or rearwardly. In this regard, the support member 22, as seen in FIG. 2, carries a housing support plate 29 with a central slot 30 open at a forward end. As seen in FIG. 2, vertical side walls 31 and 32 extend upwardly from the support plate 29 on each side thereof. The bottle assembly 40 is adapted to slide rearwardly into the central slot 30 with a cap support plate 54 carried on a bottle cap member 44 of the bottle assembly 40 received above the support plate 29 between the side walls 31 and 32 to support the bottle assembly 40 on the support member 22.

Figure 6:
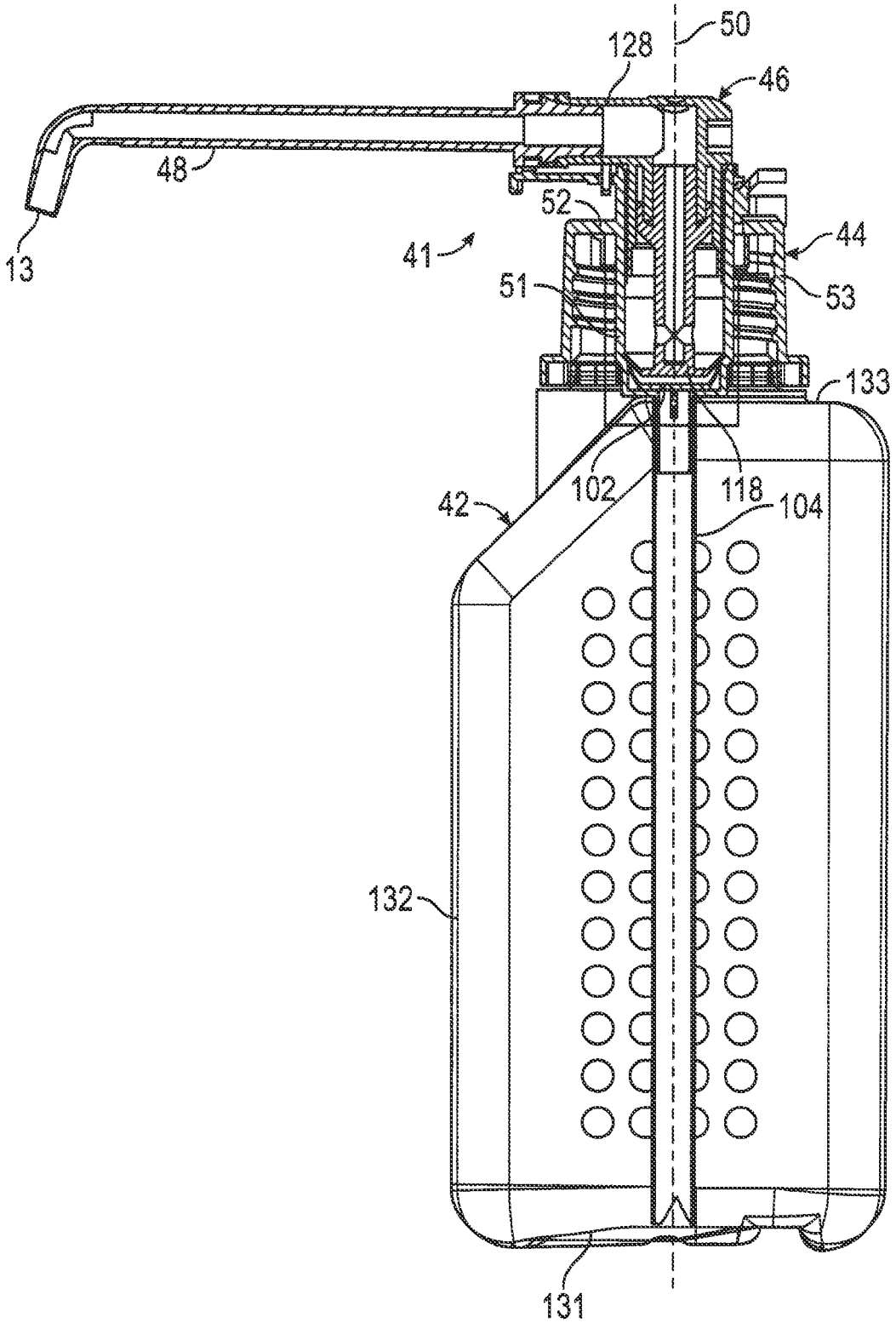
FIG. 6 is a left side cross-sectional view of the bottle assembly of FIG. 5 in the use configuration along a center plane on FIG. 5.
Figure 7:
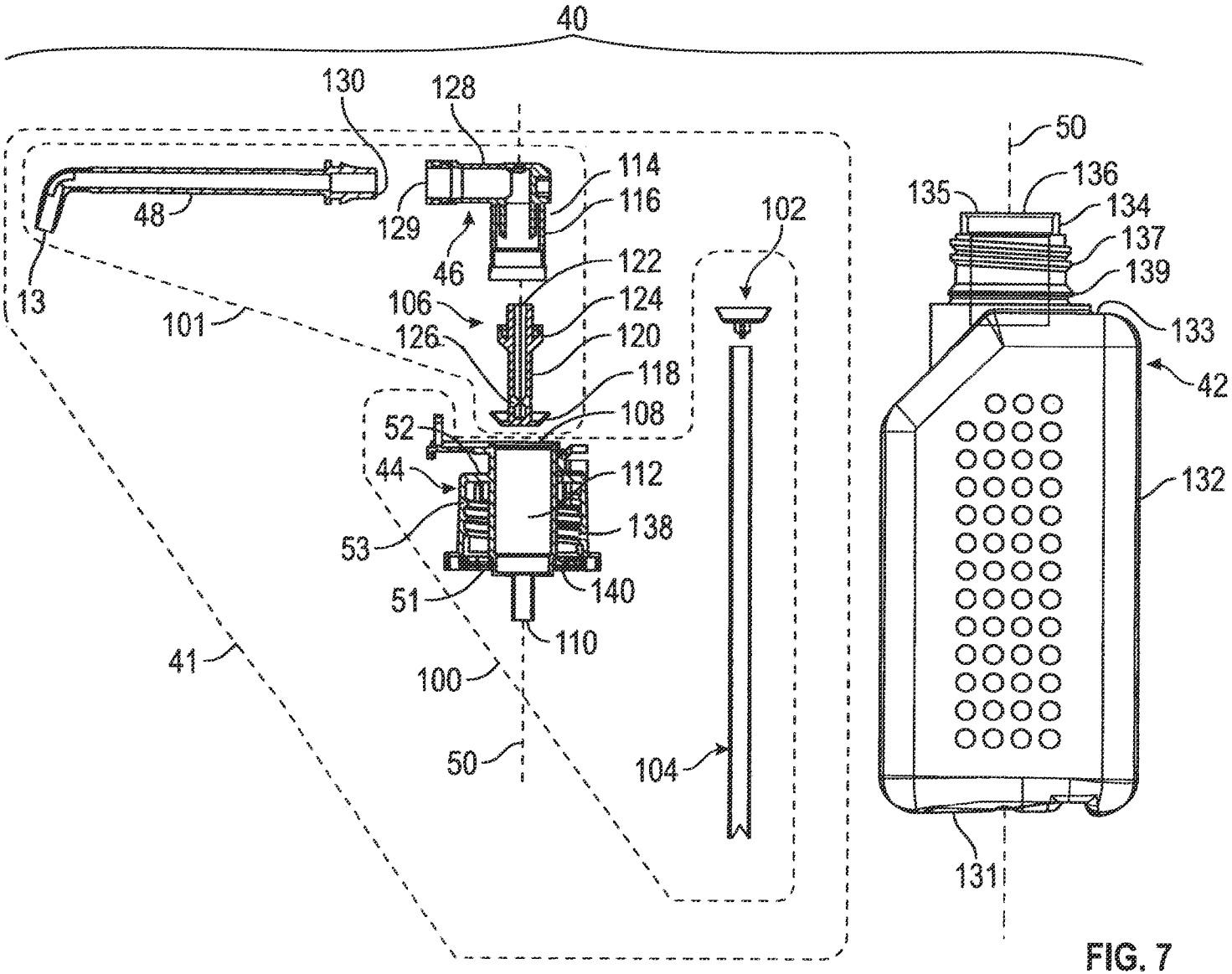
FIG. 7 is a exploded view of FIG. 6.

Reference is made to FIGS. 6 and 7 showing the bottle assembly 40 in cross-sectional views. The bottle assembly 40 includes a bottle 42 and a pump assembly 41. The bottle 42 has an outlet opening 43. The pump assembly 41 is formed from a cap assembly 100 and a piston assembly 101. The cap assembly 100 is formed from a bottle cap member 44, a one-way inlet valve 102 and a dip tube 104. The piston assembly 101 is formed from a piston member 46, a discharge tube 48 and a piston stem 106, all secured together against removal.

The bottle cap member 44 includes an inner tube member 51 open at an upper end 108 and at a lower inlet end 110 and forming a cylindrical fluid chamber 112 therein. The bottle cap member 44 has an outer tubular collar member 53 coaxially about the inner tube member 51 and joined to the inner tube member 51 by an end wall 52 forming an annular chamber between the inner tube member 51 and the outer tubular collar member 53 open at an inner open end.

The one-way inlet valve 102 is received in the inner tube member 51 below the cylindrical chamber 112 between the cylindrical chamber 112 and the lower inlet end 110. The dip tube 104 is sealably engaged to the inner tube member 51 about the lower inlet end 110. The inner tube member 51 is coaxial about a center axis 50.

The piston assembly 101 includes a piston portion 114 coaxial about the axis 50 including the piston stem 106 and a cylindrical tube 116 on the piston member 46 within which the piston stem 106 is fixedly secured. The piston stem 106 carries at its lower inner end a one-way outlet valve 118. Outwardly from the one-way outlet valve 118, the piston stem 106 forms a hollow stem tube 120 with a central passageway 113 closed at an inner end and open at an outer end 122. The piston stem 106 carries axially outwardly from the one-way outlet valve 118 a seal disc 124. An outlet port 126 located axially between the one-way outlet valve 118 and the seal disc 124 extends through an annular wall of the stem tube 120 into communication with the stem passageway 113.

The piston member 46 includes a horizontal tubular portion 128 disposed about a horizontal axis normal to the center axis 50 with a passageway through the piston member 46 from inside the piston tube 116 to inside the horizontal tube portion 128. The hollow discharge tube 48 has an inlet end 130 engaged in a sealed manner within a socket 129 at the end of the horizontal tube portion 128. The discharge tube 48 extends from its inlet end 130 to the discharge nozzle 13.

The piston portion 114 of the piston assembly 101 is coaxially slidably received within the fluid chamber 112 of the cap assembly 100 for reciprocal coaxial movement between a retracted position as shown in FIG. 6 and extended positions such that the piston assembly 101 and the cap assembly 100 act as a piston pump to draw fluid from within the bottle 42 up the dip tube 104 for discharge out the nozzle 13. A variable volume liquid compartment is defined within the fluid chamber 112 between the one-way inlet valve 102 and the one-way outlet valve 118. The one-way inlet valve 102 is received within the inner tube member 51 to prevent fluid flow axially inwardly therepast but to permit fluid flow axially outwardly therepast. The one-way outlet valve member 118 is engaged within the chamber 112 to permit fluid flow axially outwardly therepast but to prevent fluid flow axially inwardly therepast. The cylindrical tube 116 is received within the chamber 112 to prevent fluid flow axially inwardly or outwardly between the cylindrical tube 116 and the chamber 112.

The piston assembly 101 is rotatable about the axis 50 relative to the cap assembly 100. In this regard, the piston portion 114 is rotatable within the fluid chamber 112, that is, with the piston member 46 rotatable about the center axis 50 relative the bottle cap member 44.

The bottle 42 provides an interior cavity defined within its walls including a bottom wall, a side wall and a top wall 133. The top wall 133 merges into an upwardly extending neck 134 coaxial about the center axis 50 and open at an upper end 135 at an outlet opening 136. Radially outwardly extending threads 137 extend radially outwardly on the neck 134 and are adapted to engage with radially inwardly extending threads 138 provided on the outer tubular collar member 53 of the bottle cap member 44. The neck 134 of the bottle 42 also carries radially outwardly extending locking ratchet teeth 139 for engagement with radially inwardly extending lock ratchet teeth 140 provided on the outer tubular collar member 53 of the bottle cap member 44 at a lower end thereof. The bottle cap member 44 is threadably engaged onto the bottle neck 136 with as the bottle cap member 44 is threaded onto the neck 134, the locking ratchet teeth 139 on the neck 134 and the lock ratchet teeth 140 on the outer tubular collar member 53 of the bottle cap member 44 engaging to prevent rotation of the bottle cap member 44 in a direction to permit disengagement of the bottle cap member 44 from the neck 134 and with the ratchet lock teeth 140 and locking ratchet teeth 139 engaging in a manner that in a fully tightened configuration orients the bottle cap member 44 in the desired rotational position relative to the neck 134 and thereby to the bottle 42 as best seen, for example, in top view in FIGS. 4 and 5 in which side edges of the cap support plate 54 are oriented to extend precisely forwardly and rearwardly. As well, in the fully tightened position as seen, for example, in FIG. 6, the upper end 135 of the neck 134 of the bottle 42 is received in a sealed engagement with the bottle cap member 44 preferably with a resilient washer, not shown, provided between the end wall 52 of the bottle cap member 44 and the upper end 135 of the neck 134 of the bottle 42.

Bottle Cap Vent Structure First Embodiment

Reference is made to FIGS. 14 to 17 illustrating a vent structure 55 provided on the bottle cap member 44 by which a vent port 58 initially sealed to prevent communication between the interior cavity of the bottle 42 and the atmosphere may be opened to provide communication between the interior cavity of the bottle 42 and the atmosphere.

Figure 16:
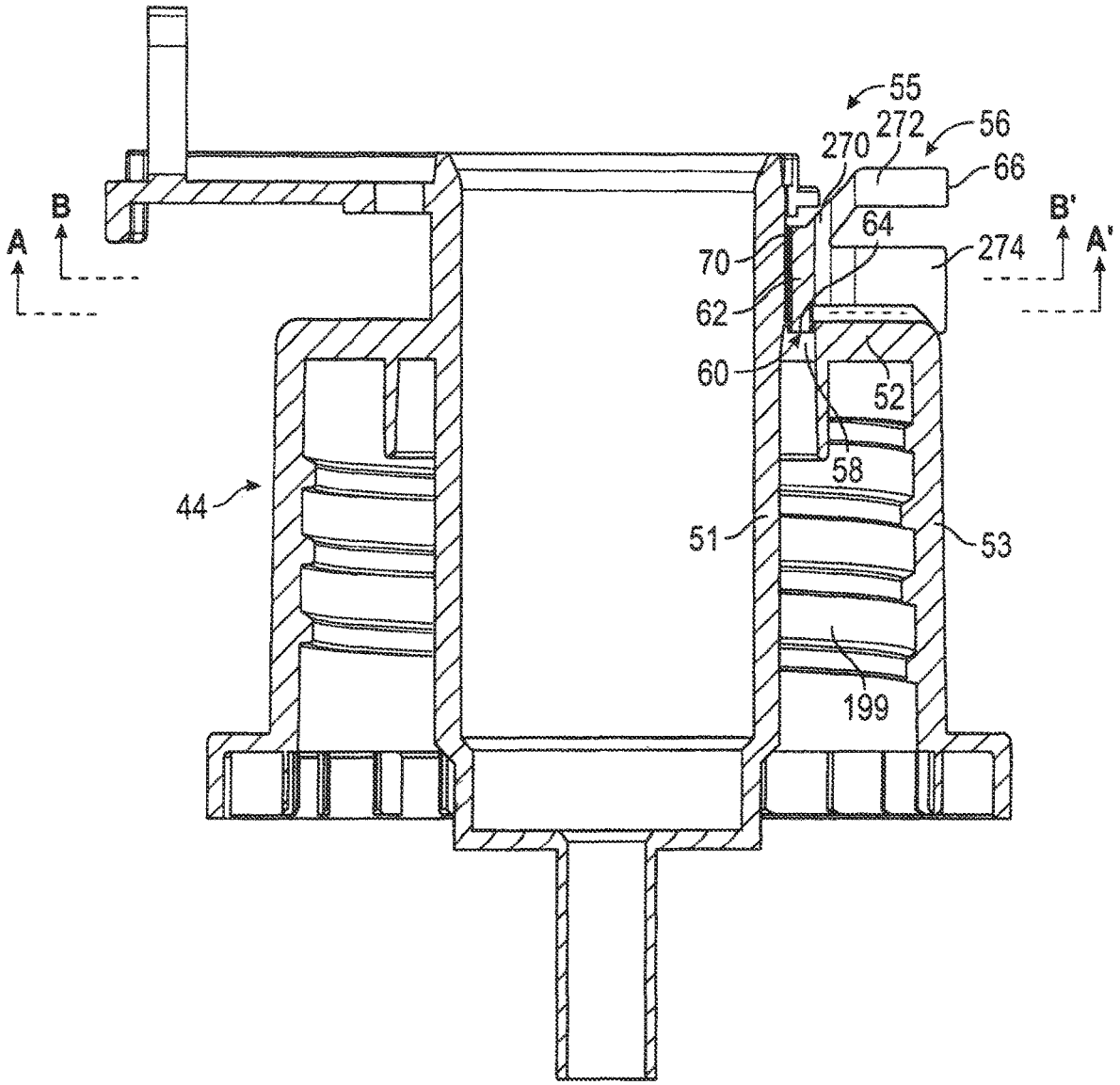
FIG. 16 is a cross-sectional right side view of the bottle cap member of FIG. 14.

As seen in FIG. 16, the bottle cap vent structure 55 includes the vent port 58 and a frangible plug member 60 closing the vent port 58.

As seen in FIG. 16, the end wall 52 of the bottle cap member 44 includes the vent port 58 that extends upwardly through the end wall 52. An inner lower opening of the vent port 58 is open into an annular space 199 between the inner tube member 51 and the outer tubular collar member 53 of the bottle cap member 44. The inner lower opening of the vent port 58 opens radially inside the neck 134 and through the neck into the interior cavity of the bottle 42. An upper end of the vent port 58 is closed by the frangible plug member 60. The frangible plug member 60 includes a cylindrical plug post 62 and an annular frangible ring 64 that extends circumferentially about the plug post 62 joined at a circumferential inner edge to the radially outer surface of the plug post 62 and joined at a circumferential outer edge to the end wall 52. Preferably, the bottle cap member 44 is injection molded from a plastic material so as to provide the bottle cap member 44 as a unitary integral element with the frangible plug member 60 including the plug post 62 and the frangible ring 64 integrally formed with the end wall 52 of a plastic material. The annular frangible ring 64 is preferably provided so as to have an axial dimension which is sufficiently small that by the application of forces to the plug post 62 the annular frangible ring 64 will be broken, at least in part so as to provide communication through the vent port 58, for example, to permit: atmospheric air to flow through the vent port 58 and into the bottle 42 to relieve vacuum conditions that may arise on dispensing the fluid from the bottle 42 by operation of the pump assembly 41.

Figure 17:
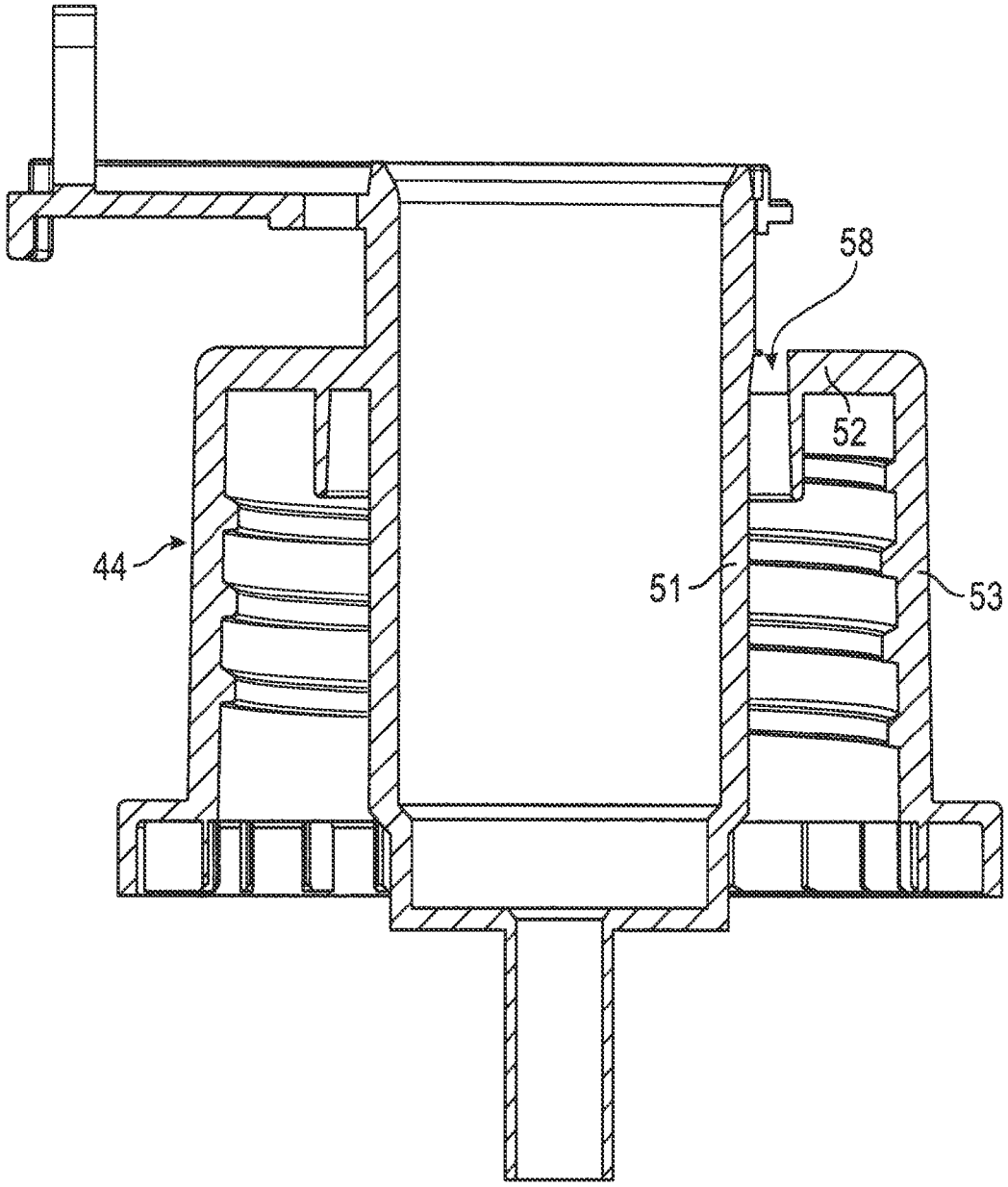
FIG. 17 is a cross-sectional right side view of the bottle cap member as in FIG. 16 but with a frangible plug member and a vent tab removed.

The plug post 62 extends upwardly from the end wall 52. The plug post 62 along a forward portion of the plug post 62 is secured to the inner tube member 51 via an elongate upwardly extending frangible member 70 that has a small circumferential extent relative the central axis 50. A vent tab 56 is secured along a rearward portion of the plug post 62 opposite from the frangible member 70. The vent tab 56 extends rearwardly away from the plug post 62 to a distal end 66. By applying suitable forces to the vent tab 56, both the annular frangible ring 64 and the frangible member 70 can be severed such that the plug post 62 and vent tab 56 may be removed from the bottle cap member 44 leaving the bottle cap member 44 as illustrated in FIG. 17. As seen in FIG. 17, with the frangible plug member 60 removed, the vent port 58 provides communication between the atmosphere through the bottle cap member 44 into the bottle 42. The vent tab 56 and post plug 62 may be considered to be a lever member coupled to the bottle cap member 44 with the frangible member 70 serving as a fulcrum junction about which the lever member is pivotable on applying forces to the lever member at an engagement surface on the distal end 66. The lever member may be considered to be connected to the frangible ring 64 at a load juncture by which forces are transferred from the lever member to the frangible ring to break the frangible ring.

As one manner of use of the bottle cap vent structure 55, prior to the insertion of the bottle assembly 40 into the dispenser assembly 10, a person may manually engage the vent tab 56 and apply forces to the vent tab 56 and thereby across the frangible ring 64 and the frangible member 70 sufficient to break them and sever the vent tab 56 including the plug member 60 attached from the bottle cap member 44.

However, severing of the vent tab 56 and plug member 60 from the bottle cap member 44 is not necessary. In use, it is merely necessary that the frangible plug member 60 has its annular frangible ring 64 broken such that communication is provided through the vent port 58 between the bottle 42 and the atmosphere whether or not the frangible plug member 60 is removed from the bottle cap member 44.

Figure 4:
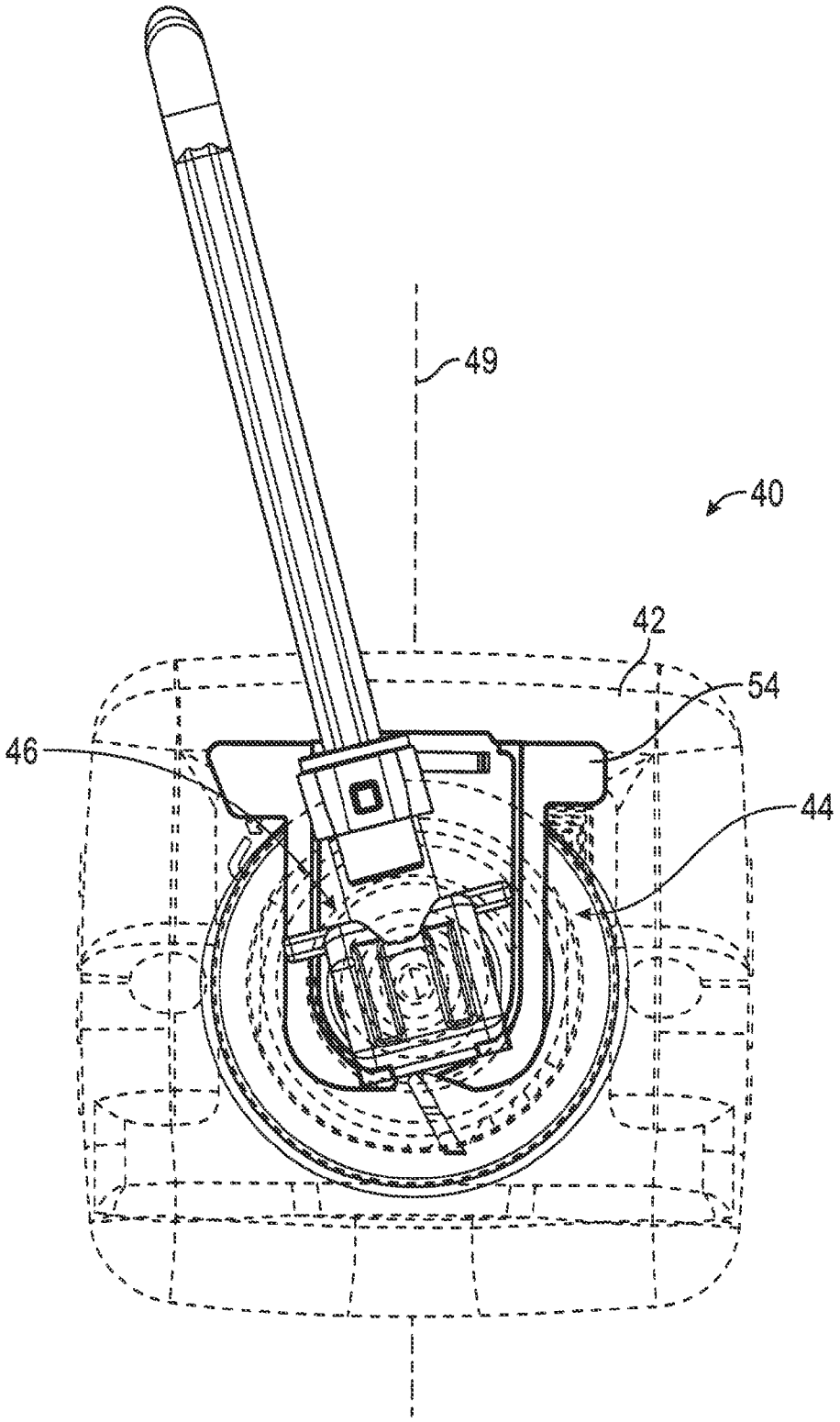
FIG. 4 is a top view of the bottle assembly of FIG. 3 in the latched transport configuration.
Figure 5:
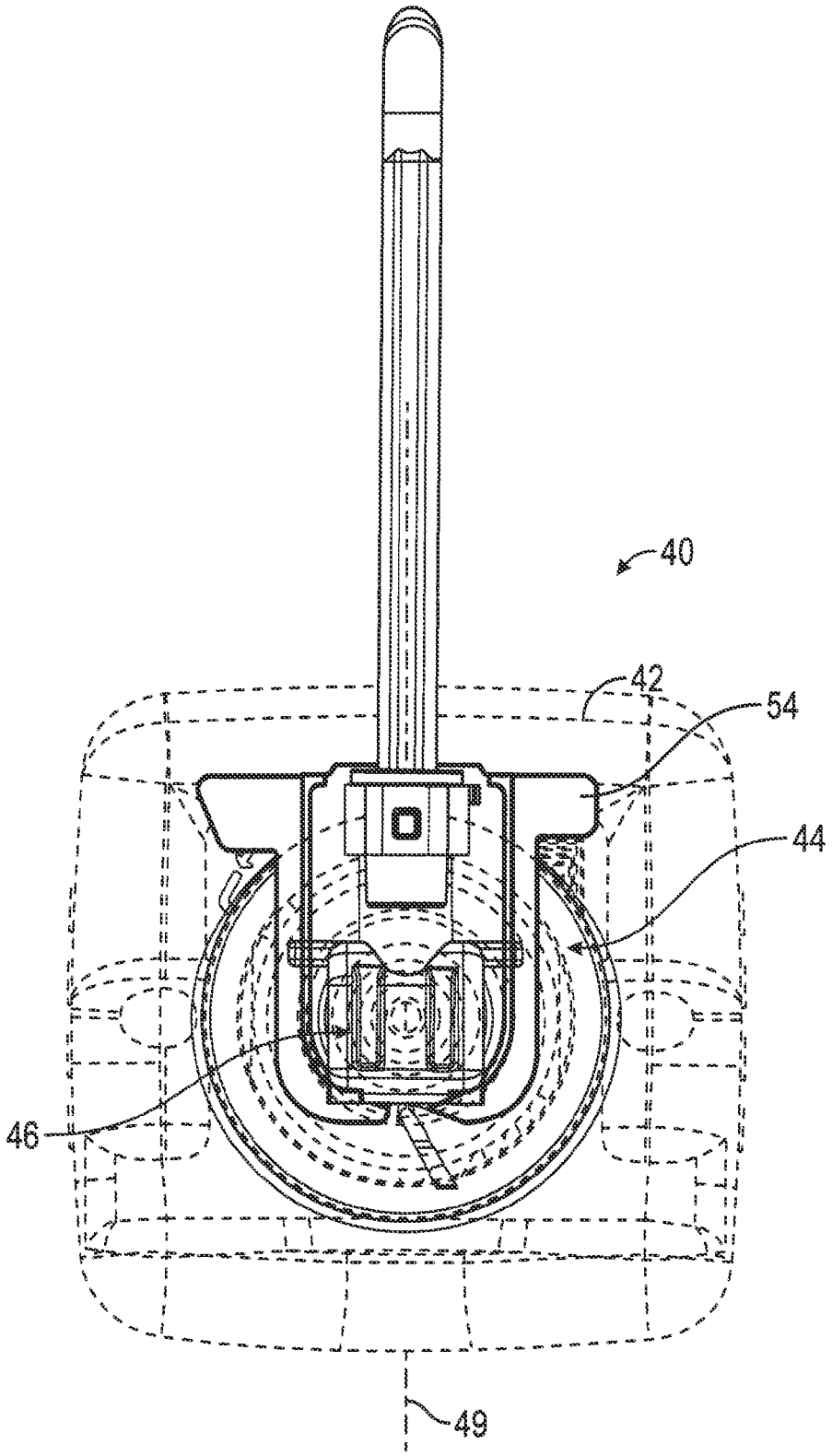
FIG. 5 is a top view of the bottle assembly of FIG. 3, but in an unlatched use configuration for use in dispensing fluid.

Referring to FIGS. 4 and 5, the broken line 49 represents a vertical center plane 49 including the center axis 50 through the bottle 42 and the cap assembly 100 including the bottle cap member 44 fixedly secured to the battle 44 against relative rotation. As can be seen in each of FIGS. 4 and 5 and, as well, in FIG. 14, the vent tab 56 extends from the plug post 62 towards the left side of the bottle cap member 44 as it extends rearwardly to its distal end 66. The bottle cap venting structure 55 is configured such that in coupling of the bottle assembly 40 to the fluid dispenser 10, the frangible plug member 60 will become broken to provide air venting between the atmosphere and the interior of the bottle 42. As the bottle assembly 40 is being coupled to the dispenser 10, on sliding of the bottle assembly 40 rearwardly, the bottle cap venting structure 55 engages with the housing 16 of the dispenser 10, breaking the frangible plug member 60 and opening the vent port 58.

Figure 14:
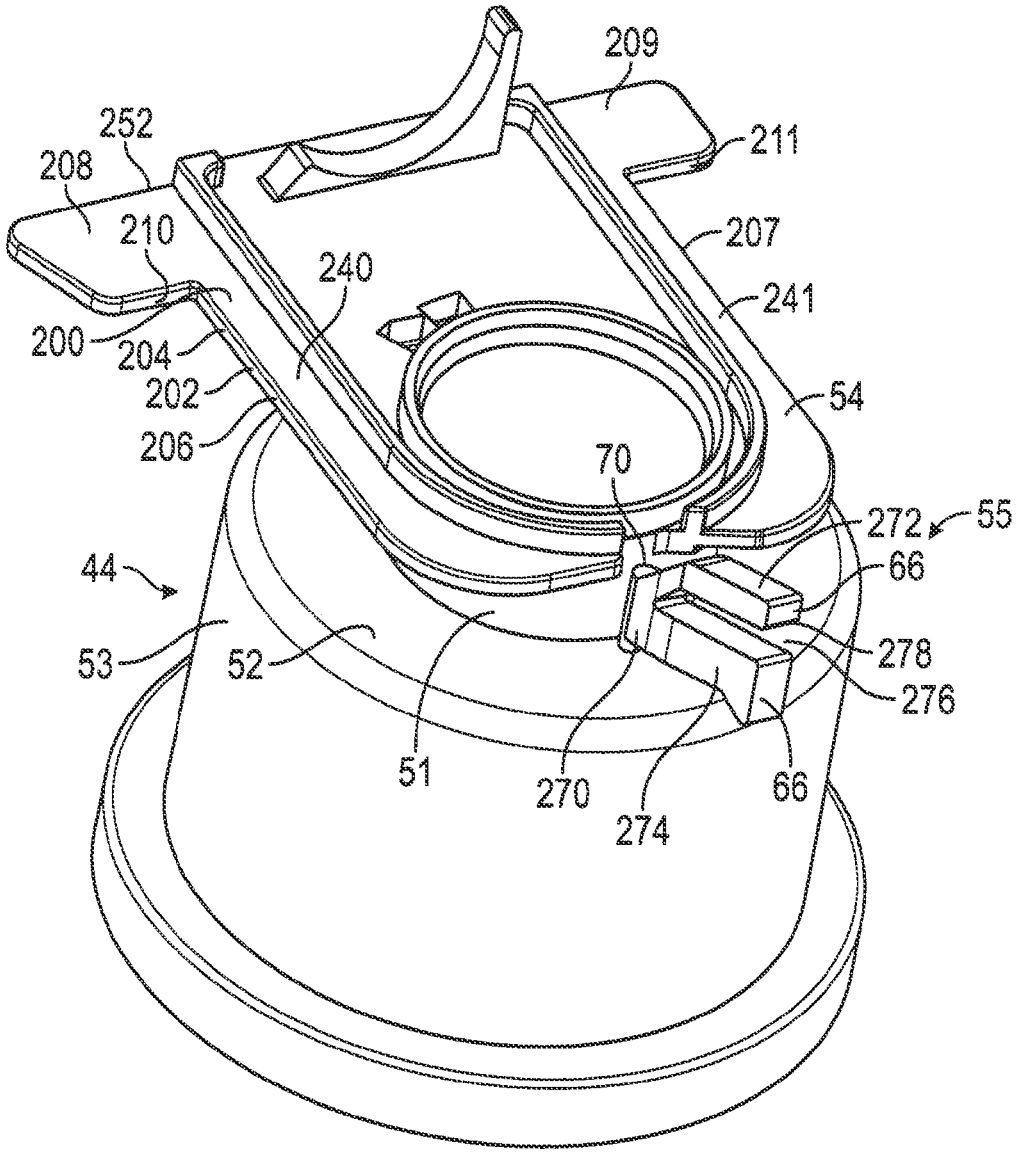
FIG. 14 is a pictorial top rear view of the bottle cap member in FIG. 7.

Referring to FIG. 14, the bottle cap member 44 has the cap support plate 54 extend radially outwardly from the inner tube member 51. The cap support plate 54 has an upper surface 200 and a lower surface 202 providing a circumferential edge 204 therebetween. The cap support plate 54 includes a right lateral guide arm portion 240 and a left lateral guide arm portion 241 as best seen on FIG. 14. The edge 204 includes a right side portion 206 on the right lateral guide arm portion 240 and a left side portion 207 left lateral guide arm portion 241. Each of the right side portion 206 and the left side portion 207 of the edge 204 are linear disposed in a vertical plane parallel the center plane 49. The cap support plate 54 includes a right stop tab 208 and left stop tab 209 that extend laterally from the center plane 51 beyond the right side portion 206 and the left side portion 207 and present as part of the edge 204 a right stop surface 210 and a left stop surface 211.

Figure 18:
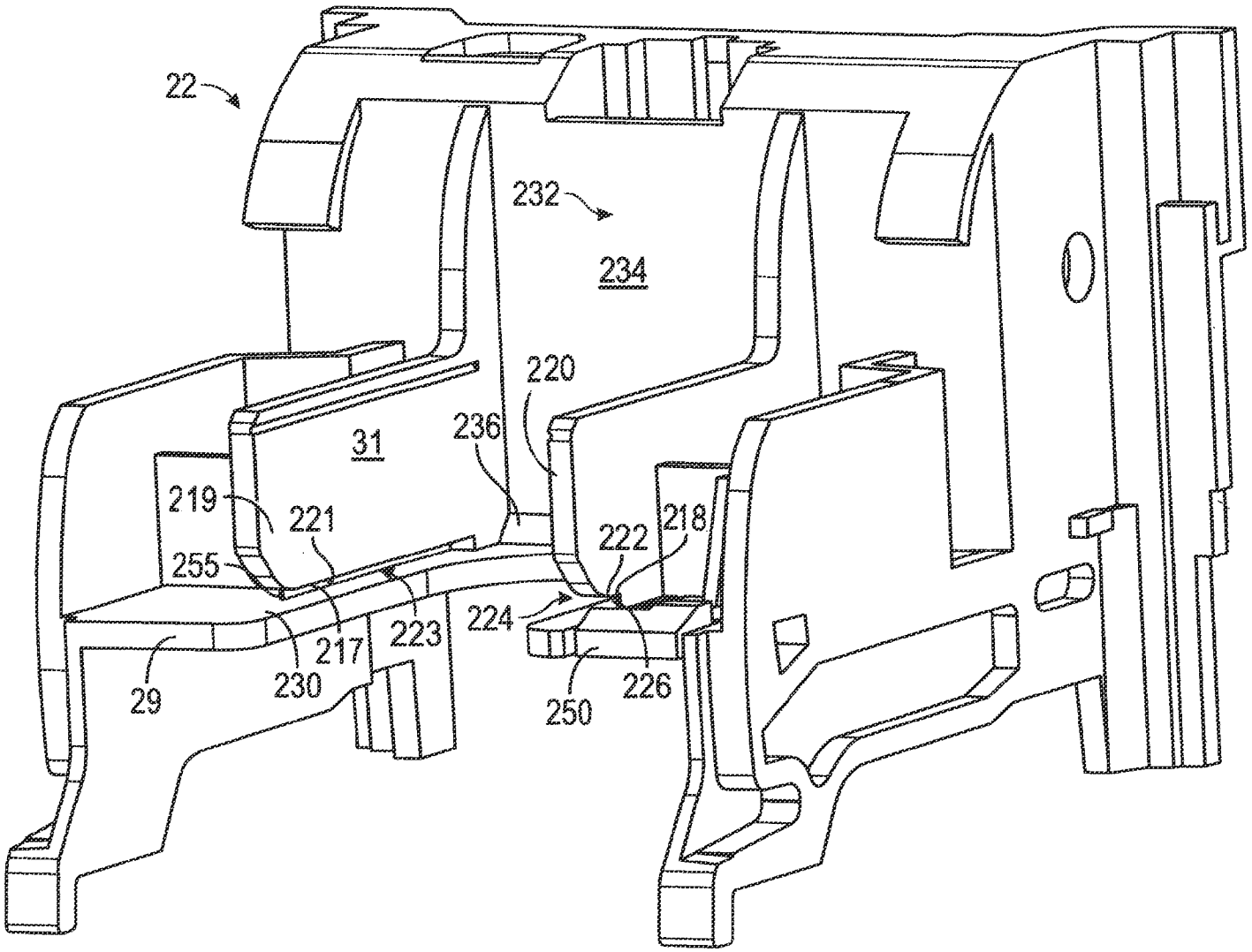
FIG. 18 is a top front pictorial view of a support member of the housing assembly shown in FIG. 2.

Reference is made to FIG. 18 showing the support member 22. The left vertical side wall 31 is cut away so as to provide a recessed lower wall portion 217 below an upper wall portion 219 joined by a horizontal downwardly directed upper guide surface 221 such that a left slotway 223 is defined opening inwardly towards the center plane 49 above the housing support plate 29 between an upper surface 230 of the housing support plate 29 and the upper guide surface 221 and bounded laterally by the lower wall portion 217. The left vertical side wall 31 carries a forwardly directed left stopping surface 225. The right vertical side wall 32 is a mirror image of the left vertical side wall 31 and similarly provides a right slotway 224 bounded by an upper guide surface 222, a recessed lower wall portion 218 below an upper wall portion 220 and the upper surface 230 of the housing support plate 29, and also a right forwardly directed stopping surface 226.

The support member 22 includes a rear wall 232 that spans between the left side wall 31 and the right side wall 32 and extends upwardly from the housing support plate 29. The rear wall 232 includes a vertical upper portion 234 and a lower sloped portion 236 that has a forwardly directed surface that extends rearwardly as it extends upwardly.

Figure 19:
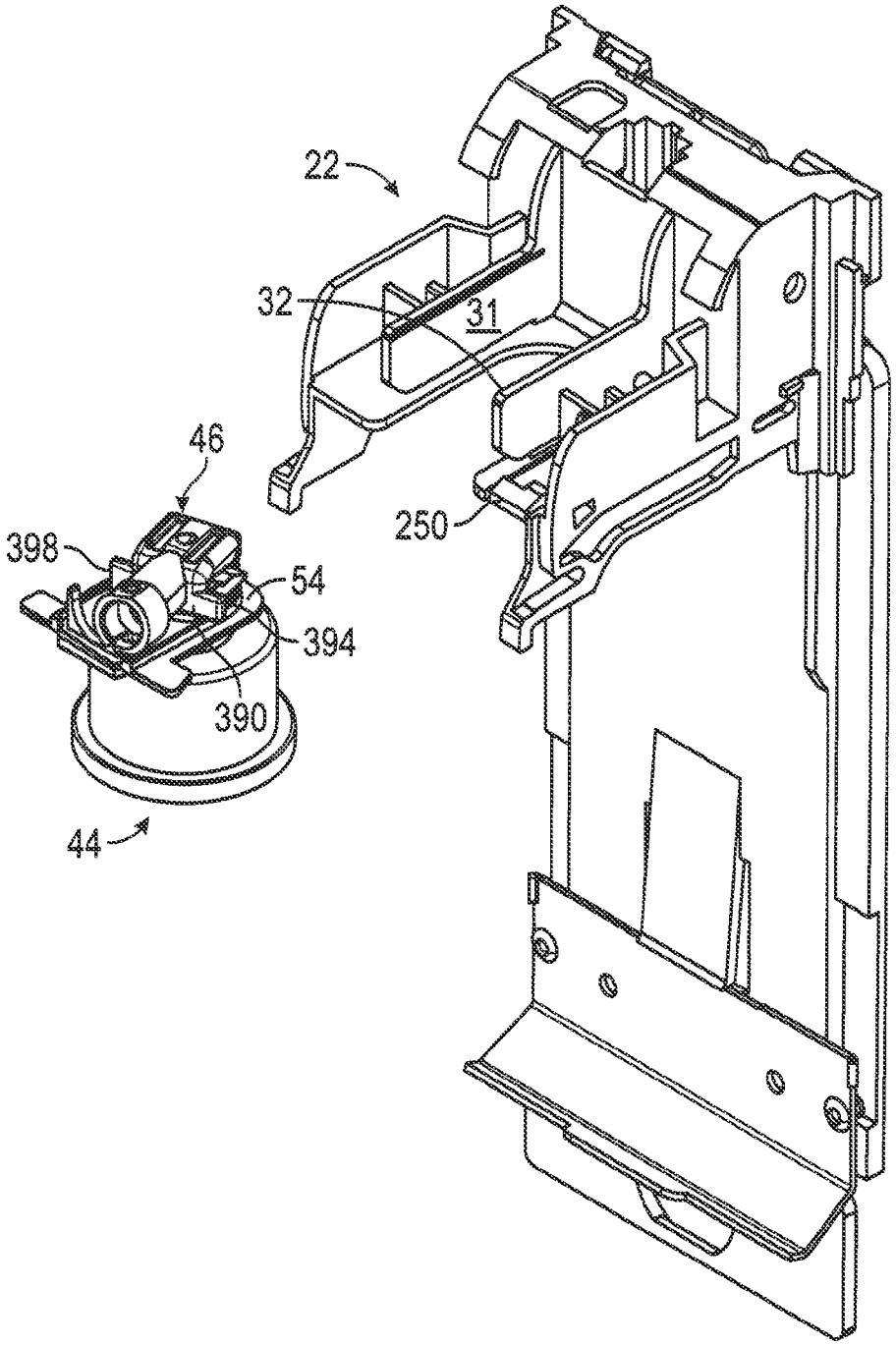
FIG. 19 is a front pictorial view showing the bottle cap member and the piston member of FIGS. 9 and 10 in the latched transport configuration located in front of the support member of FIG. 18 ready for coupling.

Reference is made to FIG. 19 which schematically illustrates the bottle cap member 44 positioned in front of the support member 22 ready for rearward sliding to couple the bottle cap member 44 to the support member 22. The bottle cap member 44 is slidable rearwardly relative to the support member 22 guided by engagement therebetween to adopt a desired angular orientation and to stop movement in a desired position. In such rearward sliding, cap support plate 54 has its lower surface 202 engaged on the upper surface 230 of the housing support plate 29.

The bottle cap member 44 is slid rearwardly relative to the support member 22 with the lower surface 220 of the cap support plate 54 engaged on the upper surface 230 of the housing support plate 29 and the right lateral guide arm portion 240 and the left lateral guide arm portion 241 to be received within the respective right slotway 224 and the left slotway 223 with engagement between the right side portion 206 and the left side portion 207 of the edge 204 of the cap support plate 54 engaging and being guided by the respective right and left lower wall portions 217 and 219 of the respective right and left vertical walls 32 and 31.

Rearward sliding of the bottle cap member 44 relative the support member 22 is stopped at a desired position when the stop surface 210 on the right stop tab 208 engages the right stopping surface 226 and the stop surface 211 on the left stop tab 209 engaging the left stopping surface 225.

As seen in FIG. 18, the support member 22 is preferably provided with a resilient catch member 250 that is deflected downwardly by the right stop tab 208 on rearward movement of the bottle cap member 44 and which on the right stop tab 208 moving rearwardly past the catch member 250, the catch member 250 under its inherent bias moves back upwardly to its inherent position in which a rearwardly directed stop surface on the rear end of the catch member 250 is located rearward of a forwardly directed catch surface 252 on the right stop tab 208 preventing forward movement of the bottle cap member 44 relative the support member 22 unless the catch member 250 is manually deflected downwardly.

Figure 20:
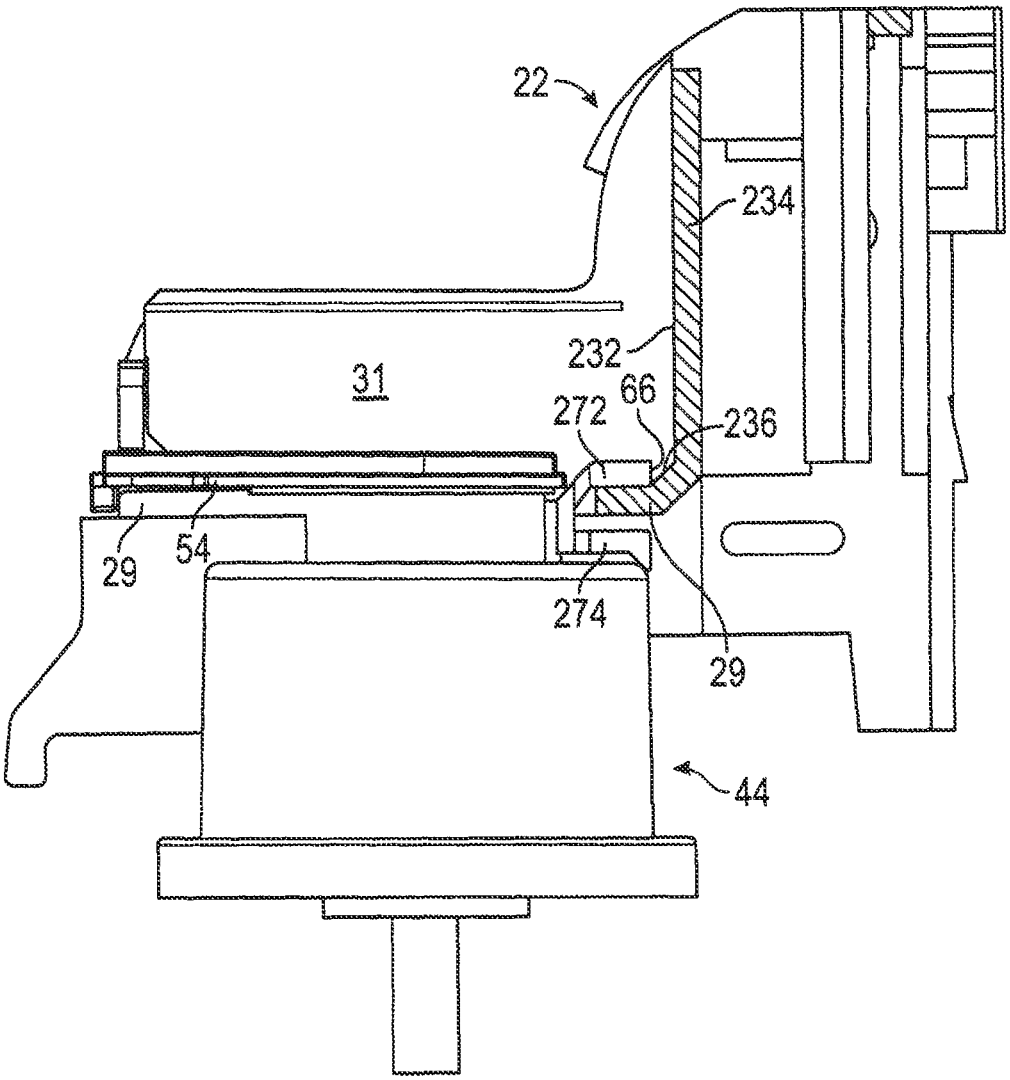
FIG. 20 is a cross-sectional right side view showing the bottle cap member and the piston member of FIGS. 9 and 10 in the latched transport configuration slidably engaging of the support member of FIG. 17 ready during a coupling procedure and in which the support member is in cross-section.
Figure 21:
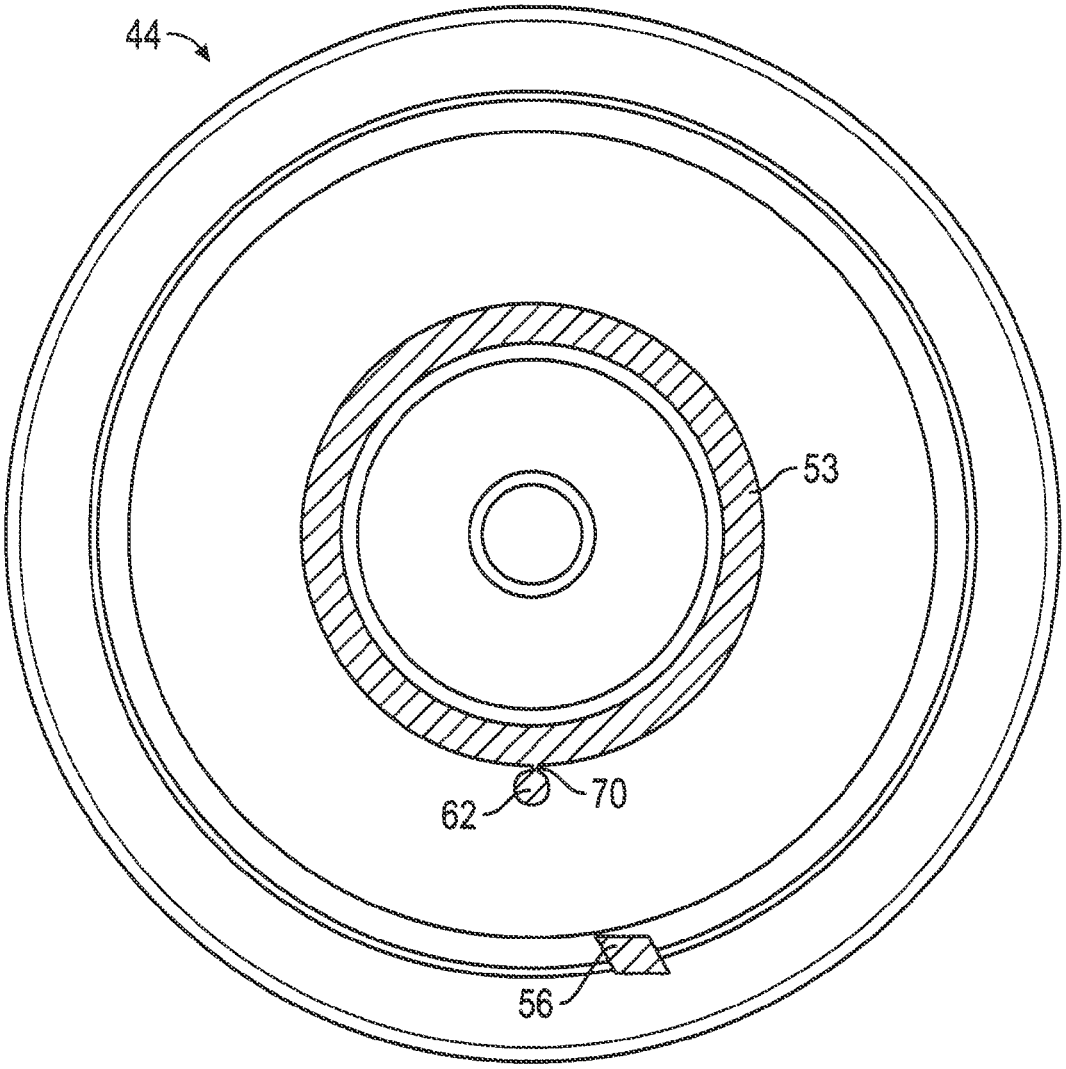
FIG. 21 is a cross-sectional top view of the bottle cap member of FIG. 16 along section line A-A' on FIG. 16.
Figure 22:
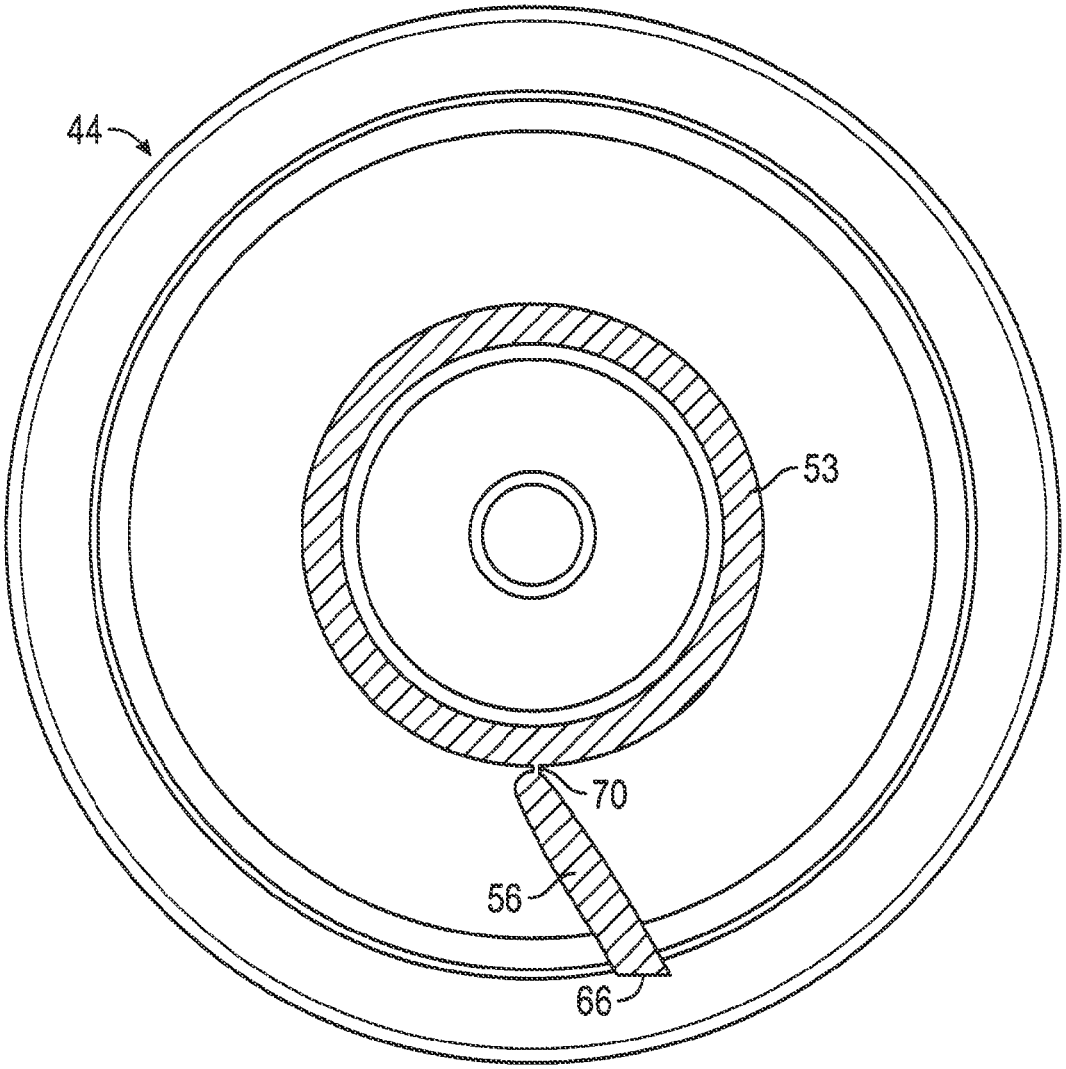
FIG. 22 is a cross-sectional top view of the bottle cap member of FIG. 16 along section line B-B' on FIG. 16.
Figure 23:
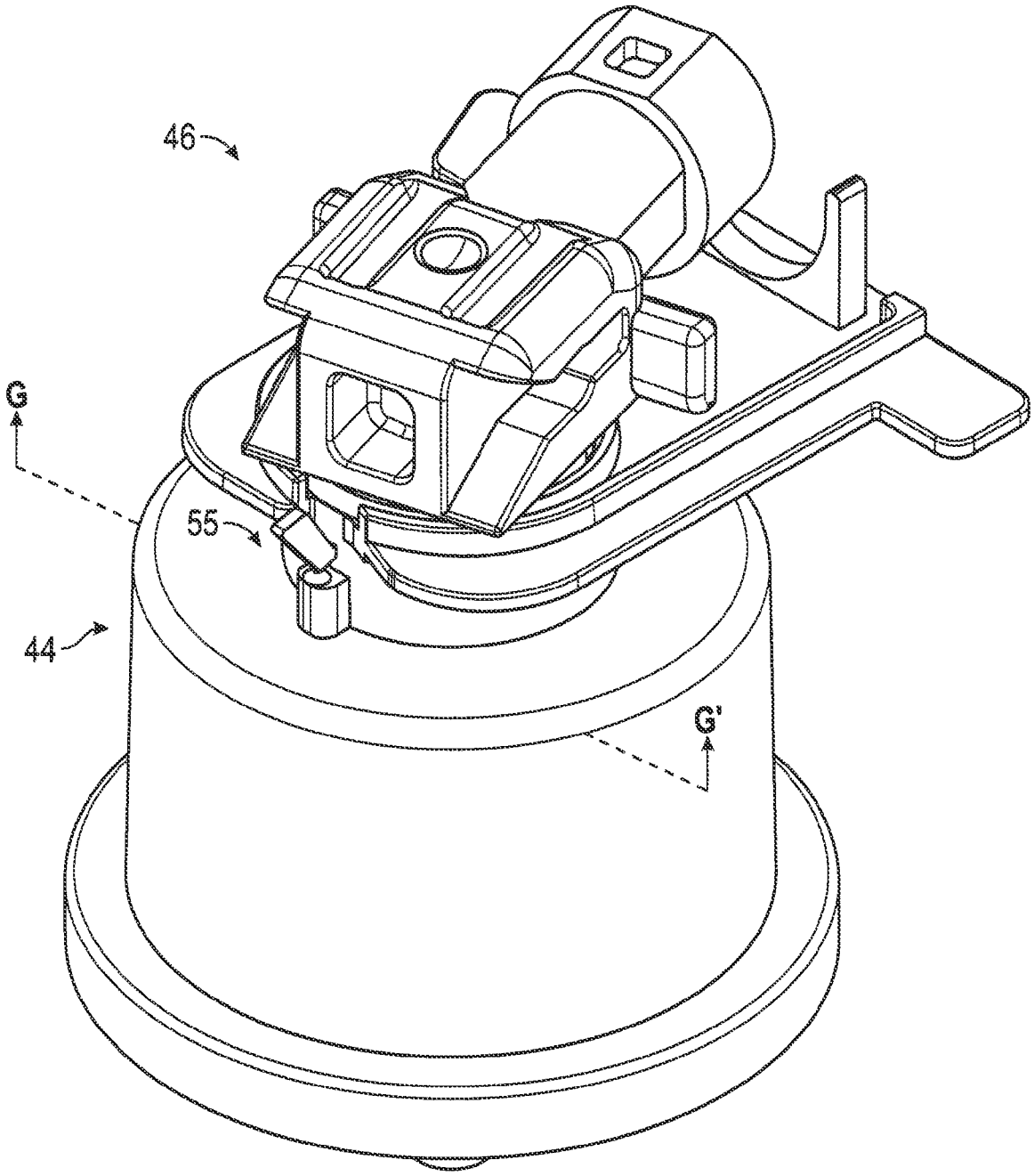
FIG. 23 is a rear top pictorial view of a bottle cap member and a piston member in accordance with a second embodiment of the present invention in the latched storage condition.

Reference is made to FIG. 20 which illustrates, as seen from the right side, the support member 22, shown cross-sectioned along the center plane 49, with the bottle cap member 44 (not cross-sectioned) in an intermediate position in sliding rearwardly with the cap support plate 54 engaged on the housing support plate 29.

Figure 15:
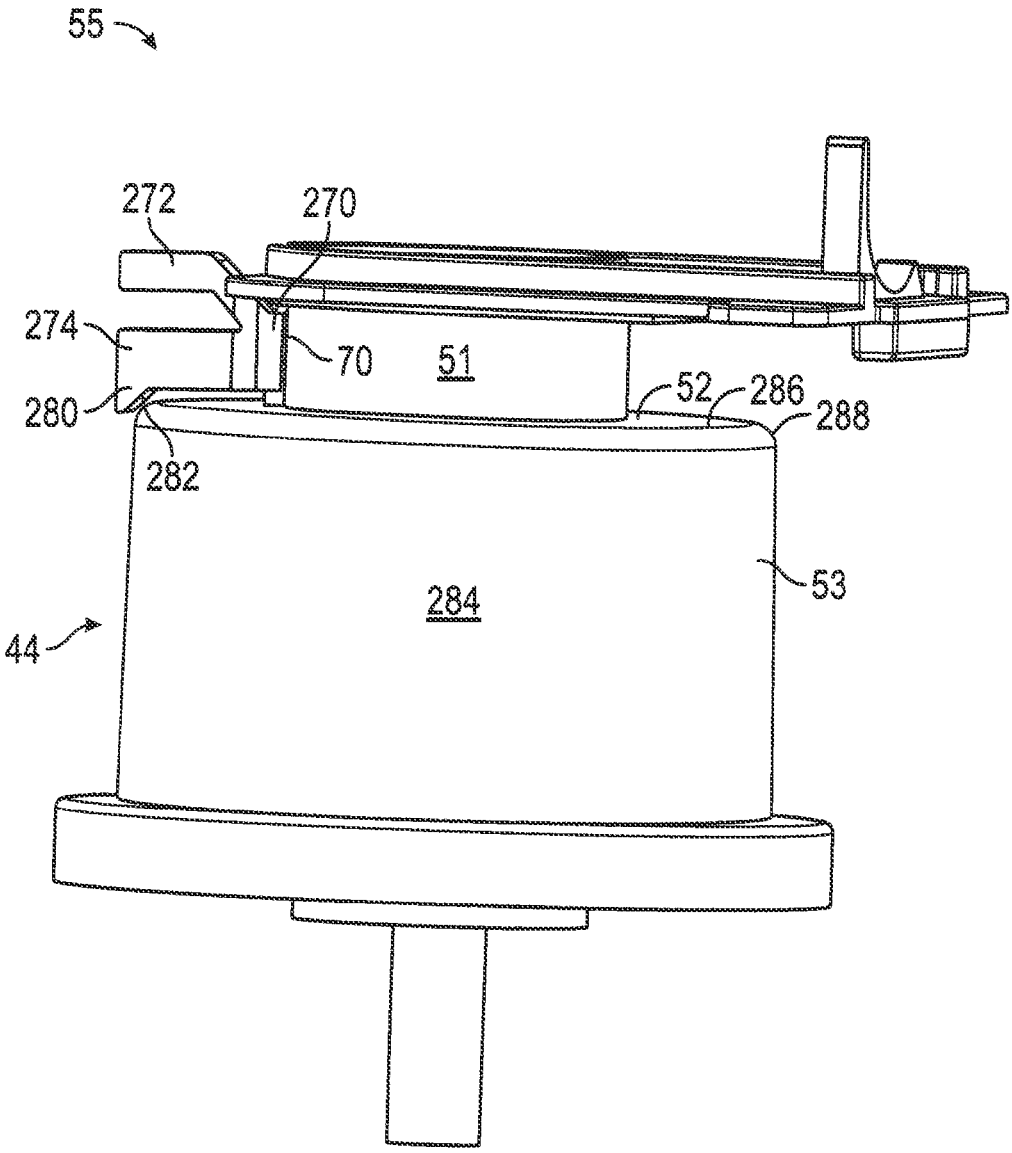
FIG. 15 is a pictorial top left view of the bottle cap member in FIG. 14.

Referring to FIGS. 14 to 16, the vent tab 56 includes an upwardly extending post portion 270, an upper arm 272 and a lower arm 274. A forward side of the post portion 270 is secured to a rear side of the plug post 62. The upper arm 272 and the lower arm 274 extend rearwardly from the post portion 270 spaced vertically from each other to define a horizontally extending slot 276 therebetween open at a rear end.

Referring to FIG. 20, in the intermediate position shown, the bottle cap member 44 has been slid rearwardly guided on the housing support plate 29 with the housing support plate 29 within the slot 276 on the vent tab 56 with the upper arm 272 of the vent tab 56 above the upper surface 230 of the housing support plate 29. FIG. 20 shows as the intermediate position, a position in which a camming surface 278 at the rear end of the upper arm 272 of the vent tab 56 engages with the lower sloped portion 236 of the rear wall 232. From the intermediate position of FIG. 20, with further rearward sliding of the bottle cap member 44, engagement between the camming surface 278 on the vent tab 56 and the lower sloped portion 236 of the rear wall 232 of the support member 22 moves the vent tab 56 so as to apply forces that break the frangible plug member 60 and open the vent port 58 to provide communication between the atmospheric air and the interior of the bottle 42.

Referring to FIGS. 4 and 5, with the vent tab 56 extending towards the left side of the bottle cap member 44 as it extends rearwardly, engagement between the distal end 66 of the upper arm 272 of the vent tab 56 and the rear wall 232 displaces the rear distal end 66 of the vent tab 56 towards the left which, in itself, is sufficient to rupture the annular frangible ring 64. As well, the contact between the lower sloped portion 236 of the rear wall 232 and the camming surface 278 of the distal end 66 of the upper arm 272 of the vent tab 56 urges the distal end of the vent tab 56 upwardly. Such upward urging applies forces to the frangible member 70, particularly at the lower end of the frangible member 70 breaking the frangible member 70 as by pivoting it about a fulcrum at the upper end of the frangible member 70. The upward movement of the distal end 66 of the vent tab 56 is also adequate in itself to break the frangible plug member 60 and sever the annular frangible ring 64.

Reference is made to FIG. 15 which illustrates a pictorial top left side view of the bottle cap member 44 showing that the lower arm 274 of the vent tab 56 carries a cam protrusion 280 that extends downwardly and rearwardly. The cam protrusion 280 has a downwardly and forwardly directed cam surface 282 that extends downwardly as it extends rearwardly. As forces are applied to the vent tab 56 urging the distal end 66 of the vent tab 56 towards the left, as seen on FIG. 14, the vent tab 56 which is relatively rigid will as a unit be pivoted relative to the inner tube member 51 by deflection of the frangible member 70 effectively acting as a vertical "living" hinge. In the vent tab 56 pivoting about the notional vertical axis of this living hinge formed by the frangible member 70, the cam surface 282 of the cam protrusion 280 on the lower arm 274 of the vent tab 56 will be moved into engagement with the bottle cap member 44 in a manner that will move the distal end 66 of the vent tab 56 upwardly.

As seen on FIG. 15, an outer surface 284 of the outer tubular collar member 53 and an upper surface 286 of the end wall 52 merge at a corner surface 288 which extends radially inwardly as it extends upwardly. With pivoting of the vent tab 56 about the frangible member 70, the cam surface 282 on the cam protrusion 280 will come to engage the surfaces 284, 286 and 288 which engagement will, with increased pivoting of the distal end 66 of the vent tab 56 to the left, displace the distal end 66 of the vent tab 56 upwardly applying forces to the frangible plug member 60 acting to break the frangible plug member 60 and applying forces to the lower end of the frangible member 70 acting to break the frangible member 70 at least over lower portions thereof.

As can be seen on FIG. 20, the slot 276 in the vent tab 56 is preferably configured such that in pivoting of the vent tab 56 to the left, there is no engagement between the lower arm 274 and the support plate 54 which would prevent suitable pivoting of the vent tab 56.

The arrangement which provides for pivoting of the vent tab 56 to the left resulting in engagement of the cam protrusion 280 with the bottle cap member 44 assisting in breaking the frangible plug member 60 is advantageous not only when the bottle assembly 40 is being moved rearwardly to couple to the dispenser 10 but also if the vent tab 56 is desired to be moved manually prior to insertion to break the frangible plug member 60 prior to coupling of the bottle assembly 40 to the dispenser 10.

As can be seen on FIG. 14, the cap support plate 54 is cut away at its rear in the location of the vent tab 56 such that interference between the cap support plate 54 and the vent tab 56 does not limit the ability of the vent tab 56 to be moved sufficiently for breaking of the frangible plug member 60.

In use of the bottle assembly 40, the vent tab 56 may be entirely severed from the bottle cap member 44 and discarded as a separate part. Preferably, however, to avoid extra parts that need to be disposed of or recycled, the vent tab 56 is moved to a position in which the frangible plug member 60 is sufficiently broken to permit air to pass through the vent port 58 yet with portions of the frangible plug member 60 and the frangible member 70 to remain attached to the bottle cap member 44 as for disposal and recycling as a unitary element. The bottle cap member 44 and the support member 22 are configured such that when they are coupled together, with the frangible plug member 60 broken to provide air passage, the frangible plug member 60 and the vent tab 56 can remain coupled to the bottle cap member 44 without interfering with the insertion and removal of the bottle assembly 40 or operation of the dispenser 10.

Transport Latching System First Embodiment

Figure 8:
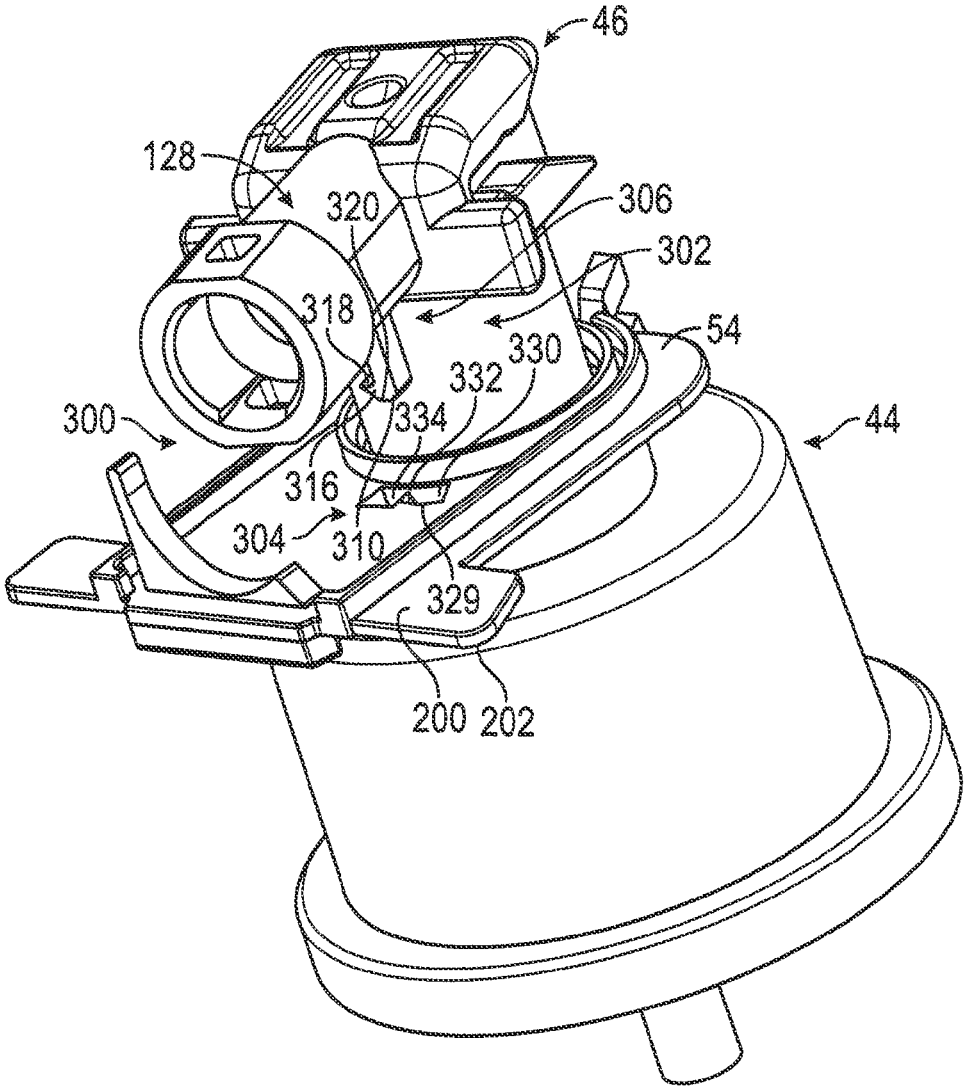
FIG. 8 is a front top pictorial view of a bottle cap member and a piston member of the bottle assembly of FIG. 5 in the same relative rotational position as in FIGS. 2 to 4 but with the piston member axially spaced upwardly from the bottle cap member in a pre-latching orientation.
Figure 9:
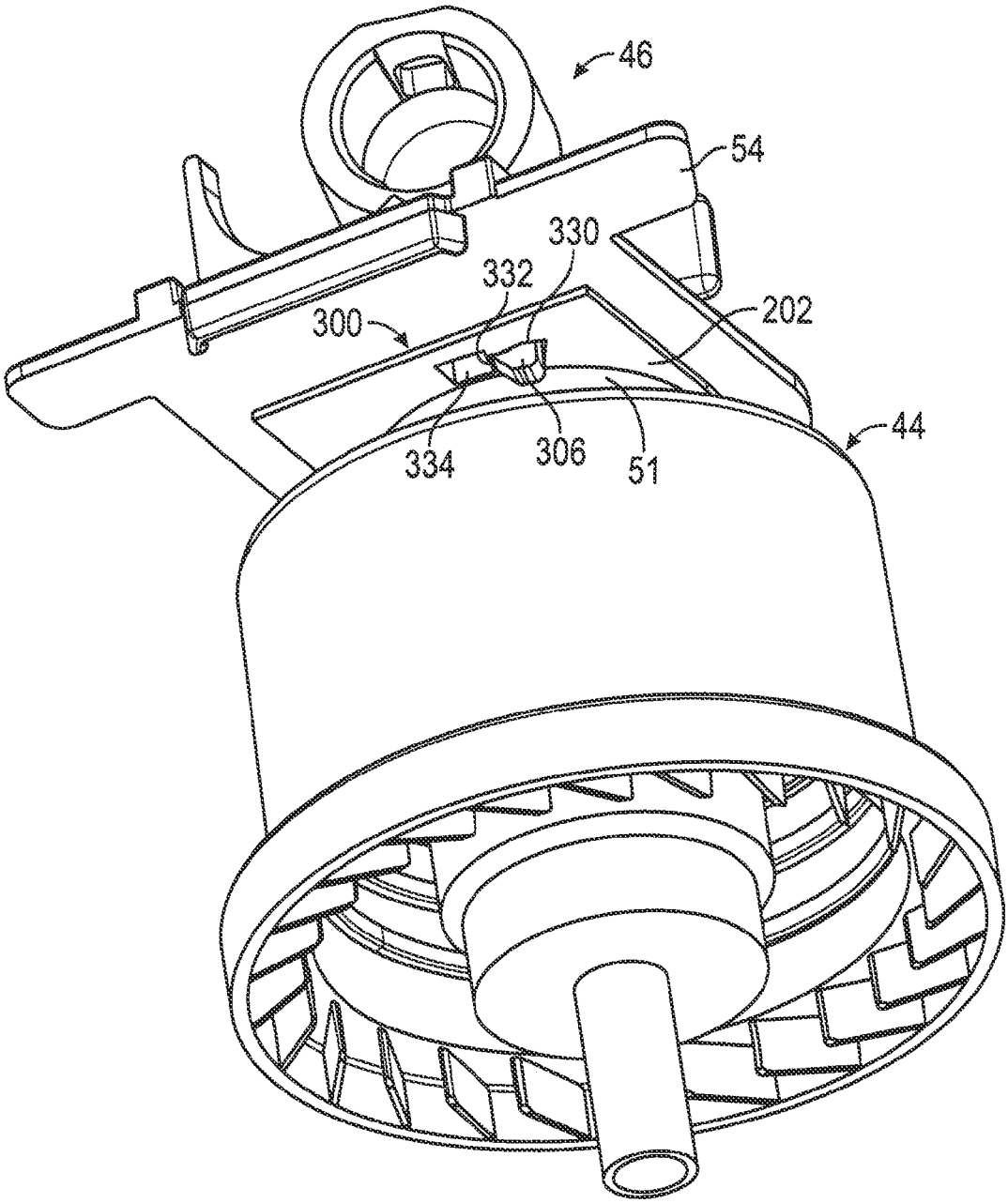
FIG. 9 is a front bottom pictorial view of the bottle cap member and the piston member of FIG. 8 but coupled as in FIG. 4 in the latched transport configuration.

The invention includes a tamper evident latching system 300 provided on the pump assembly 41 by which the cap assembly 100 and the piston assembly 101 are latched together in a latched transport configuration that prevents use of the pump assembly 41 to dispense fluid until the latching system 300 is unlatched. Referring to FIGS. 8 and 9, a latching mechanism 302 is provided on the piston member 46 for interaction with a catch mechanism 304 on the bottle cap member 44 to provide the latching system 300.

As seen on FIG. 8, the horizontal tube portion 128 of the piston member 46 carries as part of the latch mechanism 302 a hook member 306 that extends parallel the central axis 50 from an upper end secured to a lower surface of the horizontal tube portion 128 downwardly to a distal end 310. The hook member has a front face, a rear face, a right side face and left side face, all of which merge at the distal end 310. A side tab 316 extends laterally to the right providing an upwardly directed latch surface 318. The side tab 316 carries a forwardly directed cam surface 320 forming part of the distal end 310 with the cam surface 320 extending upwardly as it extends to the left.

The catch mechanism 304 is provided on the cap support plate 54 and includes a latch opening 330 and a free passage opening 334 with a frangible member 332 disposed between the latch opening 330 and the free passage opening 334. The latch opening 330 extends through the cap support plate 54 opening both through the plate upper surface 200 and the plate lower surface 220. Similarly, the free passage opening 334 extends entirely through the cap support plate 54 from the plate upper surface 200 to the plate lower surface 220. The frangible member 332 is formed as a thin vertical wall disposed in a plane that includes the center axis 50 and extends radially relative to the center axis 50.

Figure 10:
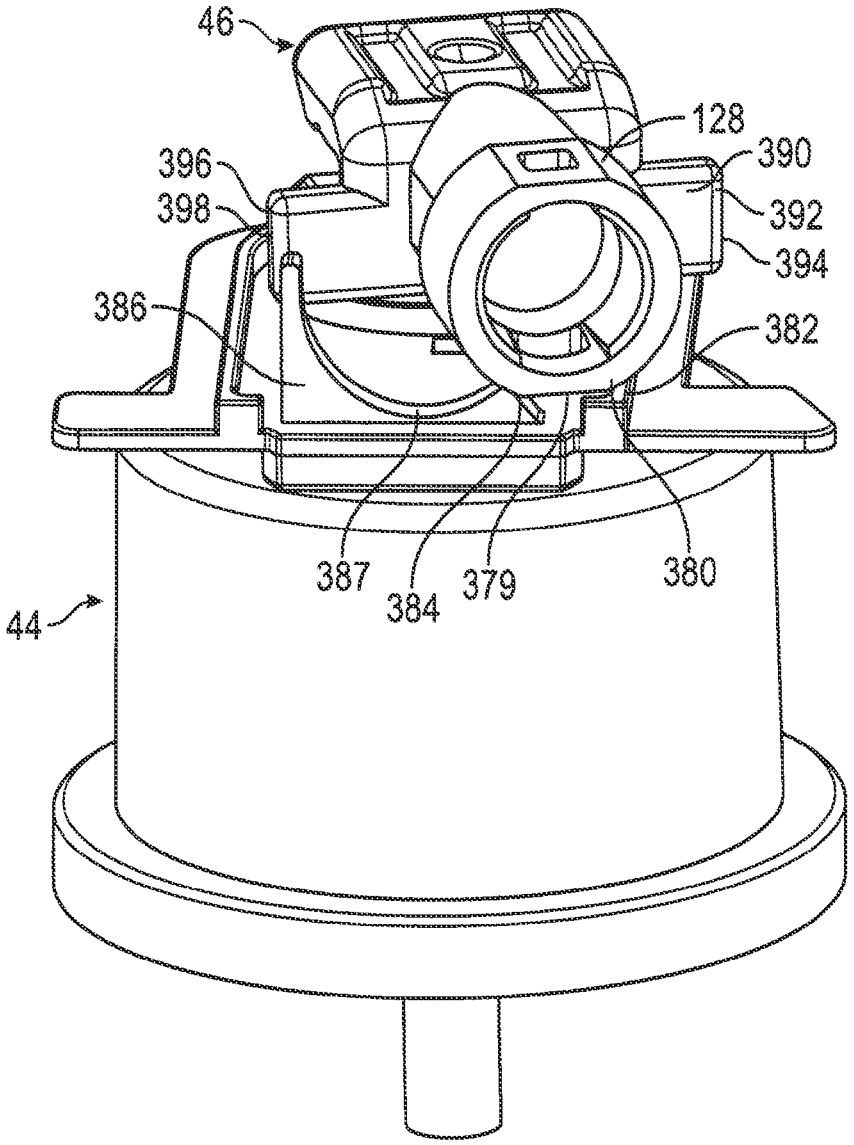
FIG. 10 is a top front pictorial view of the bottle cap member and the piston member of the bottle assembly as seen in FIG. 9 in the latched transport configuration.

FIG. 8 illustrates the piston member 46 coupled to the bottle cap member 44 for coaxial sliding along the axis 50 and with the piston member 46 in a rotational position about the axis 50 relative to the bottle cap member 44 as shown in the top view of FIG. 4 referred to as a transport rotational position. In the transport rotational position, the hook member 306 carried on the piston member 46 is axially aligned with the latch opening 330 carried on the support plate 54 of the bottle cap member 44. While maintained in this transport rotational position, relative downward axial movement of the piston member 46 on the bottle cap member 44 causes the hook member 46 to engage with the latch opening 330 and pass downwardly through the latch opening 330 so as to assume a latched transport configuration as illustrated in FIGS. 9 and 10.

As can be seen in FIG. 9, in the latched transport configuration, the hook member 306 has passed through the latch opening 330 and the latch surface 318 on the hook member 306 has come to be engaged with the lower surface 202 of the cap support plate 54 adjacent the latch opening 330 so as to prevent axial movement of the piston member 46 from the latched retracted position shown in FIG. 9 axially upwardly towards extended positions. As seen in FIG. 9, the hook member 306 has passed downwardly through the latch opening 330 without damaging the frangible member 332.

As seen in FIG. 8, the latch opening 330 has a rearward wall and a forward wall 329. The forward wall has a left hand portion angled rearwardly to engage with the cam surface 320 of the hook member 306 to deflect the hook member radially away from the frangible member 332 as the hook member 306 is forced downwardly through the latch opening 330.

In the latched transport configuration, the pump assembly 41 is inoperative to pump fluid since the piston member 46 is secured to the bottle cap member 44 against relative axial movement. As well, in the latched transport configuration, the pump assembly 41, the pump assembly 41 is preferably configured to prevent fluid flow from the bottle through the pump assembly 41. This can preferably be accomplished, for example, as seen in FIG. 6, when in a latched transport configuration, the one-way outlet valve 118 of the piston member 46 is axially urged into the one-way inlet valve 102 as to prevent the one-way inlet valve 118 from deflecting or moving as is necessary to permit fluid flow either outwardly or inwardly past the one-way inlet valve 102. With the bottle cap member 44 carrying the frangible plug member 60 intact blocking the vent port 58 and with the bottle cap member 44 sealably engaged on the neck of the bottle 42, and the bottle not having any other openings than its outlet opening 136, fluid within the bottle assembly 40 cannot flow out of or leak from the bottle assembly no matter what vertical orientation the bottle assembly 40 is placed in.

FIG. 10 shows that in the latched transport configuration, a lower surface 379 of the horizontal tube portion 128 of the piston member 46 is urged downwardly into engagement between two transport locating surfaces provided on the bottle cap member 44. As best seen on FIG. 13, these surfaces are a right locating surface 380 directed towards the left provided as the left side of an upstanding reinforcing rib 382 carried on the cap support plate 54 and a left locating surface 384 directed towards the right provided at a right side of a locating tab 386.

Figure 11:
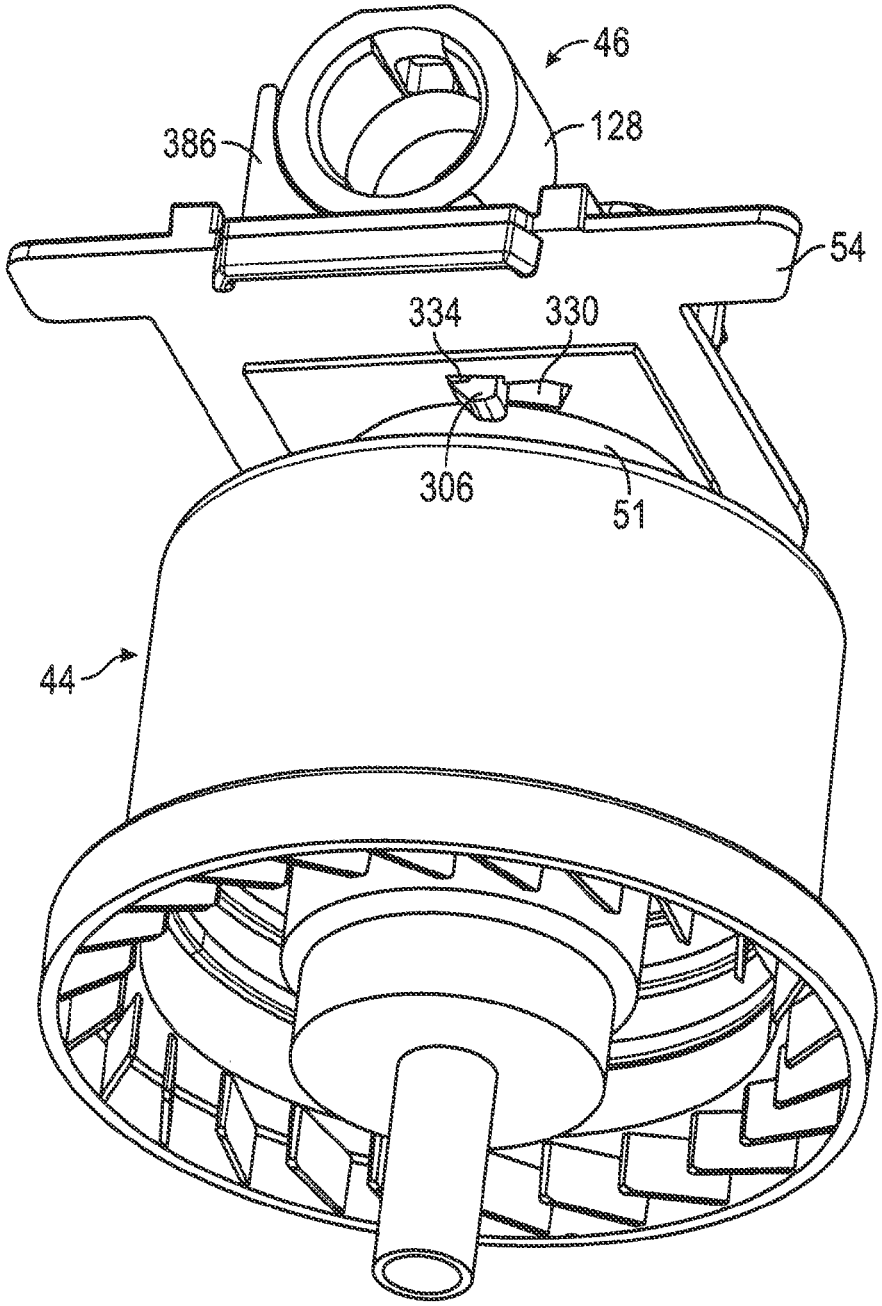
FIG. 11 is a front bottom pictorial view of the bottle cap member and the piston member of the bottle assembly in the use rotational position as in FIG. 5 and with the piston member an axially retracted position relative the bottle cap member.
Figure 12:
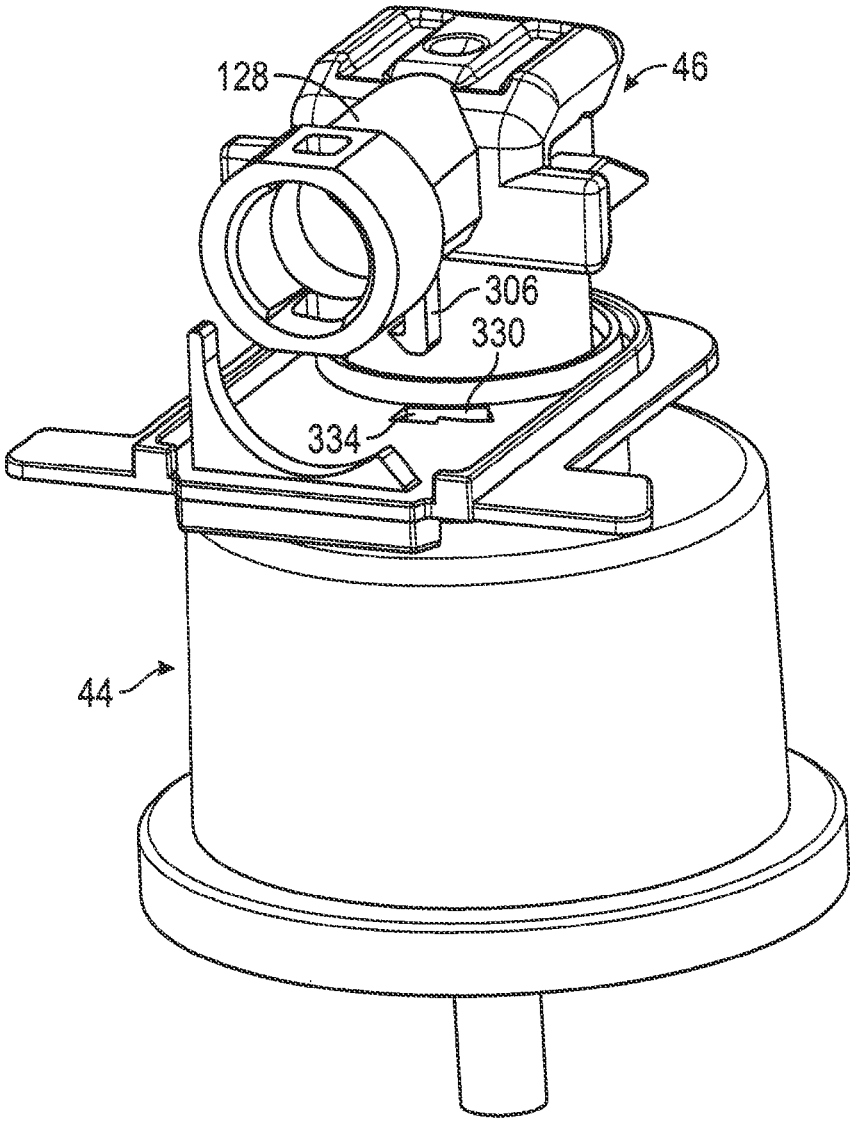
FIG. 12 is a front top pictorial view of the bottle cap member and the piston member of the bottle assembly in the use rotational position as in FIG. 5 with the piston member in an axially extended position relative the bottle cap member.
Figure 13:
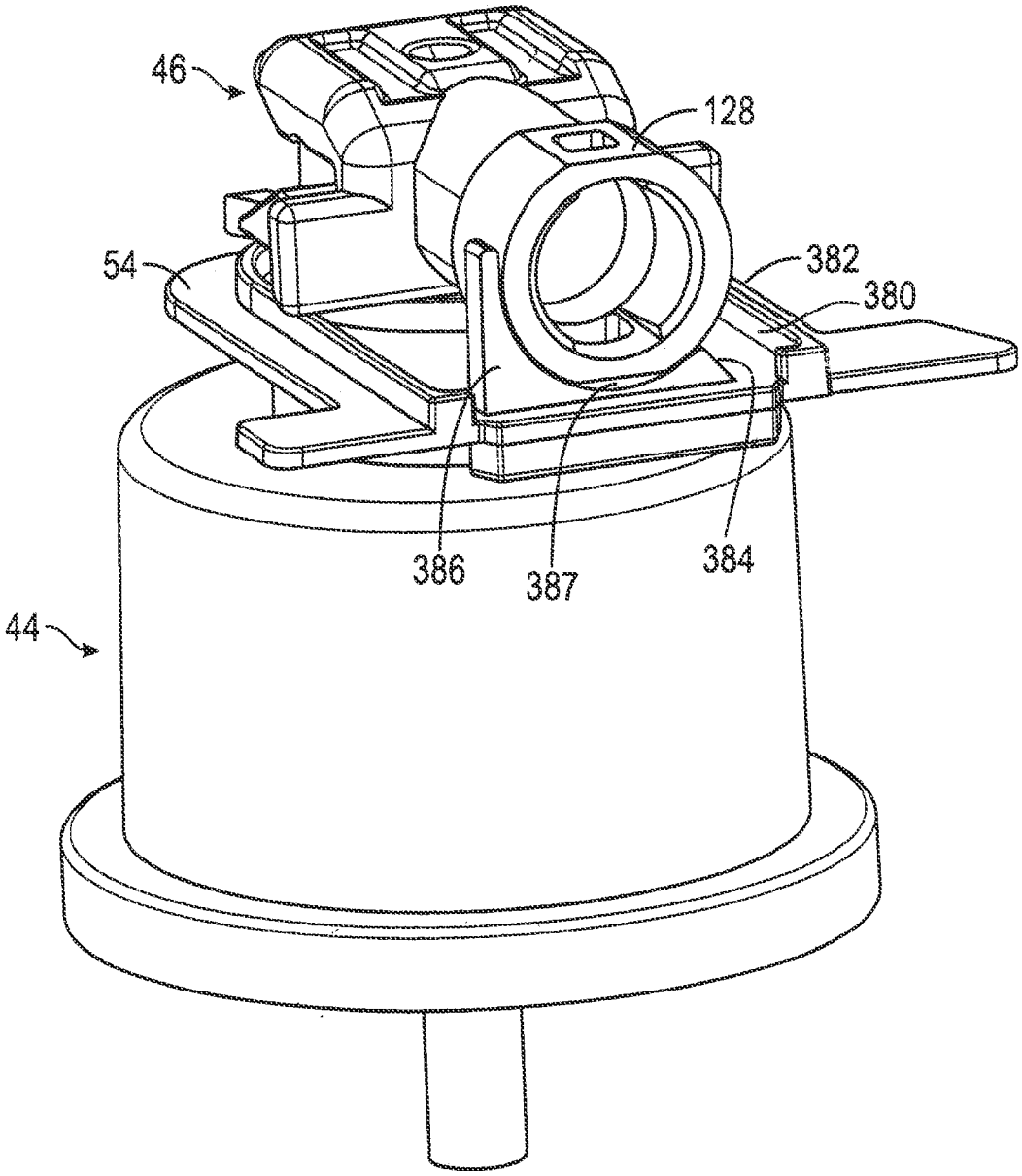
FIG. 13 is a top front pictorial view of the bottle cap member and the piston member of the bottle reservoir as seen in FIG. 11.

From the latched transport configuration as shown in FIGS. 9 and 10, the piston assembly 101 may be rotated about the axis 50 relative to the cap assembly 100 to assume an unlatched rotational orientation, for example, with the piston assembly 101 being rotated from the latched transport rotational orientation, as seen in FIGS. 9 and 10, to an unlatched rotational position as seen in FIGS. 1, 5, 11, 12 and 13. From the latched transport orientation, as seen in FIGS. 9 and 10, forces are applied to the piston assembly 101 to rotate the piston assembly clockwise as seen in top view relative to the cap assembly 100 with the piston member 46 to assume the unlatched rotational position as illustrated in FIGS. 11 to 13. The application of sufficient forces to the piston member 46 relative to the bottle cap member 44 will rotate the tube portion 128 relative the bottle cap member 44 from the latched transport orientation of FIGS. 9 and 10 to the latched rotational position shown in FIGS. 11 and 13. In moving from the latched transport configuration of FIG. 9 to the unlatched rotational position of FIG. 11, the hook member 306 is rotated about the axis 50 from the latch opening 330 into the free passage opening 334 and, in so doing, passes through the frangible member 332 breaking the frangible member 332. In the hook member 306 passing through the frangible member 332, the hook member 306 is moved circumferentially relative the frangible member 332 with circumferentially directed engagement surfaces on the hook member 306 engaging with an oppositely circumferentially directed surface of the frangible member 332. In the unlatched rotational position, the hook 306 is axially aligned with the free passage opening 334 and the hook member 306 is free to move axially upwardly and downwardly through the free passage opening 334 in relative reciprocal movement of the piston assembly 101 and the cap assembly 100 to operate the pump assembly 41 to discharge fluid from the bottle 42. For example, from the fully retracted position shown in FIG. 11, the piston member 46 can be moved axially upwardly with the hook member 306 to pass upwardly through the free passage opening 334 as to an extended position illustrated in FIG. 12. Reciprocal movement between the position of FIGS. 11 and 12 will result in operation of the pump assembly 41 to discharge fluid from the bottle 42.

The frangible member 332 preferably is configured such that when the frangible member 332 has been broken as is necessary to move from the latched transport configuration, the broken frangible member 332 will be visually apparent to a person inspecting the bottle assembly 40. For example, the frangible member 332 may be broken in a manner that it completely severs from the bottle cap member 44 and thus its absence is an indication of tampering or that the pump assembly 41 has been previously used. In other arrangements, the frangible member 332 may be partially severed with a portion requiring to be bent to a position where the fact that it has been broken is readily, visually apparent to a user, of course, without impairing the operation of the pump assembly 41.

As to the rotational forces that need to be applied to rotate the piston member 46 relative the bottle cap member 44 from the latched transport configuration to an unlatched configuration, the forces need to be sufficient to break the frangible member 332, and to overcome the resistance to rotational movement by the engagement of the hook member 306 between the front and rear walls of the latch opening 330, and by the engagement between the left locating surface 384 carried on the bottle cap member 44 and the horizontal tube portion 128 of the piston member 46.

Reference is made to FIG. 13 which illustrates the piston member 46 and the bottle cap member 44 in an unlatched rotational position with the piston fully retracted as in FIG. 11 and showing the locating tab 386 as providing a locating surface 387 configured to match the circumferential profile of a locating surface 390 on the horizontal tube portion 128 of the piston member 46 which, on axial downward movement of the piston member 46, locates the piston member 46 in the desired unlatched rotational position when the piston member 46 is fully retracted.

In accordance with the present invention, the bottle assembly 40 when in the latched transport condition as illustrated in FIG. 1 may be moved rearwardly to couple with the dispenser 10. In such rearward movement, the interaction between the bottle assembly 40 and the dispenser 10 can preferably be provided such that engagement between the piston assembly 101 and the dispenser 10 will rotate the piston assembly 101 from the latched transport configuration to an unlatched rotational position ready for use.

As seen on FIG. 10, the piston member 46 carries a vertically extending locating plate 390 which extends to a right distal end 392 carrying right cam surfaces 394. Similarly, the locating plate 390 also extends to a left distal end 396 carrying left cam surfaces 398.

Reference is made to FIG. 19 which is similar to FIG. 2 but merely illustrates the piston member 46 on the bottle cap member 44 as positioned ready for rearward sliding relative to the support member 22 for coupling. In such rearward sliding as has been discussed as with reference to FIGS. 14, 18 and 20, the cap support plate 54 is engaged on the housing support plate 29 with engagement between them orienting the bottle cap member 44 and the bottle 42 into a desired angular orientation relative to the support member 22. In such rearward sliding, the right vertical wall 32 of the support member 22 above the housing support plate 29 engages with the cam surface 394 on the right distal end 392 of the locating plate 390 carried on the piston member 46. Engagement between the right cam surface 394 and the right vertical wall 32 during rearward sliding of the pump assembly 41 relative to the support member 22 will apply forces to the piston member 46 which rotate the piston member 46 from the latched transport configuration to the unlatched rotational position.

The right and left cam surfaces 394 and 398 on the piston member 46 are spaced a distance corresponding to the horizontal spacing between the left and right vertical walls 31 and 32 of the support member 22. Each of the cam surfaces 394 and 398 are spaced a suitable distance from the center axis 50 such that with rearward sliding of the bottle assembly 40 with the bottle cap member 44 guided to be correctly oriented by the support member 22, engagement between the left and right vertical walls 31 and 32 and the cam surfaces 394 and 398 will rotate the piston member 46 relative to the bottle cap member 44 from the latched transport configuration to the unlatched configuration.

Second Embodiment

Reference is made to FIGS. 23 to 38 illustrating a second embodiment of a pump assembly 41 in accordance with the present invention.

In the second embodiment, the piston member 46 is identical to the piston member 46 of the first embodiment with the single exception that the hook member 306 is different. In the second embodiment the bottle cap member 44 is identical to the bottle cap member 44 of the first embodiment with the first exceptions that the latch opening 330, the free passage opening 334 and the frangible member associated with them are different, and with the second exceptions that the bottle cap vent structures 55 are different. Otherwise, the piston member 46 and the bottle cap member 44 of the second embodiment are the same as in the first embodiment and interact with the other elements of the dispenser 10 and the bottle assembly 40 in the same manner as in the first embodiment.

In describing the second embodiment, the same reference numerals are used to refer to the same and similar elements.

Bottle Cap Vent Structure Second Embodiment

Reference is made to FIGS. 23 to 30 illustrating a vent structure 55 provided on the bottle cap member 44 by which a vent port 58 initially sealed to prevent communication between the interior cavity of the bottle 42 and the atmosphere may be opened to provide communication between the interior cavity of the bottle 42 and the atmosphere.

A bottle assembly 40 includes the bottle 42 having an outlet opening 43. The bottle cap member 44 is to be secured to the bottle 42 about the outlet opening 43 as in the first embodiment. As seen on FIG. 27, the vent port 58 through the bottle cap member 44 has an inner end 47 open into the bottle 42 and an outer end 49 open to the atmosphere. A frangible plug member 60 is received in the vent port 58. The frangible plug member 60 prevents flow through the vent port 58 when frangible plug member 60 is intact and not broken.

A vent tab 56 is provided on the exterior of the bottle cap member 44. The vent tab 56 is coupled to the frangible plug member 60 with the vent tab 56 extending from the frangible plug member 60 accessible on the exterior of the bottle cap member 44 for engagement to apply forces to the vent tab 56 that become translated to the frangible plug member 60 breaking the frangible plug member 60. The frangible plug member 60 when broken permits flow through the vent port 58.

The vent tab 56 is coupled to the frangible plug member 60 at a load juncture 352. As seen on FIG. 25, the vent tab 56 is coupled to the bottle cap member 44 at a fulcrum juncture 354 spaced from the load juncture 352. The vent tab 56 comprises a lever member 360 extending from the fulcrum juncture 354 away from the fulcrum juncture 354 to a distal end 66 carrying an engagement surface 412. The load juncture 352, the fulcrum juncture 354 and the engagement surface 412 are juxtaposed such that with the application of forces to the engagement surface 412 of the lever member 360 the lever member 360 pivots about the fulcrum juncture 354 displacing the load juncture 352 and applying forces across the frangible plug member 60 to break the frangible plug member 60.

Preferably, the forces applied across the frangible plug member 60 to break the frangible plug member 60 are tension forces, however, the forces may be compression forces or a combination of tension forces and compression forces.

Preferably, the fulcrum juncture 354 is on the lever member 306 in between the load juncture 352 and the engagement surface 412 as in this second embodiment, however, a load juncture may be on a lever member in between a fulcrum juncture and an engagement surface.

Figure 24:
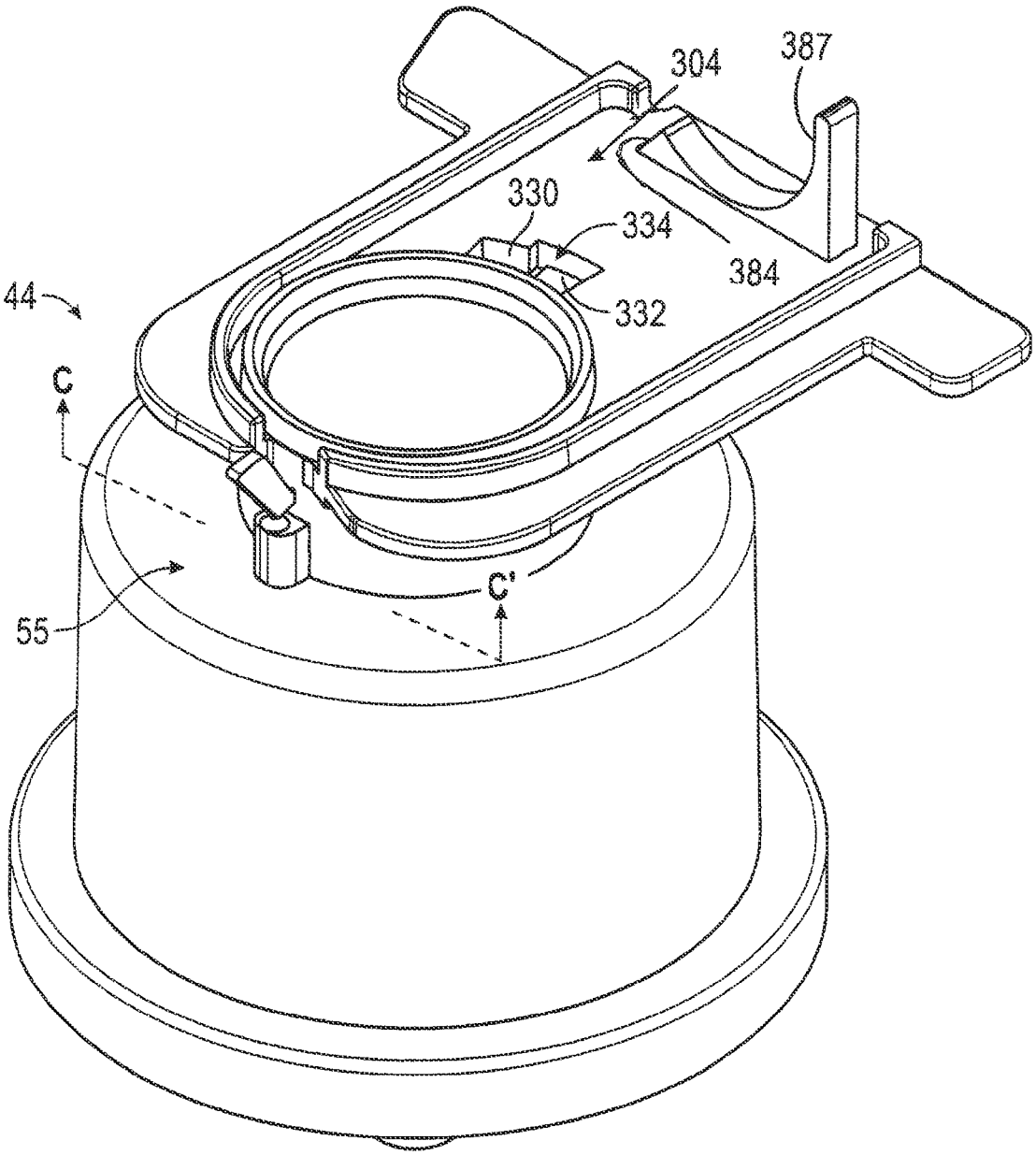
FIG. 24 is a rear top pictorial view of the bottle cap member of FIG. 23.

Preferably as shown on FIG. 24, the lever member 360 is accessible on the exterior of the bottle cap member for engagement to apply forces to the engagement surface to break the frangible plug member 60.

Preferably, the bottle cap member 44 is injected molded from plastic material integrally forming the vent port 58, the frangible plug member 60 and the vent tab 56 including the lever member 360, fulcrum juncture 354 and load juncture 352 with the frangible plug member 60 intact closing the vent port 58. Preferably, the fulcrum juncture 354 is flexible. Preferably, the bottle 42 is enclosed but for the outlet opening 43.

The bottle assembly 40 of the second embodiment may be provided in combination with a dispenser 10 having a housing 16 to which the bottle assembly 40 is removably coupled to dispense fluid from the bottle 42 in the same manner as the first embodiment with the bottle assembly 40 is movable relative the housing 16 to couple the bottle assembly 40 to the housing 16 in a dispensing position for dispensing of fluid from the bottle assembly 40. During movement of the bottle assembly 40 relative the housing 16 toward the dispensing position engagement between the engagement surface 412 provided on the lever member 310 and a cam surface 432 on the housing 16 applies forces to the lever member 360 that pivots the lever member 360 about the fulcrum juncture 354 to break the frangible plug member 60 in the dispensing position.

Preferably, the engagement surface 412 is directed in the rearward direction and the cam surface 432 on the housing 16 is directed in a forward direction opposite to the rearward direction.

Preferably, the lever member 360 extends from the fulcrum juncture 354 to the distal end 66 in the rearward direction and one or more of the group of: a. upwardly or rearwardly, and b. laterally. Preferably, with the cam surface 432 on the housing 16 directed in a forward direction, and the dispenser assembly 10 mounted vertically, the bottle assembly 40 is movable in a rearward direction relative the housing 16 to couple the bottle assembly 40 to the housing 16 in the dispensing position. However, this is not necessary and it is to be appreciated that the bottle assembly 40 can be movable other directions than a rearward direction relative the housing 16 to couple the bottle assembly to the dispenser, and a dispenser may be mounted in any desired orientation other than vertically.

Figure 27:
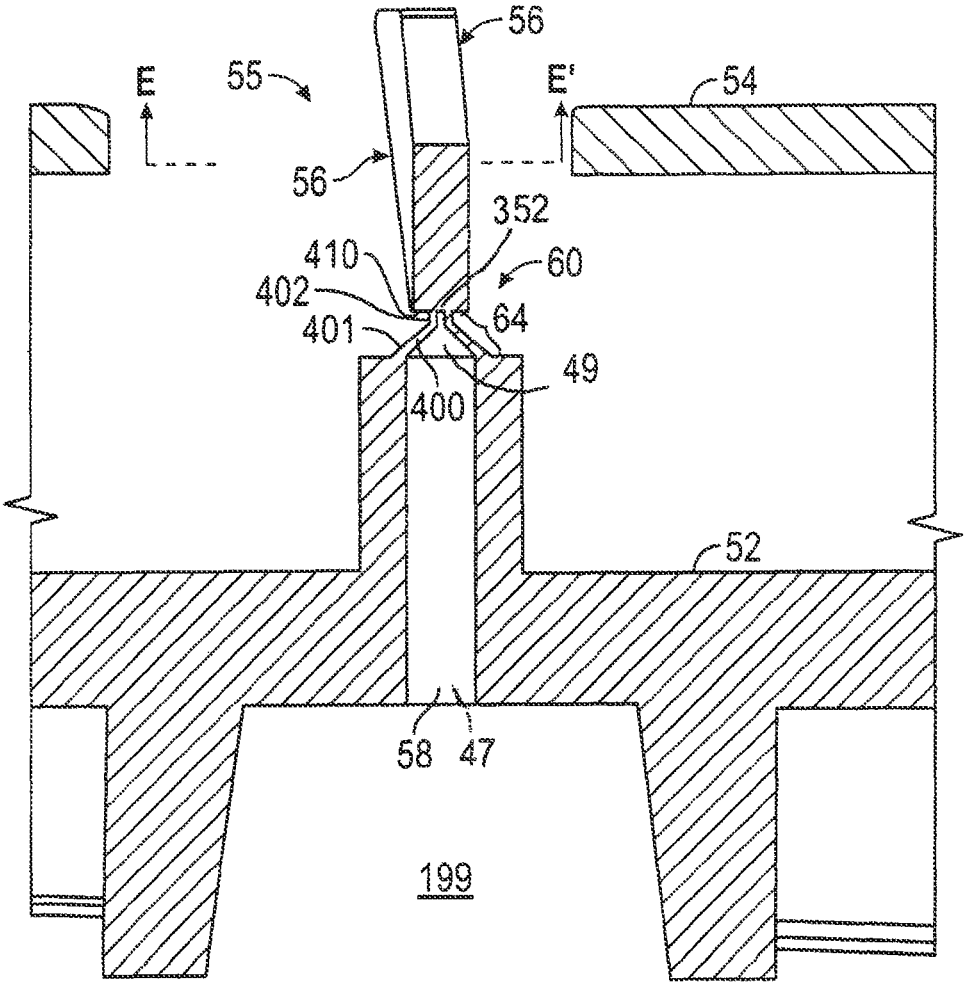
FIG. 27 is a vertical cross-section through the bottle cap member along section line D-D' on FIG. 26.

As seen in FIG. 27, the bottle cap vent structure 55 includes the vent port 58 and a frangible plug member 60 closing the vent port 58. The end wall 52 of the bottle cap member 44 includes the vent port 58 that extends upwardly through the end wall 52. An inner lower opening of the vent port 58 at the inner end 47 of the vent port 58 is open into an annular space 199 between the inner tube member 51 and the outer tubular collar member 53 of the bottle cap member 44. As was the case with the first embodiment, as in the second embodiment, when coupled to a bottle, the lower inner opening of the vent port 58 is to open radially inside the neck 134 of the bottle and through the neck into the interior cavity of the bottle. An outer end 49 of the vent port 58 is open to the atmosphere but for being closed by the frangible plug member 60.

The frangible plug member 60 includes a frangible ring 64 that is joined at a circumferential outer lower edge to the end wall 52 about the vent port 58 and extends upwardly to where the frangible ring 64 is closed at an upper end and merges at a circumferential inner upper edge with a lower surface 410 of the vent tab 56. The load juncture 352 is provided where the frangible ring 64 merges with the lower surface 410 of the vent tab 56. The frangible ring 64 is preferably tubular provided as a thin walled tube with a tube wall 400 having a frustoconical lower portion 401 and a cylindrical upper portion 402. Preferably, the tube wall is weakest between the frustoconical lower portion and the cylindrical upper portion 402. Preferably, the tube wall has a least thickness and a least cross-sectional area and is most likely to break at a juncture between the frustoconical lower portion 401 and the cylindrical upper portion 402.

Figure 25:
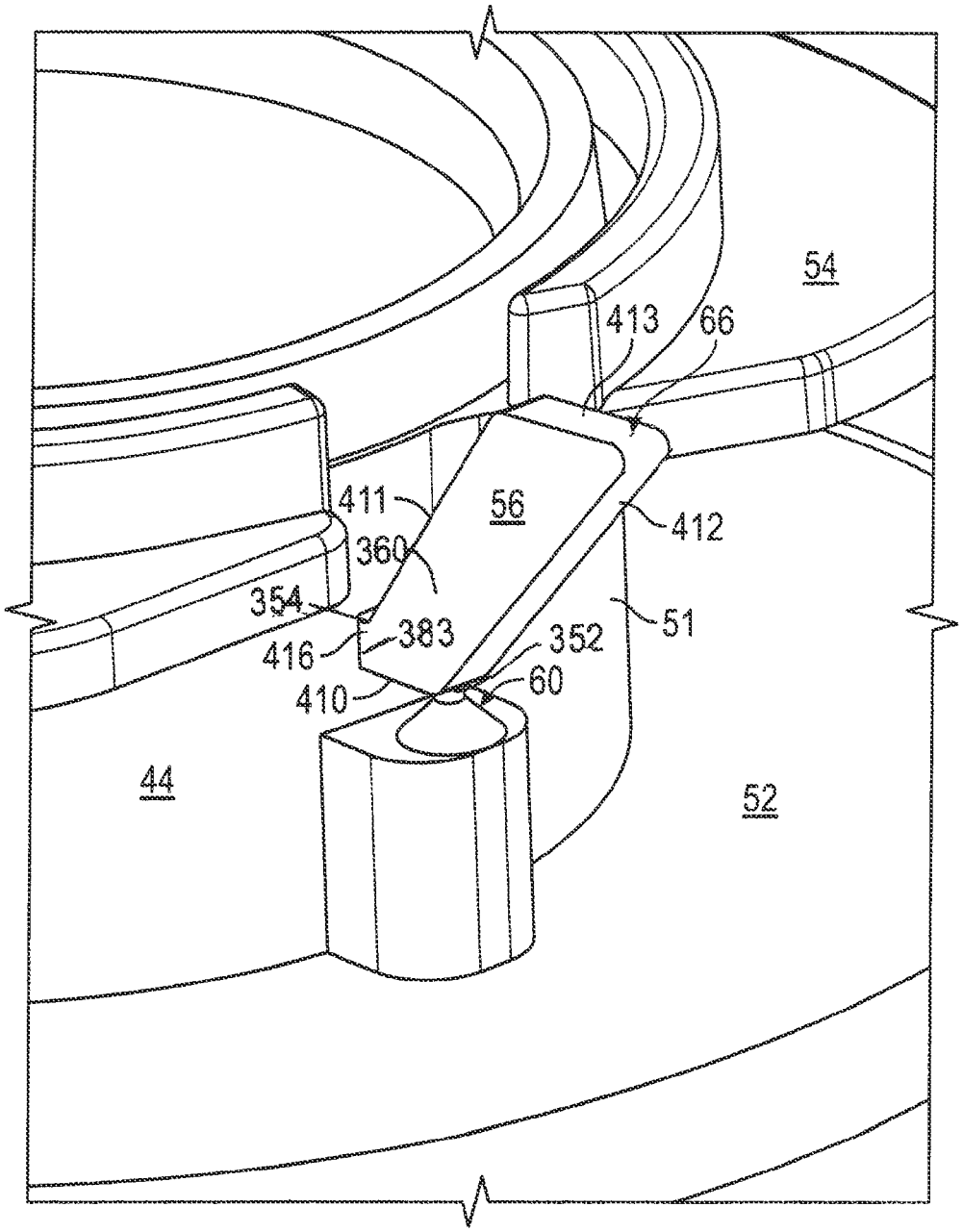
FIG. 25 is an enlarged rear top pictorial view of the bottle cap member shown in FIG. 24 as seen from the opposite side.

As best seen in FIG. 25, the vent tab 56 has the lower surface 410, a front surface 411, a cam forming rear surface or engagement 412 and a top surface 413. The vent tab 56 is an elongate member, or lever member 360, extending upwardly and rearwardly from a lower or proximate end 383 as by the lower surface 410 to a distal end 66. The vent tab 56 is joined to the end wall 52 by a fulcrum portion 416 that extends forwardly from the front surface 411 and merges into the inner tube 51. The fulcrum portion 416 provides the fulcrum junction 354. The fulcrum portion 416 is capable of being deflected such that, forces which are applied to the engagement surface 412 and distal end 55 urging the vent tab 56 forwardly and/or laterally to the left side of the bottle cap member 44, will pivot the vent tab 56 in the manner of a lever about the fulcrum portion 416 applying forces across the frangible plug member 60 breaking the frangible ring 64.

By applying suitable forces to the vent tab 56, the annular frangible ring 64 can be broken such that vent port 58 provides communication between the atmosphere through the bottle cap member 44 into the bottle 42.

Figure 30:
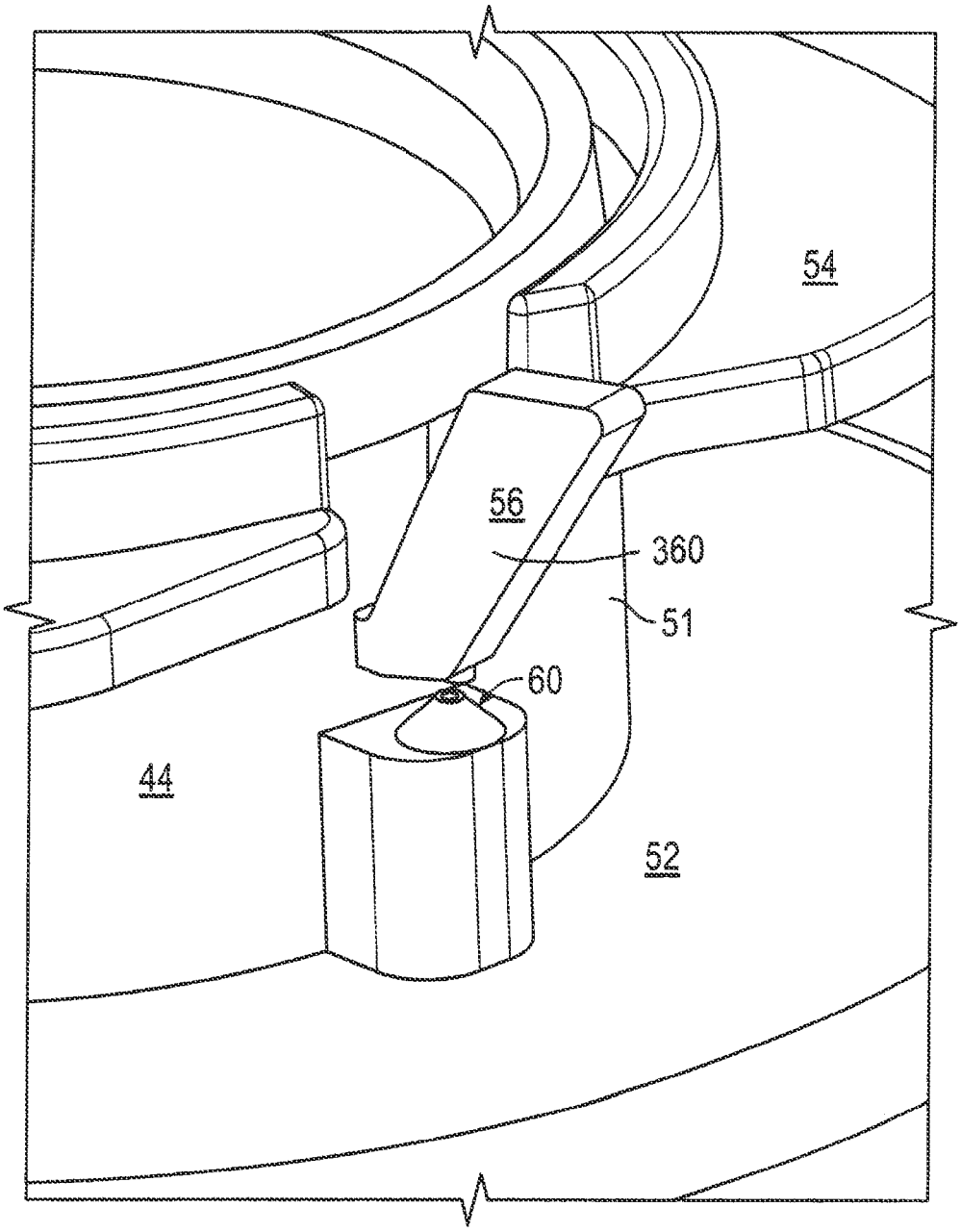
FIG. 30 is an enlarged pictorial view of the bottle cap member the same as FIG. 25 but showing a frangible plug member broken.
Figure 31:
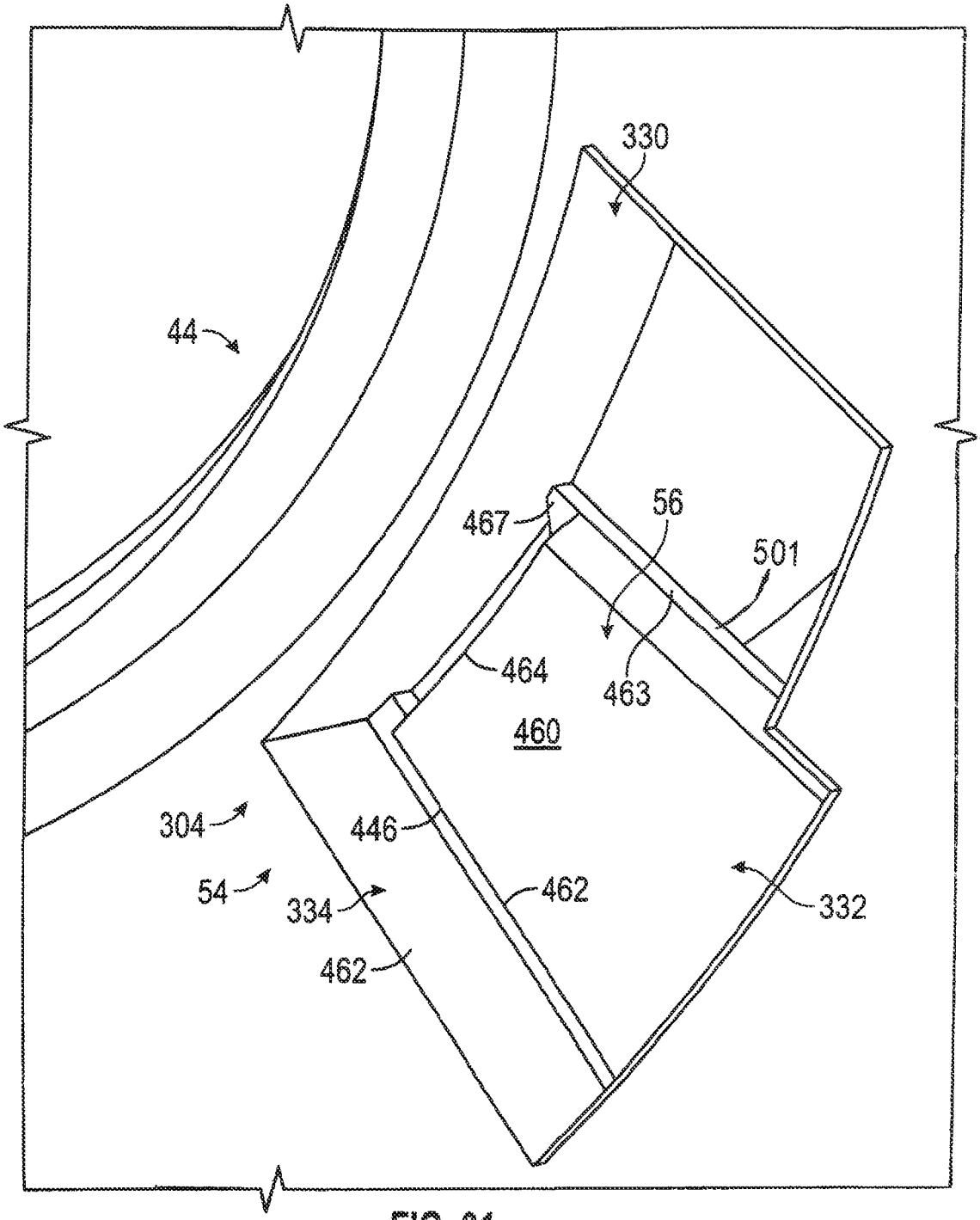
FIG. 31 is an enlarged front top pictorial view of the bottle cap member of FIG. 24 showing openings through the cap support plate.
Figure 32:
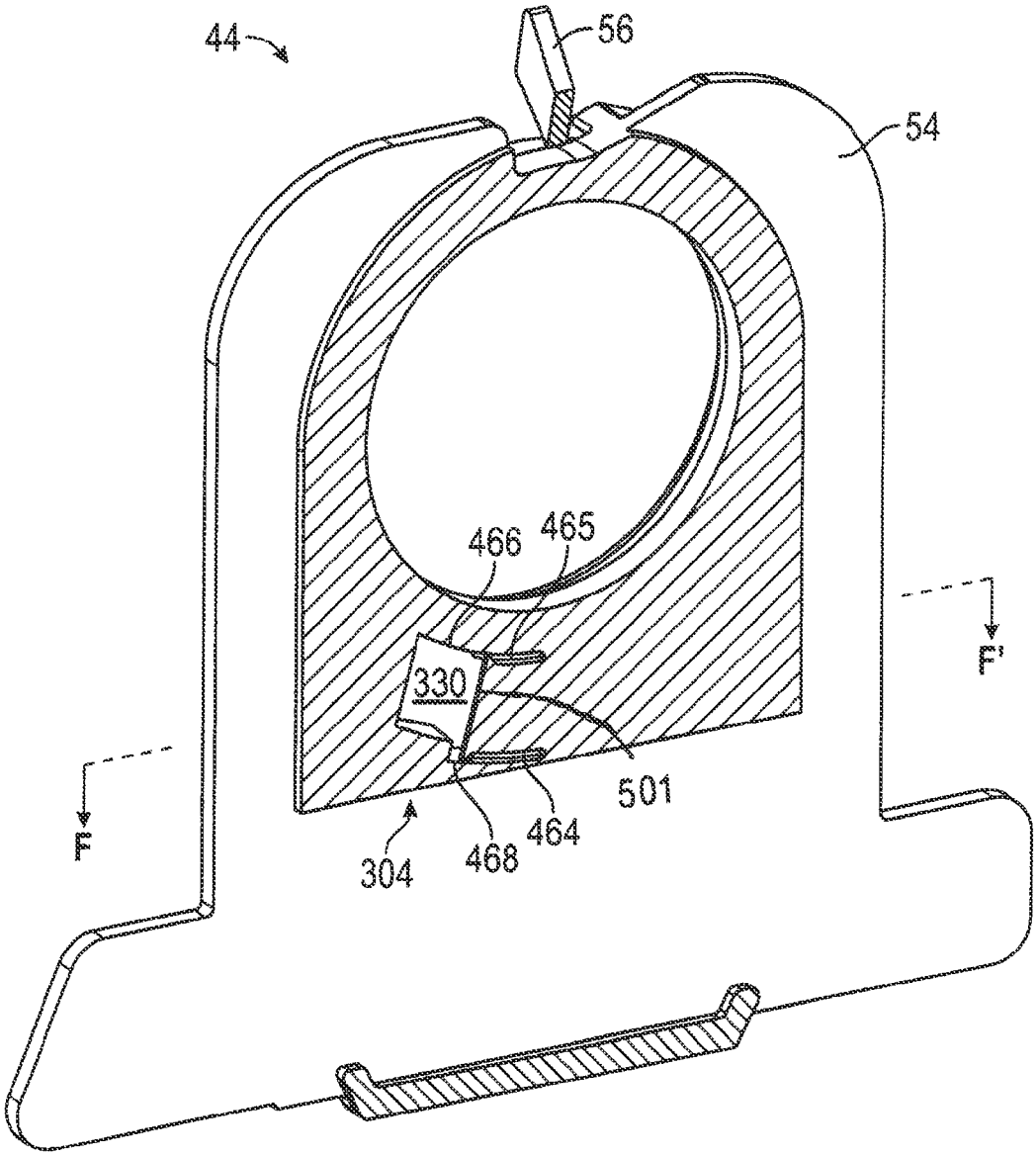
FIG. 32 is a pictorial bottom view of the bottle cap member of FIG. 23 along section line E-E' on FIG. 27.
Figure 33:
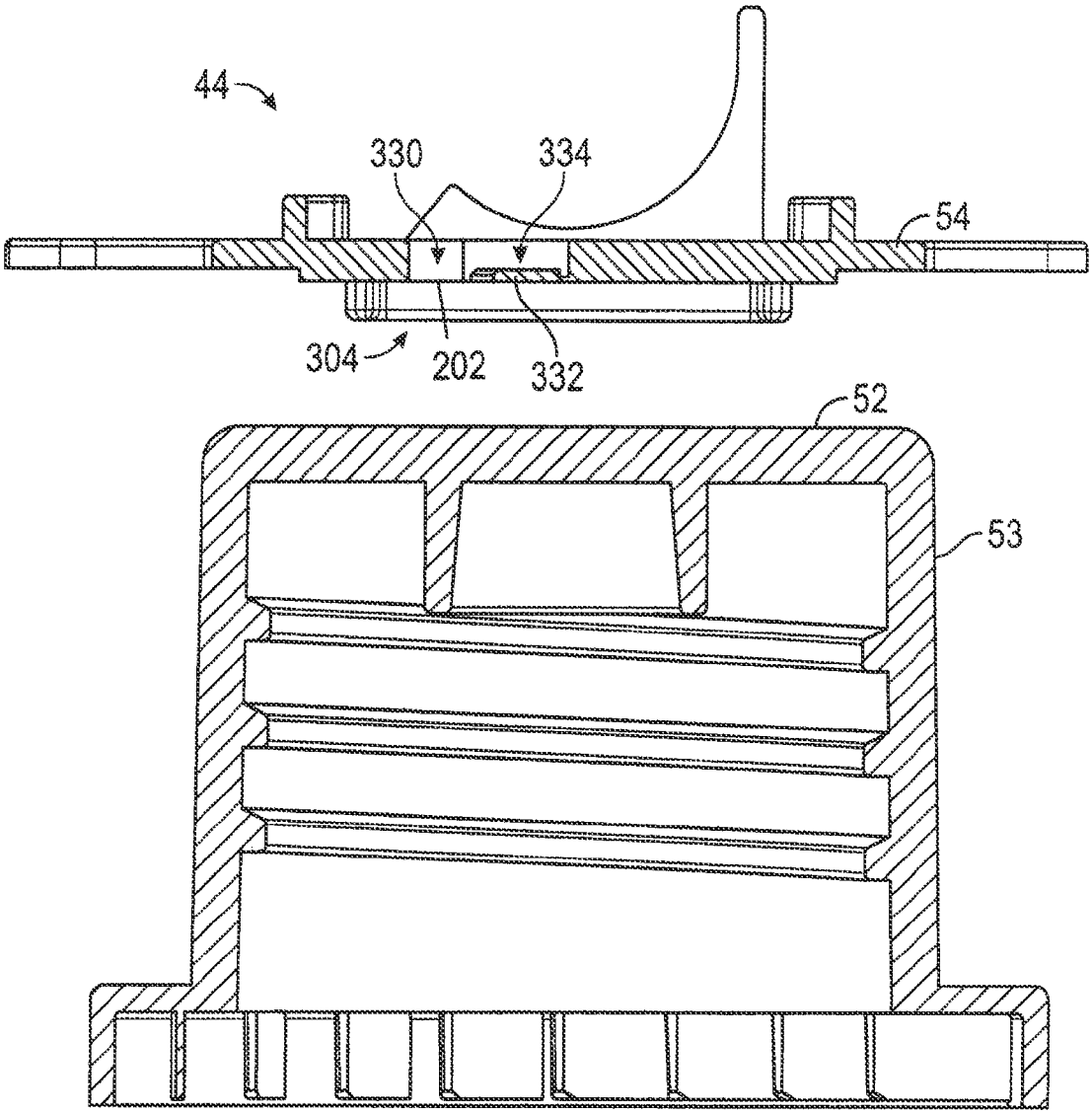
FIG. 33 is a cross-sectional rear view of the bottle cap member of FIG. 23 along section line F-F on FIG. 32.

As one manner of use of the bottle cap vent structure 55, prior to the insertion of the bottle assembly 40 into the dispenser assembly 10, a person may manually engage the vent tab 56 and apply forces to the vent tab 56 and thereby across the frangible ring 64 sufficient to break it. FIG. 30 shows the vent tab after it has been pivoted upwardly and the plug member 60 broken.

The bottle cap venting structure 55 is preferably configured such that in coupling of the bottle assembly 40 to the fluid dispenser 10, the frangible plug member 60 will become broken to provide air venting between the atmosphere and the interior of the bottle 42. As the bottle assembly 40 is coupled to the dispenser 10, on sliding of the bottle assembly 40 rearwardly, the bottle cap venting structure 55 engages with the housing 16 of the dispenser 10, breaking the frangible plug member 60 and opening the vent port 58.

Figure 28:
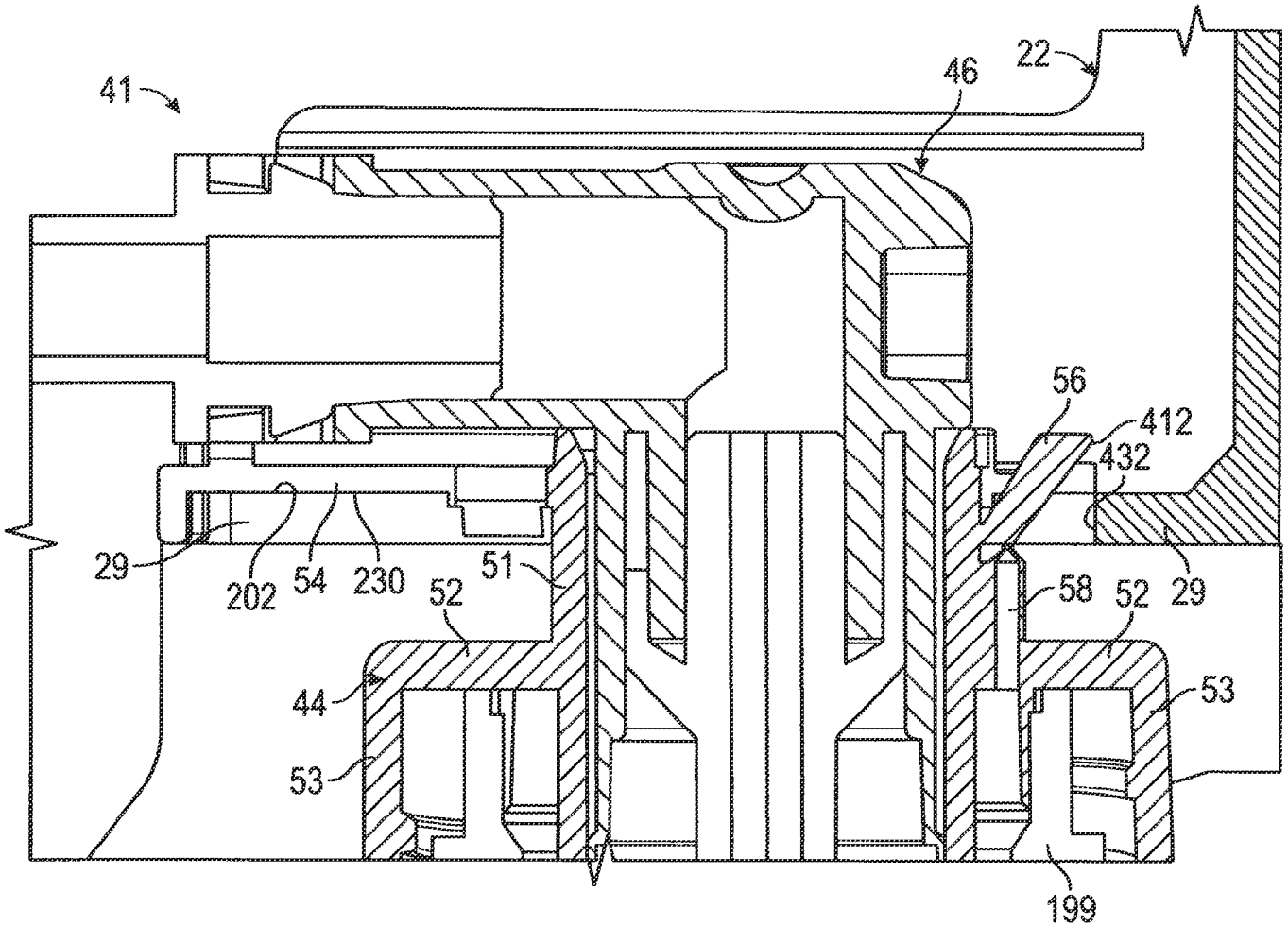
FIG. 28 is a cross-sectional right side view showing the bottle cap member and piston member of FIG. 23 in the unlatched rotational position slidably engaging on a support member of FIG. 17 during an intermediate position in a coupling procedure.

As seen in FIG. 28, the cap support plate 29 of the support member 22 includes a forwardly directed cam surface 432. FIG. 28 illustrates a piston pump assembly 41 including the bottle cap member 44 and the piston member 46 of the second embodiment supported on the support member 22, the same as illustrated in FIG. 18, in an intermediate position ready for further rearward relative sliding to couple the bottle cap member 44 to the support member 22. The bottle cap member 44 is slidable rearwardly relative to the support member 22 guided by engagement therebetween to adopt the desired angular orientation and to stop movement in a desired position. In such rearward sliding, the cap support plate 54 has its lower surface 202 engaged on the upper surface 230 of the housing support plate 29.

Figure 26:
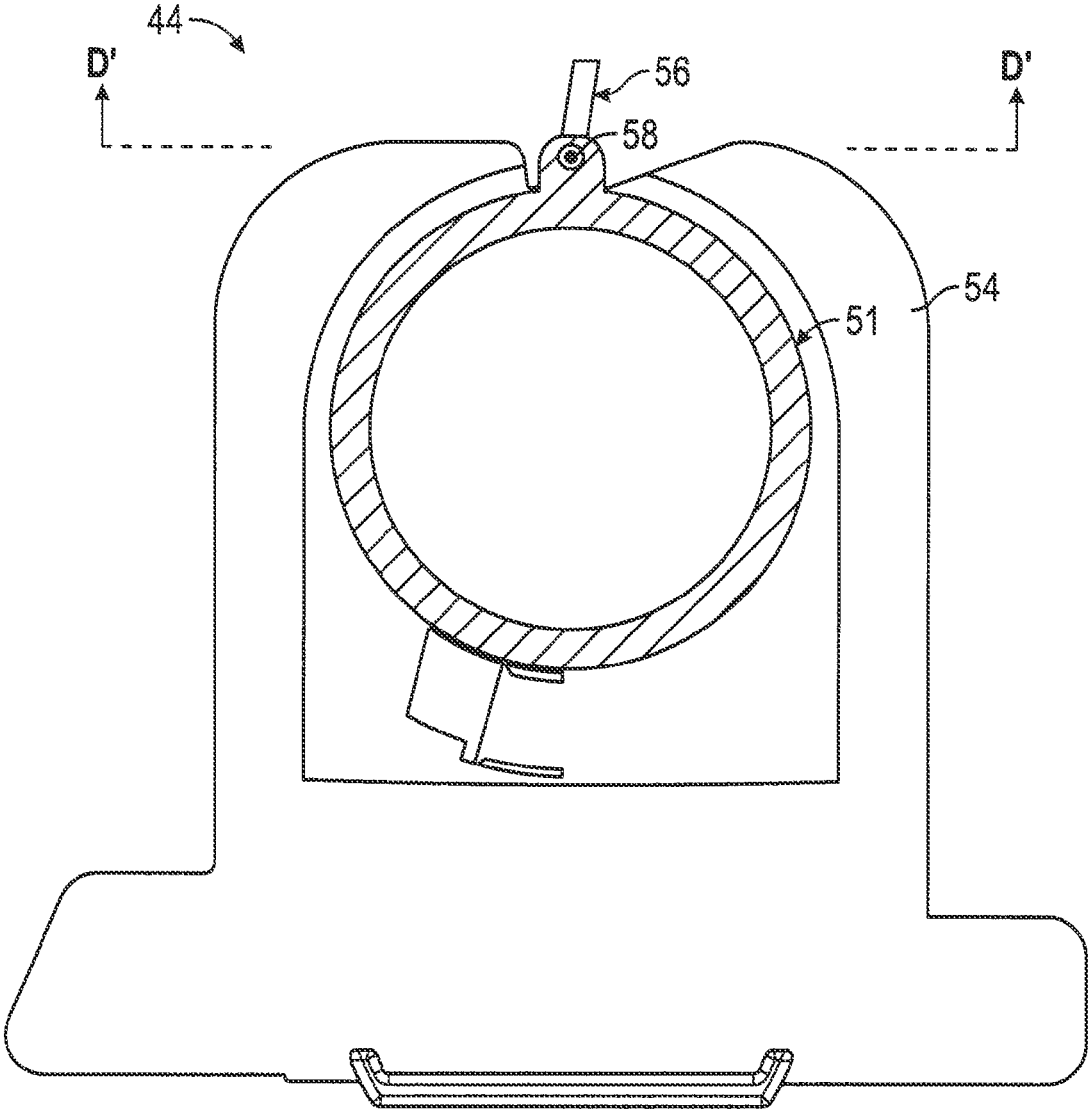
FIG. 26 is a bottom view of the bottle cap member of FIG. 24 cross-sectioned along section line C-C on FIG. 24 below the cap support plate.
Figure 29:
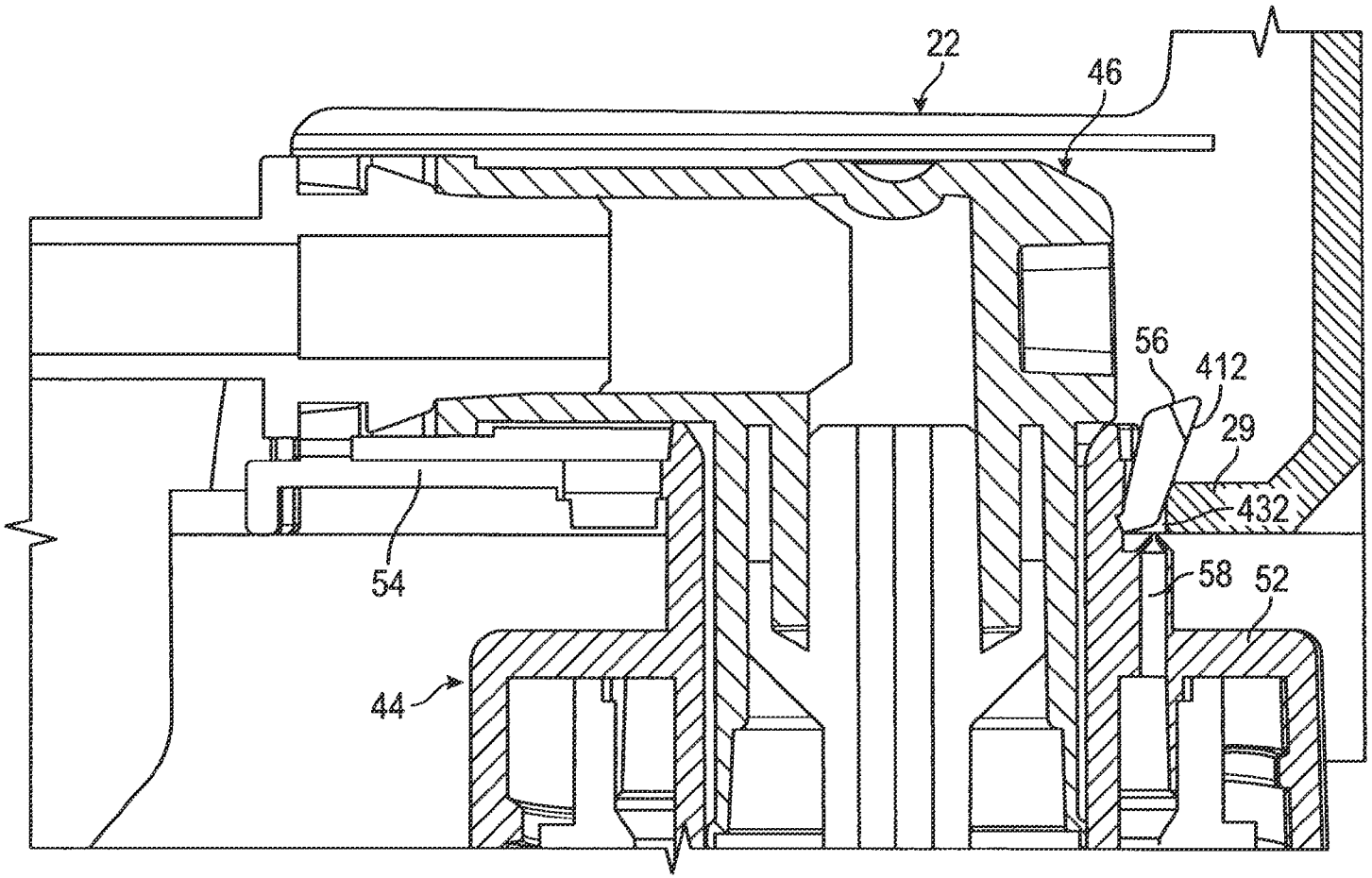
FIG. 29 is a cross-sectional right side view showing the bottle cap member and piston member of FIG. 23 in the unlatched rotational position slidably engaging on a support member of FIG. 17 in a final coupled position.

FIG. 28 which illustrates in cross-section along a center plane as seen from the right side, the support member 22 with the bottle cap member 44 in the intermediate position for sliding rearwardly with the cap support plate 54 engaged on the housing support plate 29. In FIG. 28, the intermediate position is a position in which the engagement surface 412 at the rear end of the vent tab 56 is spaced rearward of the cam surface 432 of the cap support plate 29. From the intermediate position of FIG. 28, with further rearward sliding of the bottle cap member 44, the bottle cap member 44 comes to assume a fully rearward position as shown in FIG. 29 in which the bottle cap member 44 is coupled to the support member 22 for dispensing fluid. In such further rearward sliding of the bottle cap member 44 from the intermediate position of FIG. 28 to the fully rearward position of FIG. 29, engagement between the engagement surface 412 on the vent tab 56 and the cam surface 432 of the support plate 29 pivots the vent tab 56 forwardly about its fulcrum portion 416 so as to apply forces that break the frangible plug member 60. The cam surface 432 of the support plate 29 engages the engagement surface 412 on the vent tab 56 at a height above the fulcrum portion 416, pivoting the vent tab 56 upwardly relative the fulcrum portion 416 placing tension forces across frangible plug member 60 which breaks the frangible ring 64. As can be seen in FIG. 26, the vent tab 56 extends from the frangible plug member 60 upwardly and towards the left side of the bottle cap member 44 as it extends rearwardly to its distal end 66. The rear edge 432 of the support plate 29 in engaging the cam forming rear surface 412 also therefore pivots the vent tab 56 about the fulcrum portion towards the left side which also assists in breaking the frangible plug member 60.

As can be seen on FIG. 25, the cap support plate 54 is cut away at its rear in the location of the vent tab 56 such that interference between the cap support plate 54 and the vent tab 56 does not limit the ability of the vent tab 56 to be moved sufficiently for breaking of the frangible plug member 60. Preferably, the bottle cap member 44 is injection molded from a plastic material so as to provide the bottle cap member 44 as a unitary integral element with the frangible plug member 60 including the frangible ring 64 integrally formed with the end wall 52 of a plastic material. The annular frangible ring 64 is preferably provided so as to have an axial dimension which is sufficiently small that by the application of forces to the vent tab 56 the annular frangible ring 64 will be broken, at least in part so as to provide communication through the vent port 58.

In use of the bottle assembly 40, as seen in FIG. 29, the vent tab 56 is moved to a position in which the frangible plug member 60 is sufficiently broken to permit air to pass through the vent port 58 yet with severed portion of the frangible plug member 60 and the vent tab 56 to remain attached to the bottle cap member 44 as for disposal and recycling as a unitary element. The bottle cap member 44 and the support member 22 are configured such that when they are coupled together, with the frangible plug member 60 broken to provide air passage, the frangible plug member 60 and the vent tab 56 can remain coupled to the bottle cap member 44 without interfering with the insertion and removal of the bottle assembly 40 or operation of the dispenser 10.

Storage Latching System Second Embodiment

The second embodiment includes a tamper evident latching system 300 provided on the pump assembly 41 by which the cap assembly 100 and the piston assembly 101 are latched together in a latched transport configuration that prevents use of the pump assembly 41 to dispense fluid until the latching system 300 is unlatched. A latching mechanism 302 is provided on the piston member 46 for interaction with a catch mechanism 304 on the bottle cap member 44 to provide the latching system 300.

The piston pump assembly 41 comprises the bottle cap member 44 and a bottle cap member 44. The bottle cap member 44 provides a fluid chamber 112 coaxial about a center axis 50. The piston member 46 has a piston portion 114 coaxially received in the chamber 112 for coaxially reciprocal movement of the piston member 46 between a retracted position and an extended position relative the bottle cap member 44 to draw fluid through the chamber 112 and discharge the fluid out a discharge outlet 48 carried on the piston member 46. The piston member 46 is rotatable about the axis 50 relative the bottle cap member 44 between a first rotational position and a second rotational position.

In the first rotational position on relative movement of the piston member 46 from the extended position to the retracted position, a latching system 300 couples the piston member 46 to the bottle cap member 44 in a latched configuration against axial movement toward the extended position. In the latched configuration, the piston member 46 is rotatable about the axis 50 relative the bottle cap member 44 from the first rotational position to the second rotational position in which second rotational position the piston member 46 is reciprocally movable relative the bottle cap member 44 between the retracted position and the extended position.

The latching system 300 includes a latching mechanism 302 and a catch mechanism 304. While the first and this second embodiment disclose the latching mechanism 302 on the piston member 46 as seen on FIG. 34 and the catch mechanism 304 on bottle cap member 44 as seen on FIG. 31, this is not necessary, and thus a first of the piston member 16 and the bottle cap member 44 may carry the latching mechanism 302 including a latch member 306 spaced radially from the axis 50 and a second of the piston member 16 and the bottle cap member 44 that is not the first of the of the piston member 46 and the bottle cap member 44 may carry the catch mechanism 301.

The latch member 306 comprises a latch surface 318 directed axially in a first axial direction. The catch mechanism 304 has a catch surface 202 directed axially in a second axial direction opposite the first axial direction as seen on FIG. 36. In the first rotational position, the latch surface 318 of the latch member 306 is at a same relative circumferential location about the axis 50 as a circumferential location of the catch surface 202, and the latch surface 318 and the catch surface 202 are axially opposed to each other. In the first rotational position with the piston member 46 in the extended position, the latch surface 318 of the latch member 306 is axially spaced from the catch surface 202 of the catch mechanism 304. In the first rotational position on relative movement of the piston member 46 from the extended position to the retracted position, the latch member 306 becomes engaged with the catch mechanism 304 with the latch surface 318 engaged with the catch surface 202 in the latched configuration against relative axial movement of the piston member 46 toward the extended position.

When the piston member 46 is in the first rotational position in the latched configuration, on rotation of the piston member 46 about the axis 50 relative the bottle cap member 44 from the first rotational position to the second rotational position circumferential movement of the latch member 306 relative the catch mechanism 304 moves the latch surface 318 to a different relative circumferential location about the axis 50 than a circumferential location of the catch surface 202 thereby disengaging the latch surface 318 from engagement with the catch surface 202.

While the first and this second embodiment disclose a frangible member 332 on the bottle cap member 44, and both the second engagement surface 321 and the latch member/hook member 306 on the piston member 16, this is not necessary. Thus, one of the piston member 46 and the bottle cap member 44 may include the frangible member 332 spaced radially from the axis 50 with a circumferentially directed first engagement surface 501 directed circumferentially in a first direction. Another of the piston member 46 and the bottle cap member 44, that is not the one of the piston member 46 and the bottle cap member 14, may include an engagement member with a circumferentially directed second engagement surface 321 directed circumferentially in a second direction opposite the first direction. The frangible member may be on either of the bottle cap member 44 and the piston member 46, with the frangible member on a different of the bottle cap member 44 and the piston member 46 than the second engagement surface to move relative to and engage and break the frangible member. While the first and this second embodiment disclose the latch member 306 on the piston member 46, and the latch opening 330, free passage opening 334 and the catch surface 202 on the on the battle cap member 44, this is not necessary. The latch member may be on either of the bottle cap member 44 and the piston member 46, with the latch opening 330, free passage opening 334 and the catch surface 202 on a different of the bottle cap member 44 and the piston member 46 than the latch member 306. While the first and this second embodiment disclose the frangible member 332 on the bottle cap member 44 and the latch opening 330, the free passage opening 334 and the catch surface 202 also on the bottle cap member 44 this is not necessary and the frangible member 332 may be on a different of the of the bottle cap member 44 and the piston member 46 than the latch opening 330, the free passage opening 334 and the catch surface 202.

The frangible member 332 is positioned on the one of the piston member 46 and the bottle cap member 44 with the first engagement surface 501 in circumferential opposition to the second engagement surface 321 such that when the piston member 46 is in the first rotational position in the latched configuration with the frangible member 322 intact and unbroken, rotation of the piston member 46 about the axis 50 towards the second rotational position circumferentially moves the second engagement surface 321 into circumferential engagement with the first engagement surface 501 with such circumferential engagement preventing the rotation of the piston member 46 to the second rotational position unless the frangible member 332 is broken by applying a rotational force to the piston member 46 relative the bottle cap member 44 greater than a first threshold rotational force required to break the frangible member 332 by the circumferential engagement between the second engagement surface 321 and the first engagement surface 501.

In the second rotational position, the bottle cap member 46 is axially movable relative the bottle cap member 44 between the retracted position and the extended positions without the latch surface 318 and the catch surface 202 engaging.

Preferably, when the piston member 46 is in the first rotational position in the latched configuration, on rotation of the piston member 46 about the axis 50 relative the bottle cap member 44 from the first rotational position toward the second rotational position in the circumferential movement of the latch member 306 relative the catch mechanism 304, latch surface 318 is slidable circumferentially relative to and in engagement with the catch surface 202.

Preferably, the latch member 306 comprises a hook member 306 extending axially parallel to the axis 50 from a proximate end 309 to a distal end 310. The hook member 306 has a side tab 316 that extends laterally of the axis 50 and carries the latch surface 318. The catch mechanism 304 has an axially extending latch opening 330 with the catch surface 202 adjacent the latching opening 330. In the first rotational position on relative movement of the piston member 46 from the extended position to the retracted position, the hook member 306 becomes located within the latch opening 330 with the latch surface 318 engaged with the catch surface 202 in the latched configuration preventing relative axial movement of the piston member 46 toward the extended position.

Preferably, the catch mechanism 304 includes a free passage opening 334 located circumferentially adjacent the latch opening 330 positioned such that when the piston member 46 is in the first rotational position in the latched configuration, on rotation of the piston member 46 about the axis 50 relative the bottle cap member 44 to the second rotational position, the hook member 306 is moved from the latch opening 330 circumferentially into the free passage opening 334, locating the hook member 306 to extend axially through the free passage opening 334 in the retracted position and the second rotational position. In second rotational position the hook member 306 is freely axially movable in the free passage opening 443 permitting reciprocal axial movement of the bottle cap member 44 between the retracted position and the extended position. In the first and second embodiments, the free passage opening 334 is shown as being enclosed that is bounded on three sides to retain the hook member 306 within the free passage opening 334 and the latch opening 330 against removal by movement in circumferential and radial directions. It is not necessary that the free passage opening 334 be bounded at all, and the free passage opening may be provided where a latch opening opens circumferentially or radially through a circumferential or radial edge of the bottle cap member 44.

Preferably, the second of the piston member 46 and the bottle cap member 44 carrying the catch mechanism 304 is the one of the piston member 46 and the bottle cap member 44 that includes the frangible member 332 with the frangible member 332 positioned on the second of the piston member 46 and the bottle cap member 44 with the first engagement surface 501 in the free passage opening 334 as in the case of the second embodiment, or between the latch opening 330 and the free passage opening 334 as in the case of the first embodiment, such that when the piston member 46 is in the first rotational position in the latched configuration with the frangible member 332 intact and unbroken, rotation of the piston member 46 towards the second rotational position circumferentially moves the second engagement surface 321 on the hook member 306 into circumferential engagement with the first engagement surface 501 on the frangible member 332 with such circumferential engagement preventing the rotation of the piston member 46 to the second rotational position until the frangible member 332 is broken by applying the rotational force to the piston member 46 relative the bottle cap member 44 greater than the first rotational threshold force required to break the frangible member 332.

As disclosed in the first embodiment, the frangible member 332 may comprise a thin wall closing the latch opening 330 from the free passage opening 334.

Preferably, as in this second embodiment, the frangible member 332 is provided within the free passage opening 334 and prevents the hook member 306 from entering the free passage opening 334 sufficiently to exit the latch opening 330 unless the frangible member 332 is broken. Preferably, the frangible member 332 is provides as a door-like member extending transversely across the free passage opening 334 and on the frangible member 332 being broken the door-like member is displaced away from the latch opening 330 by movement of the hook member 306. The door-like member can be coupled in the free passage opening 334 by a hinge member 466 along an end 462 of the door-like member remote from the latch opening 330 and also coupled in the free passage opening 334 by one or more thin frangible holding members or tabs 467 and 468, the proximate the latch opening 330, wherein with breaking of the frangible member 332 by breaking the frangible tabs 167 and 468 the door-like member is pivoted about the hinge member 466 by movement of the hook member 306 with the door-like member retained within the free passage opening 334 by the hinge member 466.

As in the second embodiment, the second of the piston member 46 and the bottle cap member 44 carrying the latch member 306 is the bottle cap member 44, preferably with the bottle cap member 44 includes a cap support plate 54 extending normal the axis 50 with; a first surface 200 directed axially in one direction and a second surface 220 directed in an opposite direction; the latch opening 330 extending through the cap support plate 54 from the first surface 200 to the second surface 220; and the latch surface 318 provided by the second surface 220 adjacent the latch opening 330. In the first rotational position in the latched configuration on relative movement of the piston member 46 from the extended position to the retracted position, the hook member 306 becomes located within the latch opening 330 with the latch surface 318 engaged with the catch surface 202 in the latched configuration preventing relative axial movement of the piston member 46 toward the extended position.

As in both the first and this the second embodiment, the one of the piston member 46 and the bottle cap member 44 that includes the frangible member 332 is the bottle cap member 44.

Preferably, as in each of the first embodiment and in this second embodiment, the frangible member 332 when broken is visible from an exterior of the pump assembly 41 as being broken and provides a visual indication that the piston member 46 has been moved from the latched configuration to an unlatched configuration.

The pump assembly can include a resistance mechanism preventing, when the piston member 46 is in the latched configuration, the rotation of the piston member 46 about the axis 50 relative the bottle cap member 44 from the first rotational position, unless a rotational force is applied the piston member 16 relative the bottle cap member 44 in a direction from the first rotational position towards the second rotational position greater than a second threshold rotational force. The resistance mechanism may as was the case with the first embodiment include a circumferentially directed first resistance surface 379 on the piston member 46 spaced radially from the axis 50 directed circumferentially in a first direction; a circumferentially directed second resistance surface 384 on the bottle cap member 44 spaced radially from the axis 50 directed circumferentially in a second direction opposite the first direction, with the second resistance surface 384 circumferentially opposed to the first resistance surface 379. The first resistance surface 379 is positioned on the piston member 46 with the first resistance surface 379 in circumferential opposition to the second resistance surface 384 such that when the piston member 46 is in the first rotational position in the latched configuration the first resistance surface 379 is in engagement with the second resistance surface 384 resisting rotation of the piston member 46 about the axis 50 towards the second rotational position unless the rotational force applied the piston member 46 relative the bottle cap member 44 is greater than the second threshold rotational force.

The pump assembly can also include as was the case with the first embodiment a circumferentially directed first stop surface 379 on the piston member 46 spaced radially from the axis 50 directed circumferentially in the second direction, and a circumferentially directed second stop surface 387 on the bottle cap member 44 spaced radially from the axis 50 directed circumferentially in the first direction circumferentially opposed to the opposite the first stop surface 379, wherein the first stop surface 379 is positioned on the piston member 46 with the first stop surface 379 in circumferential opposition to the second stop surface 387 such that when the piston member 46 is in the first rotational position in the latched configuration the first stop surface 379 is in engagement with the second stop surface 387 preventing rotation of the piston member 46 about the axis 50 from the first rotational away from the second rotational position.

Preferably, the bottle cap member 44 is injected molded from plastic material integrally forming the frangible member 332, the catch opening 330, the free passage opening 334 and the catch surface 202 with the frangible member 332 unbroken.

The piston pump assembly may provide in combination with a dispenser 10 having a housing 16 to which the piston pump assembly 41 is removably coupled to dispense fluid from a bottle 42. The piston pump assembly 41 is movable relative the housing 16 to couple the piston pump assembly 41 to the housing 16. With the piston member 46 in the latched configuration during movement of the piston pump assembly 41 relative the housing 16 to couple the pump assembly 46 to the housing 16, engagement between a cam surface 394,398 provided on the piston member 46 and a caroming surface 219, 220 on the housing 126 rotates the piston member 46 about the axis 50 relative the bottle cap member 44 from the first rotational position to the second rotational position.

Figure 34:
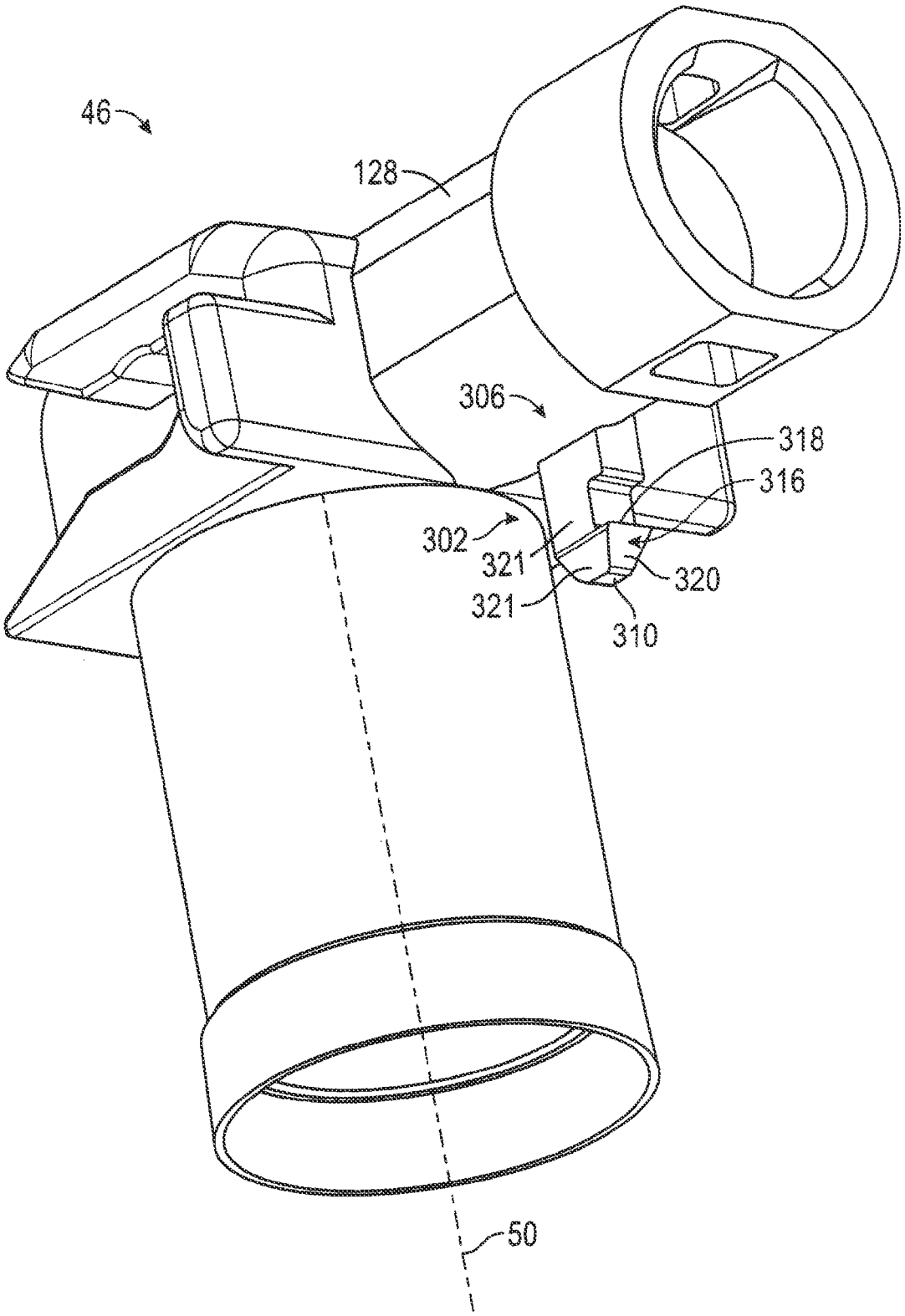
FIG. 34 is a front rear pictorial view of the piston member of FIG. 23.
Figure 35:
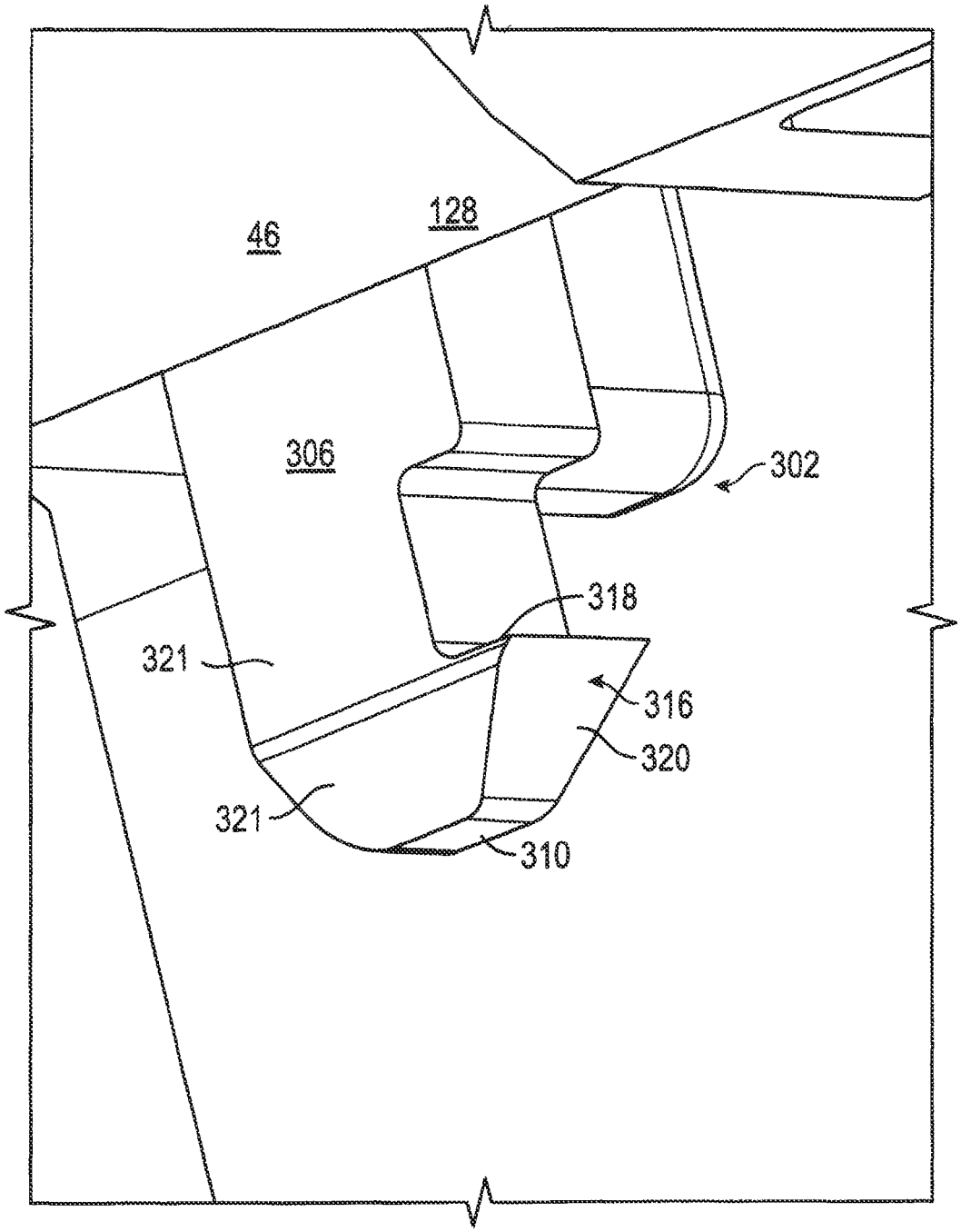
FIG. 35 is an enlarged view of FIG. 34 showing a hook member.

As seen on FIG. 34, the horizontal tube portion 128 of the piston member 46 carries as part of the latch mechanism 302 a latch member 306 sometimes being and referred to as a hook member 306 since the latch member 306 is preferably in the form of a hook member, the latch or hook member 306 extends parallel the central axis 50 from an upper or proximate end 503 secured to a lower surface of the horizontal tube portion 128 downwardly to a distal end 310. The hook member has a front face, a rear face, a right side face and left side face, all of which merge at the distal end 310. A side tab or hook tab 316 extends forwardly providing an upwardly directed latch surface 318. The hook tab 316 carries a forwardly directed cam surface 320 forming part of the distal end 310 with the cam surface 320 extending upwardly as it extends forwardly. The hook tab 316 also carries a laterally directed cam surface 321 forming part of the distal end 310 with the cam surface 320 extending upwardly as it extends to the left.

The catch mechanism 304 is provided on the cap support plate 54 and includes a latch opening 330 and a free passage opening 334. The latch opening 330 extends through the cap support plate 54 opening both through the plate upper surface or first surface 200 and the plate lower surface or second surface 220. Similarly, the free passage opening 334 extends entirely through the cap support plate 54 from the plate upper surface 200 to the plate lower surface 220. The latch opening 330 has a front wall, a rear wall and a right wall. The free passage opening 334 has a front wall, a rear wall and a left wall 462. The latch opening 330 opens to the left into the free passage opening 334.

A frangible member 332 is disposed in the free passage opening 334. The frangible member 332 is formed as a door-like member disposed in a plane that extends across the free passage opening 334. The frangible member 332 has an upper surface 460, a lower surface 461, a left hinge end 462, a right distal end 463, a rear edge 464 and a front edge 465, The right digital end 463 carries a circumferentially directed first engagement surface 501 as seen on FIG. 31.

The frangible member 332 is secured along its left hinge end 462 to the left wall 462 of the free passage opening 334 by a thin horizontal living hinge member 466 that extends along the left side wall 462 from the front to the rear. The rear edge 464 of the frangible member 332 is spaced forwardly from the rear wall of the free passage opening 334 other than where proximate the junction of the rear edge 464 and the right distal end 463 a thin rear frangible holding member 467 is provided joining the frangible member 332 to the rear wall of the free passage opening 334. Similarly, the front edge 465 of the frangible member 332 is spaced rearwardly from the front wall of the free passage opening 334 other than where proximate the junction of the front edge 465 and the right distal end 463 a thin front frangible holding member 468 is provided joining the frangible member 332 to the front wall of the free passage opening 334.

Figure 36:
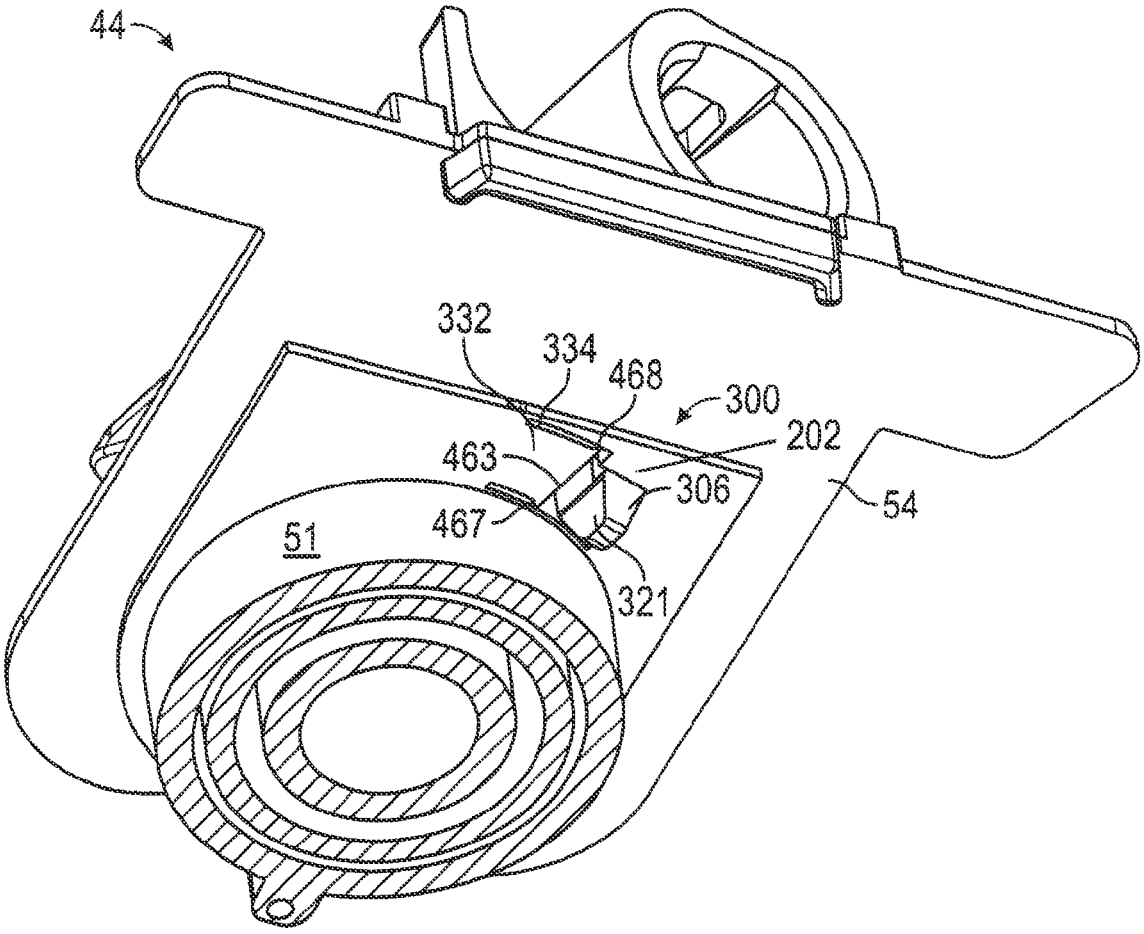
FIG. 36 is a bottom front perspective view of the bottle cap member and piston member of FIG. 23 in the latched storage position cross-sectioned along section line G-G' on FIG. 23.

With the piston member 46 coupled to the bottle cap member 44 for coaxial sliding along the axis 50 and in a transport rotational position about the axis 50, the hook member 306 carried on the piston member 46 is axially aligned with the latch opening 330 carried on the support plate 54 of the bottle cap member 44. While in this transport rotational position, relative downward axial movement of the piston member 46 on the bottle cap member 44 causes the forwardly directed cam surface 320 forming part of the distal end 310 of the hook member 306 to engage with the upper surface of the support plate 29 adjacent the front wall of the latch opening 330 to deflect the hook member 306 rearwardly to permit the hook member 306 and its hook tab 316 pass downwardly through the latch opening 330 until the hook tab 316 extends below the lower surface of the support plate and under the inherent bias of the hook member 306 the upwardly directed latch surface 318 of the hook member is received engaged with the lower surface of the support member 29 assuming a latched transport configuration as illustrated in FIG. 36. In the latched transport configuration, the hook member 306 has passed through the latch opening 330 and the latch surface. 318 on the hook member 306 has come to be engaged with the lower surface 202 of the cap support plate 54 adjacent the latch opening 330, serving as and also referred to as a catch surface 202, so as to prevent axial movement of the piston member 46 from the latched retracted position shown in FIG. 36 axially upwardly towards extended positions. As seen in FIG. 36, the hook member 306 has passed downwardly through the latch opening 330 without damaging the frangible member 332.

In the latched transport configuration, the pump assembly 41 is inoperative to pump fluid since the piston member 46 is secured to the bottle cap member 44 against relative axial movement. As well, in the latched transport configuration, the pump assembly 41, the pump assembly 41 is preferably configured to prevent fluid flow from the bottle through the pump assembly 41. This can preferably be accomplished, for example, as seen in FIG. 6, when in a latched transport configuration, the one-way outlet valve 118 of the piston member 46 is axially urged into the one-way inlet valve 102 as to prevent the one-way inlet valve 118 from deflecting or moving as is necessary to permit fluid flow either outwardly or inwardly past the one-way inlet valve 102. With the bottle cap member 44 carrying the frangible plug member 60 intact blocking the vent port 58 and with the bottle cap member 44 sealably engaged on the neck of the bottle 42, and the bottle not having any other openings than its outlet opening 136, fluid within the bottle assembly 40 cannot flow out of or leak from the bottle assembly no matter what vertical orientation the bottle assembly 40 is placed in.

Figure 37:
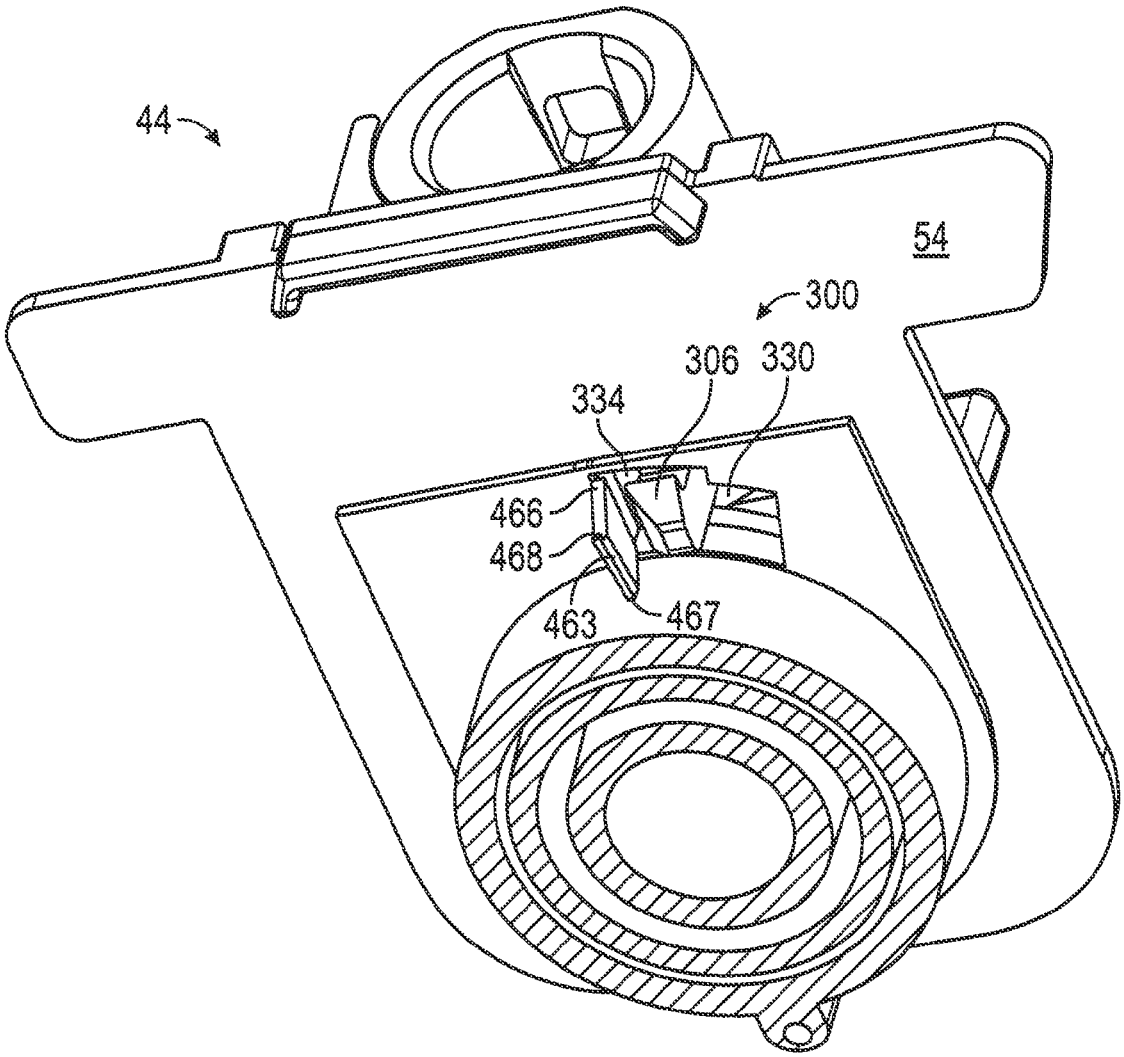
FIG. 37 is a bottom front pictorial view of the bottle cap member and the piston member of FIG. 23 cross-sectioned along section line G-G similar to that seen in FIG. 36 but in an uncoupled rotational position.
Figure 38:
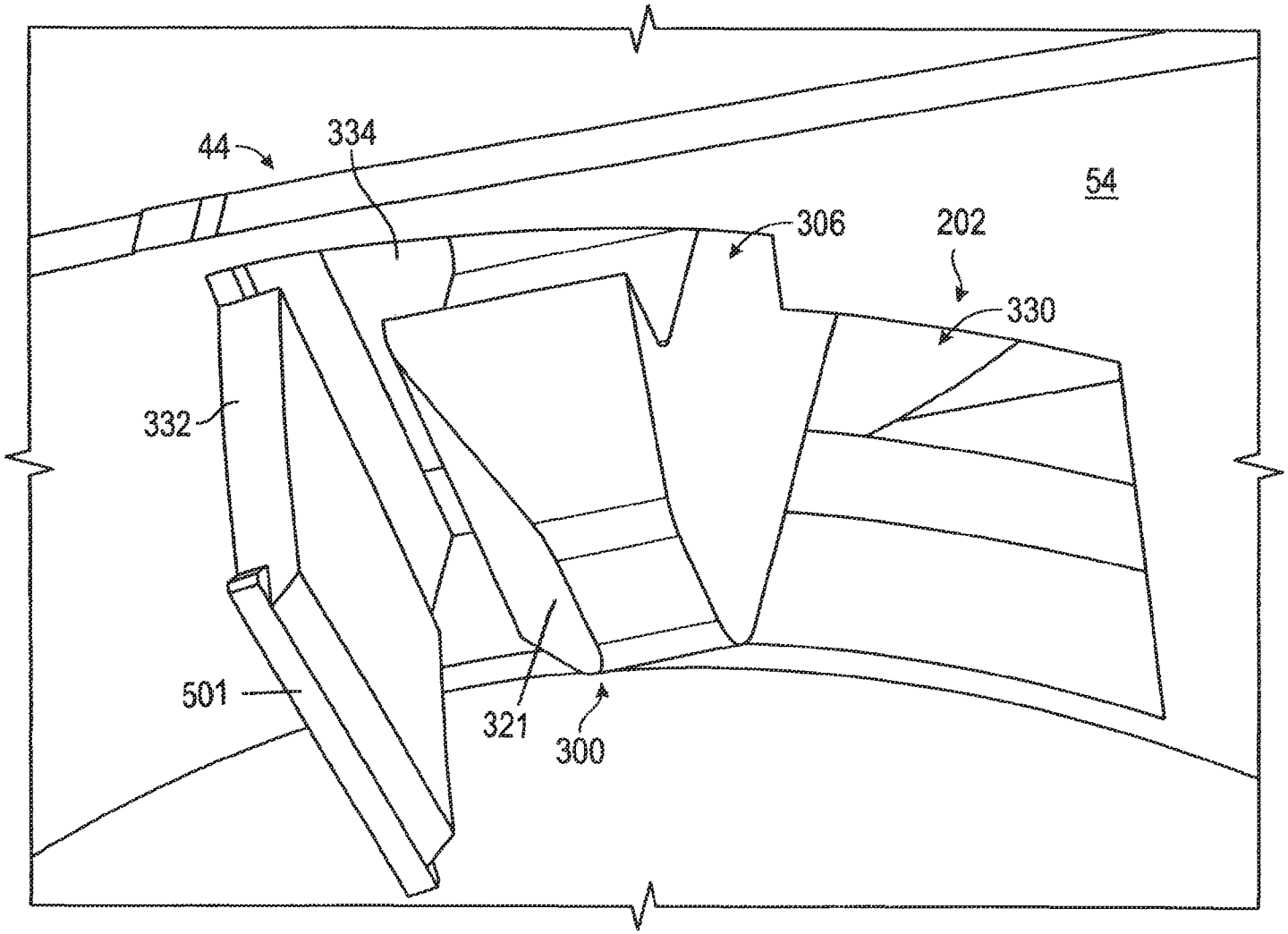
FIG. 38 is an enlarged view of portions of FIG. 37.

From the latched transport configuration as shown in FIG. 36, the piston assembly 101 may be rotated about the axis 50 relative to the cap assembly 100 to assume an unlatched rotational orientation, for example, with the piston assembly 101 being rotated from the latched transport rotational orientation, as seen in FIG. 36, to an unlatched rotational position as seen in FIG. 37. From the latched transport orientation, as seen in FIG. 36, forces are applied to the piston assembly 101 to rotate the piston assembly clockwise as seen in top view relative to the cap assembly 100 with the piston member 46 to assume the unlatched rotational position as illustrated in FIG. 37. The application of sufficient forces to the piston member 46 relative to the bottle cap member 44 will rotate the piston member 46 relative the bottle cap member 44 from the latched transport orientation of FIG. 36 to the unlatched rotational position shown in FIG. 37. In moving from the latched transport configuration of FIG. 36 to the unlatched rotational position of FIG. 37, the hook member 306 is rotated about the axis 50 from the latch opening 330 into the free passage opening 334 and, in so doing, engages the frangible member 332 breaking the thin rear frangible holding member 467 and the thin front frangible holding member 468 and pivoting the frangible member 332 about the living hinge member 466 such that the frangible member 332 extends downwardly from the living hinge member 466 to below the support plate 29. In the hook member 306 moving into the free passage opening 334, the laterally directed cam surface 321 on the hook tab 316 of the hook member engages with the circumferentially directed first engagement surface 501 on the right distal end 463 of the frangible member 332. The cam surface 321 on the hook member 306 is angled to extend upwardly as it extends to the left and in engaging the right distal end 463 urges the right distal end 463 downwardly and to the left. The right distal end 463 of the frangible member 332 is angled to extend downwardly as it extends to the right and thus also assists in engagement with the cam surface or circumferentially directed second engagement surface 321 on the hook tab 316 to having forces that tend to urge the right distal end 463 of the frangible member 332 downwardly as is advantageous to sever the front and rear frangible holding members 468 and 467, permitting with further leftward movement of the hook member 306 for the hook member 306 to engage the frangible member 332 and pivot it downwardly about the living hinge member 466. In the unlatched rotational position, the hook 306 is aligned with the free passage opening 334, and the hook member 306 is free to move axially upwardly and downwardly through the free passage opening 334 in relative reciprocal movement of the piston assembly 101 and the cap assembly 100 to operate the pump assembly 41 to discharge fluid from the bottle 42. For example, from the fully retracted position shown in FIG. 37, the piston member 46 can be moved axially upwardly with the hook member 306 to pass upwardly through the free passage opening 334 as to extended as necessary for operation of the pump assembly 41 to discharge fluid from the bottle 42.

The frangible member 332 is configured such that when the frangible member 332 has been broken by breaking the thin rear frangible holding member 467 and the thin front frangible holding member 468 as is necessary to move from the latched transport configuration, the broken frangible member 332 will be visually apparent to a person inspecting the bottle assembly 40 preferably by the broken frangible member 332 extending downwardly below the support plate 29 as seen on FIG. 37.

As to the rotational forces that need to be applied to rotate the piston member 46 relative the bottle cap member 44 from the latched transport configuration to an unlatched configuration, the forces need to be sufficient to break the frangible member 332.

Where, as in the first embodiment in the latched transport configuration, a lower surface or first resistance surface 379 of the horizontal tube portion 128 of the piston member 46 is urged downwardly into engagement between two transport locating surfaces 384 and 380 provided on the bottle cap member 44, then the rotational forces that may need to be applied also need to overcome the resistance if any to rotational movement by the engagement between the left locating surface 384 carried on the bottle cap member 44 and the horizontal tube portion 128 of the piston member 46.

As with the first embodiment in the second embodiment, the bottle assembly 40 when having the bottle cap member 44 and the piston member 46 in the latched transport orientation as illustrated in FIG. 36 may be moved rearwardly to couple with the support member 22 of the dispenser 10 and in such rearward movement, the interaction between the bottle assembly 40 and the dispenser 10 preferably is such that engagement between the piston member 46 of the piston assembly 101 and the dispenser 10 will rotate the piston assembly 101 from the latched transport configuration to the unlatched rotational position ready for use.

The two embodiments disclosed show a bottle cap vent structure with a vent port sealed for transportation and to be opened for use of the bottle as to provide atmospheric air to enter the bottle through the bottle cap member as to relieve a vacuum that may be developed within the bottle 42. Preferably, the bottle 42 may be a non-collapsible bottle in the sense of being a bottle in which with the dispensing of fluid a substantial vacuum will arise within the bottle which would prevent further dispensing of fluid unless the vacuum is relieved as by air from the atmosphere. The bottle 42 need not be non-collapsible and could be, for example, a collapsible bottle or bag in which it may be advantageous to have the bottle or bag vented.

The preferred embodiments show the bottle cap vent structures as provided in arrangements which also include a transport latching system. This is not necessary and the vent structure may be provided independent of the transport latching system and vice versa. That is, with merely one of the vent structure and the transport latching system being provided.

The vent structures and the transport latching systems are shown in embodiments in which the bottle assembly 40 is used in conjunction with a dispenser 10 including a housing assembly 16. This is not necessary, for example, the bottle assembly 40 may be used as a free standing bottle supported on a surface such as a tabletop and manually manipulated to open the vent structure and/or to move from a transport latched position.

The bottle assembly 40 as described may be used for dispensing many different fluids including preferred hand cleaning fluids, however, this is not limited and fluids to be dispensed may be of almost any manner including cleaning products, hand creams, sunscreens, food products such as ketchup, mustard, relish, vinegar and olive oil and various industrial fluids such as lubricating oil and the like.

The preferred embodiments show one configuration of a piston pump, however, the invention is not limited to this particular configuration of a piston pump and many other versions of piston pumps are known in the art and may be utilized. The piston pump arrangement in the preferred embodiment is selected such that the pump arrangement will not permit fluid to flow out through the pump without movement of the piston member 46. This is preferred, but not necessary. Vent structures and the transport latching system in accordance with the present invention is useful in bottle assemblies in which the bottle 42 needs to be kept upright to prevent leakage of the fluid from the bottle.

The preferred embodiments illustrate an arrangement in which the bottle assembly 10 is used in association with the dispenser 10 including a housing. Such a dispenser is similar to that disclosed in U.S. Pat. No. 7,748,573 to Anhuf et al, the disclosure of which is incorporated herein by reference.

The preferred embodiments illustrate an arrangement in which, when used to dispense the fluid, the bottle assembly 40 has the bottle 42 in an upright position, that is, with the open end of the bottle disposed upwardly. This, however, is not necessary. In accordance with the present invention, the bottle assembly 40 may be adapted for insertion into a dispenser with the bottle assembly inverted so that the open end is disposed downwardly or in some other orientation in which case an arrangement is preferably to be added to merely permit air from the atmosphere to flow into the bottle 40 after the frangible member 60 has been broken but to prevent fluid from flowing out of the bottle. This arrangement could include a one-way inlet valve arrangement, for example, provided across an inlet to the vent port 58 to merely permit air from the atmosphere to flow into the bottle 40 after the frangible member 60 has been broken and when a vacuum condition exists within the bottle sufficient to permit air to pass inwardly into the bottle past the one-way inlet valve. The one-way inlet valve preferably has an inherent bias as to a closed position to prevent fluid within the bottle from flowing out of the bottle when the bottle is inverted and the frangible member 60 broken. Another arrangement could be a snorkel-like tube inside the bottle which extends upwardly from the inlet to the vent port 58 to a height above liquid in the bottle.

While the invention has been described with reference to preferred embodiments, many modifications and variations will now occur to persons skilled in the art. For a definition of the invention, reference is made to the accompanying claims.

We claim:

1. A bottle assembly including:

a bottle having an outlet opening, a bottle cap member secured to the bottle about the outlet opening, a vent port through the bottle cap member having an inner end open into the bottle and an outer end open to the atmosphere, a frangible plug member received in the vent port, the frangible plug member preventing flow through the vent port when the frangible plug member is intact and not broken, a vent tab on the exterior of the bottle cap member, the vent tab coupled to the frangible plug member, the vent tab extending from the frangible plug member accessible on the exterior of the bottle cap member for engagement to apply forces to the vent tab that become translated to the frangible plug member breaking the frangible plug member, the frangible plug member when broken permitting flow through the vent port, the vent tab coupled to the frangible plug member at a load juncture, the vent tab coupled to the bottle cap member at a fulcrum juncture spaced from the load juncture, the vent tab comprising a lever member extending from the fulcrum juncture away from the fulcrum juncture to a distal end carrying an engagement surface, wherein the load juncture, fulcrum juncture and engagement surface are juxtaposed such that with the application of forces to the engagement surface, the lever member pivots about the fulcrum juncture displacing the load juncture and applying forces across the frangible plug member to break the frangible plug member, and wherein either;

the load juncture is in between the fulcrum juncture and the engagement surface, or, the fulcrum juncture is in between the load juncture and the engagement surface.

2. A bottle assembly as claimed in claim 1 wherein the forces applied across the frangible plug member to break the frangible plug member are tension forces.

3. A bottle assembly as claimed in claim 2 wherein the lever member is accessible on the exterior of the bottle cap member for engagement to apply forces to the engagement surface to break the frangible plug member.

4. A bottle assembly as claimed in claim 1 wherein the lever member is accessible on the exterior of the bottle cap member for engagement to apply forces to the engagement surface to break the frangible plug member.

5. A bottle assembly as claimed in claim 1 wherein the bottle cap member is injected molded from plastic material integrally forming the vent port, the frangible plug member and the vent tab including the lever member, fulcrum juncture and load juncture with the frangible plug member intact closing the vent port.

6. A bottle assembly as claimed in claim 5 wherein the fulcrum juncture is flexible.

7. A bottle assembly as claimed in claim 1 wherein the bottle is enclosed but for the outlet opening.

8. A bottle assembly in combination with a dispenser having a housing to which the bottle assembly is removably coupled to dispense fluid from the bottle, a bottle assembly including;

a bottle having and outlet opening, a bottle cap member secured to the bottle about the outlet opening, a vent port through the bottle cap member having an inner end open into the bottle and an outer end open to the atmosphere, a frangible plug member received in the vent port, the frangible plug member preventing flow through the vent port when the frangible plug member is intact and not broken, a vent tab on the exterior of the bottle cap member, the vent tab coupled to the frangible plug member, the vent tab extending from the frangible plug member accessible on the exterior of the bottle cap member for engagement to apply forces to the vent tab that become translated to the frangible plug member breaking the frangible plug member, the frangible plug member when broken permitting flow through the vent port, the vent tab coupled to the frangible plug member at a load juncture, the vent tab coupled to the bottle cap member at a fulcrum juncture spaced from the load juncture, the vent tab comprising a lever member extending from the fulcrum juncture away from the fulcrum juncture to a distal end carrying an engagement surface, wherein the load juncture, fulcrum juncture and engagement surface are juxtaposed such that with the application of forces to the engagement surface, the lever member pivots about the fulcrum juncture displacing the load juncture and applying forces across the frangible plug member to break the frangible plug member, the bottle assembly movable relative the housing to couple the bottle assembly to the housing in a dispensing position for dispensing of the fluid from the bottle assembly, during movement of the bottle assembly relative the housing toward the dispensing position engagement between the engagement surface provided on the lever member and a cam surface on the housing applies forces to the lever member that pivots the lever member about the fulcrum juncture to break the frangible plug member.

9. A bottle assembly as claimed in claim 8 wherein the cam surface on the housing is directed in a forward direction, and the dispenser is mounted vertically, the bottle assembly is movable in rearward direction relative the housing to couple the bottle assembly to the housing in the dispensing position, the engagement surface is directed in the rearward direction, the cam surface on the housing is directed in a forward direction opposite to the rearward direction.

10. A bottle assembly as claimed claim 8 in the lever member extends from the fulcrum juncture to the distal end in the rearward direction and one or more of the group of:

a. upwardly or rearwardly, and b. laterally.

11. A bottle assembly as claimed in claim 8 wherein the bottle cap member is injected molded from plastic material integrally forming the vent port, the frangible plug member and the vent tab including the lever member, fulcrum juncture and load juncture with the frangible plug member intact closing the vent port.

12. A bottle assembly as claimed in claim 8 wherein either: the load juncture is in between the fulcrum juncture and the engagement surface, or, the fulcrum juncture is in between the load juncture and the engagement surface.

13. A bottle assembly as claimed in claim 12 wherein the lever member is accessible on the exterior of the bottle cap member for engagement to apply forces to the engagement surface to break the frangible plug member.

14. A bottle assembly in combination with a dispenser having a housing to which the bottle assembly is removably coupled to dispense fluid from a bottle, the bottle assembly comprising:

a bottle having an outlet opening, a bottle cap member secured to the bottle about the outlet opening, a vent port through the bottle cap member having an inner end open into the bottle and an outer end open to the atmosphere, a frangible plug member received in the vent port, the frangible plug member preventing flow through the vent port when the frangible plug member is intact and not broken, a vent tab on the exterior of the bottle cap member, the vent tab coupled to the frangible plug member, the vent tab extending from the frangible plug member to provide an engagement surface accessible on the exterior of the bottle cap member for engagement to apply forces to the vent tab that become translated to the frangible plug member breaking the frangible plug member, the frangible plug member when broken permitting flow through the vent port, the bottle assembly movable relative the housing to couple the bottle assembly to the housing in a dispensing position for dispensing of the fluid from the bottle assembly, during movement of the bottle assembly relative the housing toward the dispensing position engagement between the engagement surface provided on the vent tab and a cam surface on the housing applies forces to the vent tab that moves the vent tab to break the frangible plug member.

15. A bottle assembly as claimed in claim 14 wherein either: the load juncture is in between the fulcrum juncture and the engagement surface, or, the fulcrum juncture is in between the load juncture and the engagement surface.

16. A bottle assembly as claimed in claim 14 wherein the lever member is accessible on the exterior of the bottle cap member for engagement to apply forces to the engagement surface to break the frangible plug member.

17. A bottle assembly as claimed in claim 14 wherein the bottle cap member is injected molded from plastic material integrally forming the vent port, the frangible plug member and the vent tab including the lever member, fulcrum juncture and load juncture with the frangible plug member intact closing the vent port.

* * * * *